US008545200B2

(12) United States Patent
Watanabe et al.

(10) Patent No.: US 8,545,200 B2
(45) Date of Patent: Oct. 1, 2013

(54) VARIABLE DISPLACEMENT OIL PUMP

(75) Inventors: Yasushi Watanabe, Kanagawa (JP); Atsushi Naganuma, Atsugi (JP); Hideaki Ohnishi, Atsugi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 716 days.

(21) Appl. No.: 12/719,170

(22) Filed: Mar. 8, 2010

(65) Prior Publication Data

US 2010/0232989 A1 Sep. 16, 2010

(30) Foreign Application Priority Data

Mar. 11, 2009 (JP) ..... 2009-057396

(51) Int. Cl.
*F03C 2/00* (2006.01)
*F04C 2/00* (2006.01)
*F04C 14/18* (2006.01)

(52) U.S. Cl.
USPC ..... 418/24; 418/26; 418/27; 418/30; 417/220

(58) Field of Classification Search
USPC ..... 418/24–27, 30, 259–260, 266–268; 417/220, 219, 213, 410.3
See application file for complete search history.

(56) References Cited

U.S. PATENT DOCUMENTS

| | | | | |
|---|---|---|---|---|
| 4,531,893 | A * | 7/1985 | Okoh et al. | 417/220 |
| 5,090,881 | A * | 2/1992 | Suzuki et al. | 418/26 |
| 5,752,815 | A * | 5/1998 | Muller | 418/26 |
| 2008/0247894 | A1 * | 10/2008 | Lutoslawski et al. | 418/27 |
| 2008/0308062 | A1 | 12/2008 | Morita et al. | |
| 2009/0022612 | A1 | 1/2009 | Williamson et al. | |
| 2010/0014991 | A1 * | 1/2010 | Pryor et al. | 417/220 |

FOREIGN PATENT DOCUMENTS

| | | |
|---|---|---|
| JP | 4-17792 | 1/1992 |
| JP | 2008-82228 | 4/2008 |
| JP | 2008-309049 | 12/2008 |
| WO | WO 2006/066405 A1 | 6/2006 |

* cited by examiner

*Primary Examiner* — Theresa Trieu
(74) *Attorney, Agent, or Firm* — Antonelli, Terry, Stout & Kraus, LLP.

(57) ABSTRACT

Variable displacement oil pump includes a: rotor; vanes; cam ring; housing; biasing member biasing the cam ring in a direction enlarging an eccentricity between centers of the rotor and inner circumferential surface of the cam ring; a contact surface to contact with a cam ring outer circumferential surface via a biasing force applied to the cam ring by the biasing member; a control chamber separately formed by the contact surface and a swing fulcrum of the cam ring on a cam ring outer circumference when the contact surface contacts the cam ring outer circumferential surface, and causing the cam ring to swing against the biasing force of the biasing member by a pressure from a discharge portion to the control chamber; and a choking portion formed on the outer circumferential surface of the cam ring to maintain a pressure of the control chamber even when the cam ring swings.

19 Claims, 20 Drawing Sheets

VARIABLE DISPLACEMENT OIL PUMP

BACKGROUND OF THE INVENTION

The present invention relates to a variable displacement oil pump.

U.S. Patent Application Publication No. 2009/0022612 (corresponding to International Publication No. 2006/066405) discloses a previously-proposed oil pump. In this technique, a control chamber is separately formed by providing a sealing member between a cam ring and a housing. Pressure of this control chamber swings the cam ring so that a capacity of the oil pump is variably controlled.

SUMMARY OF THE INVENTION

However, in the above previously-proposed oil pump, there is a problem of increase in number of components because the additional sealing member is provided for separately forming the control chamber.

It is therefore an object of the present invention to provide a variable displacement oil pump devised to suppress the number of components.

According to one aspect of the present invention, there is provided a variable displacement oil pump comprising: a rotor configured to rotationally driven by an internal combustion engine; a plurality of vanes movable out from and into an outer circumferential portion of the rotor; a cam ring receiving the rotor and the plurality of vanes in an inner circumferential space of the cam ring, cooperating with side walls, the rotor and the plurality of vanes to separately form a plurality of working-oil chambers, wherein the side walls are provided on both axial side surfaces of the cam ring, and configured to swing about a swing fulcrum to vary an eccentricity between a rotation center of the rotor and a center of an inner circumferential surface of the cam ring; a housing receiving the cam ring therein, comprising a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and comprising a suction portion open to at least one of the plurality of working-oil chambers from at lest one of the side walls, wherein the at least one of the plurality of working-oil chambers to which the suction portion is open increases its volume when the center of the inner circumferential surface of the cam ring becomes eccentric relative to the rotation center of the rotor; a biasing member configured to bias the cam ring in a direction that enlarges the eccentricity between the rotation center of the rotor and the center of the inner circumferential surface of the cam ring; a contact surface configured to become in contact with an outer circumferential surface of the cam ring by means of a biasing force applied to the cam ring by the biasing member; a control chamber separately formed by the contact surface and the swing fulcrum of the cam ring on an outer circumference of the cam ring when the contact surface is in contact with the outer circumferential surface of the cam ring, and configured to cause the cam ring to swing against the biasing force of the biasing member by a pressure introduced from the discharge portion to the control chamber; and a choking portion formed on the outer circumferential surface of the cam ring so as to maintain a pressure of the control chamber even when the cam ring swings.

According to another aspect of the present invention, there is provided a variable displacement oil pump comprising: a rotor configured to rotationally driven; a plurality of vanes movable out from and into an outer circumferential portion of the rotor; a cam ring receiving the rotor and the plurality of vanes in an inner circumferential space of the cam ring, cooperating with side walls, the rotor and the plurality of vanes to separately form a plurality of working-oil chambers, wherein the side walls are provided on both axial side surfaces of the cam ring, and configured to swing about a swing fulcrum to vary an eccentricity between a rotation center of the rotor and a center of an inner circumferential surface of the cam ring, wherein the swing fulcrum is formed over an entire axial range of the cam ring; a housing receiving the cam ring therein, comprising a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and comprising a suction portion open to at least one of the plurality of working-oil chambers from at lest one of the side walls, wherein the at least one of the plurality of working-oil chambers to which the suction portion is open increases its volume when the center of the inner circumferential surface of the cam ring becomes eccentric relative to the rotation center of the rotor; a biasing member configured to bias the cam ring in a direction that enlarges the eccentricity between the rotation center of the rotor and the center of the inner circumferential surface of the cam ring; a contact portion configured to become in contact with an entire axial range of an outer circumferential surface of the cam ring by means of a biasing force applied to the cam ring by the biasing member; a control chamber provided at a portion of an outer circumferential space of the cam ring which is located in the direction that enlarges the eccentricity of the cam ring and which is between the contact portion and the swing fulcrum of the cam ring, wherein the control chamber is open to the discharge portion; and a choking portion formed in a portion of the outer circumferential surface of the cam ring which is located in the direction that enlarges the eccentricity of the cam ring, wherein the choking portion has a shape extending along a swing path of the cam ring.

According to still another aspect of the present invention, there is provided a variable displacement oil pump comprising: a rotor configured to rotationally driven by an internal combustion engine; a plurality of vanes movable out from and into an outer circumferential portion of the rotor; a cam ring receiving the rotor and the plurality of vanes in an inner circumferential space of the cam ring, cooperating with side walls, the rotor and the plurality of vanes to separately form a plurality of working-oil chambers, wherein the side walls are provided on both axial side surfaces of the cam ring, and configured to swing about a swing fulcrum to vary an eccentricity between a rotation center of the rotor and a center of an inner circumferential surface of the cam ring; a housing receiving the cam ring therein comprising a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and comprising a suction portion open to at least one of the plurality of working-oil chambers from at lest one of the side walls, wherein the at least one of the plurality of working-oil chambers to which the suction portion is open increases its volume when the center of the inner circumferential surface of the cam ring becomes eccentric relative to the rotation center of the rotor; a biasing member configured to bias the cam ring in a direction that enlarges the eccentricity between the rotation center of the rotor and the center of the inner circumferential surface of the cam ring; a stopper portion configured to restrict a swing of the cam ring in a direction that increases the eccentricity between the rotation center of the rotor and the center of the inner circumferential surface of the cam ring; a first choking portion configured to face an outer circumferential surface of the cam ring under a state where the swing of the cam ring is stopped by the stopper portion; a second choking portion configured to face the outer circumferential surface of the cam ring irrespective of a swing state of the cam ring; and a control chamber separately formed on an outer circumference of the cam ring by the first choking portion, the second choking portion and the swing fulcrum of the cam ring under the state where the swing of the cam ring is stopped by the stopper portion, separately formed on the outer circumference of the cam ring by the second choking portion and the swing fulcrum of the cam ring under a state where the cam ring swings against a biasing force of the biasing member, and configured to cause the cam ring to swing against the biasing force of the biasing member by a pressure introduced from the discharge portion to the control chamber.

The other objects and features of this invention will become understood from the following description with reference to the accompanying drawings.

DETAILED DESCRIPTION OF THE INVENTION

Reference will hereinafter be made to the drawings in order to facilitate a better understanding of the present invention. Embodiments of variable displacement oil pump according to the present invention will be explained below.

First Embodiment

A variable displacement oil pump (hereinafter referred to as, pump VP) in a first embodiment according to the present invention is a vane pump whose displacement (capacity) can be varied. The pump VP is used for an internal combustion engine (hereinafter referred to as, engine) of an automotive vehicle. The pump VP is provided, for example, at a front end portion of a cylinder block of the engine. The pump VP functions to supply fluid (working oil) for lubrication and the like, to respective sliding portions of the engine and a variable valve operating apparatus (such as a valve timing control apparatus) for variably controlling an operating characteristic of valve of the engine.

(Structure of Pump)

Figure 1:
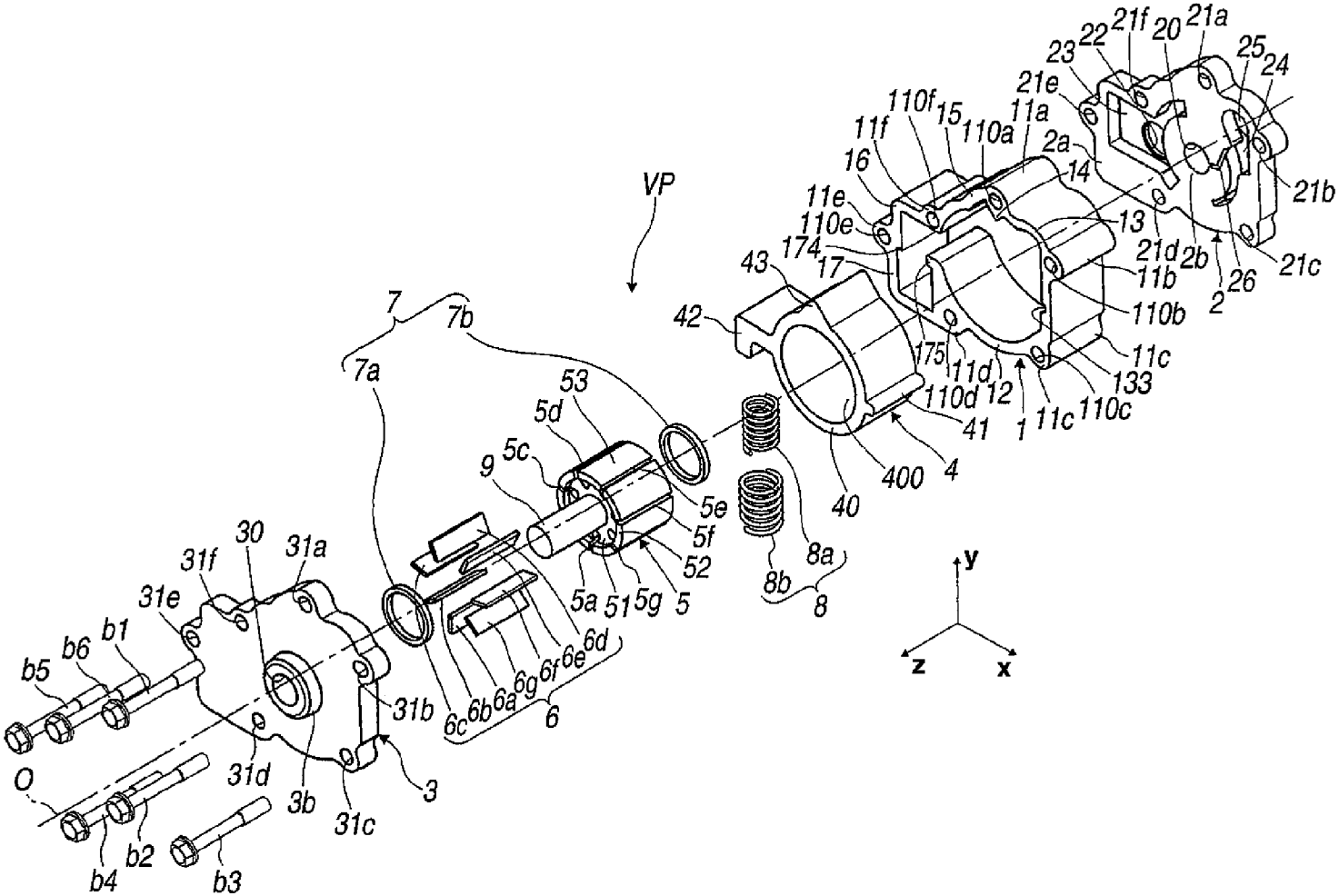
FIG. 1 is an exploded oblique perspective view of a pump in a first embodiment according to the present invention.

FIG. 1 is an exploded oblique perspective view of the pump VP. The pump VP includes a housing body (main housing) 1, a rear cover 2, a front cover 3, a cam ring 4, a rotor 5, a plurality of vanes 6, a pair of vane rings 7, a biasing member 8, and a drive shaft 9. For purpose of explanation, a direction in which a central axis O of the drive shaft 9 extends is defined as z-axis, and a positive direction of z-axis is defined by a direction toward the front cover 3 from the rear cover 2.

The housing body 1, the rear cover 2 and front cover 3 constitute a housing HSG of the pump VP. That is, the housing body 1 cooperates with the rear cover 2 and front cover 3 to define the housing HSG. The housing body 1 is a housing member formed in a hollow cylindrical (tubular) shape. An inner circumferential space of the housing body 1 receives pump components such as the cam ring 4 and the rotor 5. The rear cover 2 and the front cover 3 are plate-shaped housing members, and are sidewalls (side plates) which cover or enclose both open ends of the housing body 1. The rear cover 2 includes a bearing portion 2*b* at a substantially center of the rear cover 2. This bearing portion 2*b* is formed with a bearing hole 20 passing through the rear cover 2 in the z-axis direction. That is, the bearing hole 20 is formed to pass through an inner circumference of the bearing portion 2*b*. The front cover 3 includes a bearing portion 3*b* at a substantially center of the front cover 3. This bearing portion 3*b* is formed with a bearing hole 30 passing through the front cover 3 in the z-axis direction. That is, the bearing hole 30 is formed to pass through an inner circumference of the bearing portion 3*b*. The bearing hole 20 and the bearing hole 30 are provided substantially coaxially with each other, about the central axis O. The housing body 1, the rear cover 2 and the front cover 3 are molded of aluminum-based metallic material (aluminum alloy) by means of die casting.

As viewed in the z-axis direction, outer circumferential shapes of the housing body 1, the rear cover 2 and the front cover 3 are substantially identical with one another. The housing body 1 includes a plurality of (six) bolt-hole forming portions 11*a* to 11*f* protruding in a radially outer direction from an outer circumferential surface (of a base portion) of the housing body 1. The bolt-hole forming portions 11*a* to 11*f* are respectively formed with bolt holes 110*a* to 110*f* passing through the housing body 1 (passing through the bolt-hole forming portions 11*a* to 11*f*) in the z-axis direction. Also, the rear cover 2 is formed with bolt holes 21*a* to 21*f* passing through the rear cover 2, and the front cover 3 is formed with bolt holes 31*a* to 31*f* passing through the front cover 3. These bolt holes 21*a* to 21*f* and the bolt holes 31*a* to 31*f* are provided respectively at positions corresponding to the bolt holes 110*a* to 110*f* of the housing body 1. A female thread (internal screw) is formed at an inner circumference of each of the bolt holes 21*a* to 21*f* of the rear cover 2. A plurality of (six) bolts b1 to b6 are inserted respectively into the bolt holes 31*a* to 31*f* of front cover 3 and the bolt holes 110*a* to 110*f* of housing body 1, in a negative direction of z-axis. A male thread (external screw) of a tip portion of each bolt b1 to b6 is screwed in the female thread of the corresponding bolt hole 21*a* to 21*f* of rear cover 2. Thereby, these housing members are integrally fastened to one another, to define the housing HSG. The housing HSG includes a suction portion and a discharge portion of the pump VP.

The drive shaft 9 is arranged to pass through the bearing hole 20 of rear cover 2 and the bearing hole 30 of front cover 3, and is supported rotatably by the bearing portions 2*b* and 3*b*. The rotor 5 is connected with an outer circumference (i.e., outer peripheral surface) of the drive shaft 9. Thereby, the rotor 5 rotates integrally with (as a unit with) the drive shaft 9. A z-axial positive-directional end of the drive shaft 9 (an end of drive shaft 9 on a positive side relative to z-axis) is connected with a crank shaft of the engine. The drive shaft 9 is rotationally driven by a rotational force (torque) transmitted from the crank shaft, so that the drive shaft 9 is rotated in a clockwise direction as viewed from the positive side of z-axis.

Figure 2:
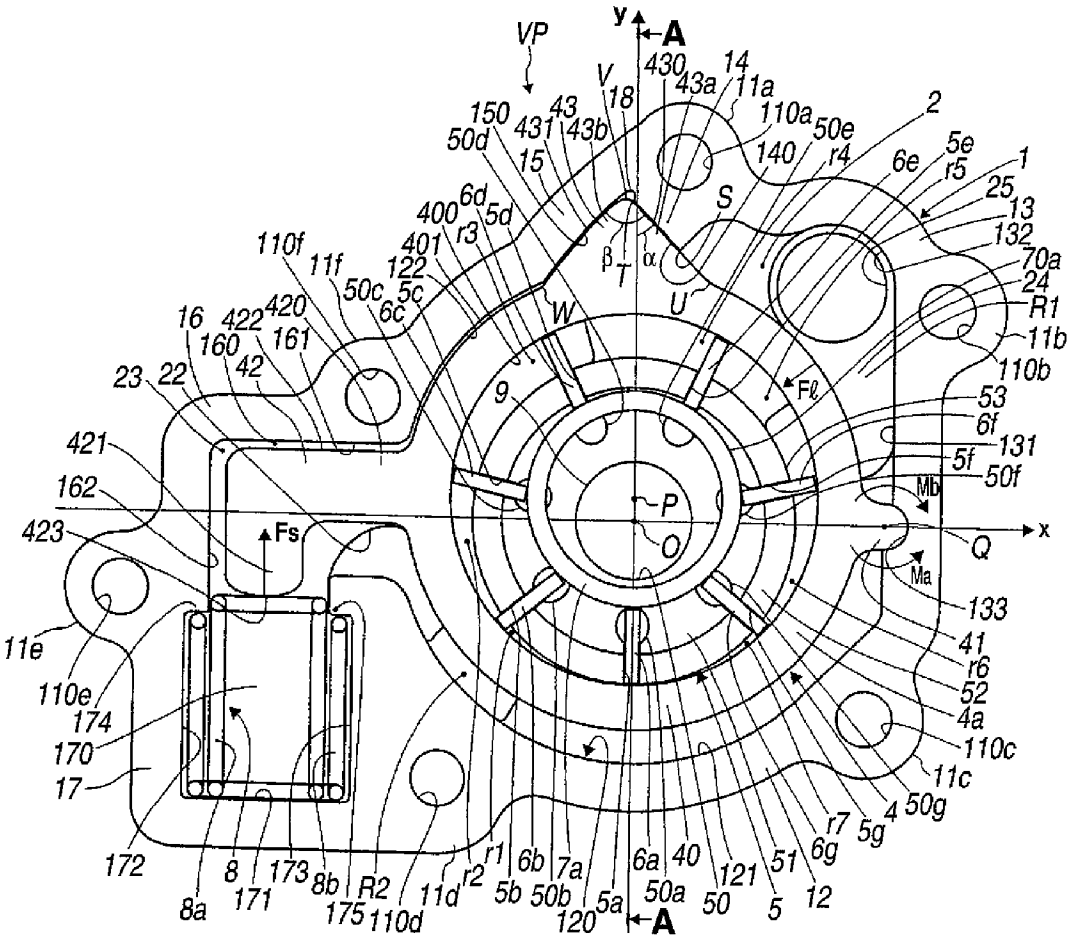
FIG. 2 is a front view of the pump in the first embodiment (initial setting state).

The rotor 5 is rotationally driven by the drive shaft 9, namely by the engine. A plurality of vanes 6*a* to 6*g* are provided to allow the vanes 6*a* to 6*g* to rise and fall relative to an outer circumferential surface of the rotor 5. That is, each vane 6*a* to 6*g* can move in a radial direction of drive shaft 9 at an outer circumferential portion of the rotor 5. The cam ring 4 accommodates the rotor 5 and the vanes 6*a* to 6*g* in an inner space of the cam ring 4. By arranging the rear cover 2 and the front cover 3 respectively on z-axis directional both side surfaces of the cam ring 4, a plurality of working-oil chambers are separately formed. That is, the vanes 6*a* to 6*g* cooperate with the rear cover 2, the front cover 3, the cam ring 4 and the rotor 5 to define the plurality of working-oil chambers. The cam ring 4 moves or swings about a swing fulcrum Q, in accordance with a discharge pressure. Thereby, an eccentricity amount between the rotation center O of the rotor 5 and a center P of an inner circumferential surface 400 of the cam ring 4 is varied as shown in FIG. 2. The biasing member 8 biases or urges the cam ring 4 in a direction that enlarges the eccentricity amount.

Figure 3:
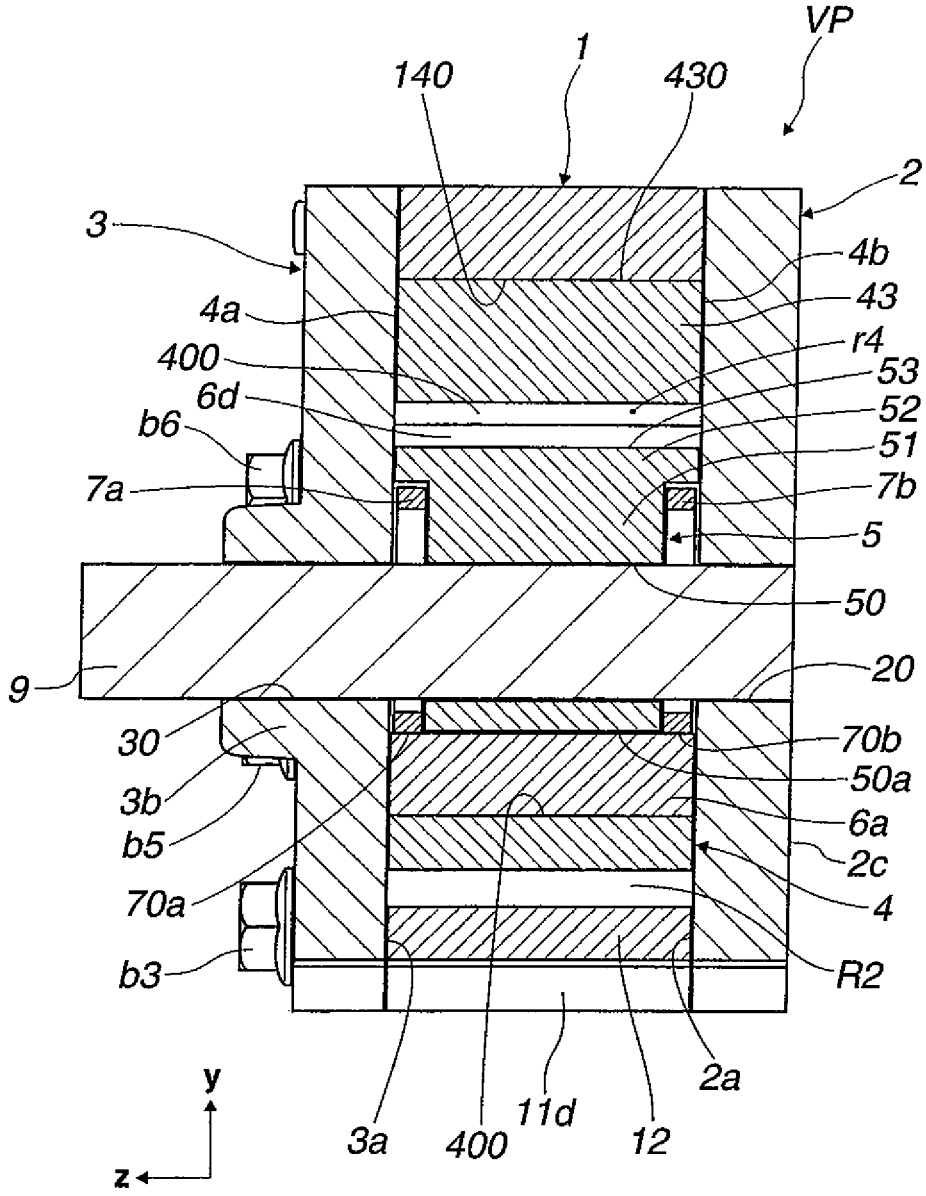
FIG. 3 is an axially cross-sectional view of the pump in the first embodiment, taken along a line A-A of FIG. 2 (as viewed in a direction of arrows A and A).
Figure 6:
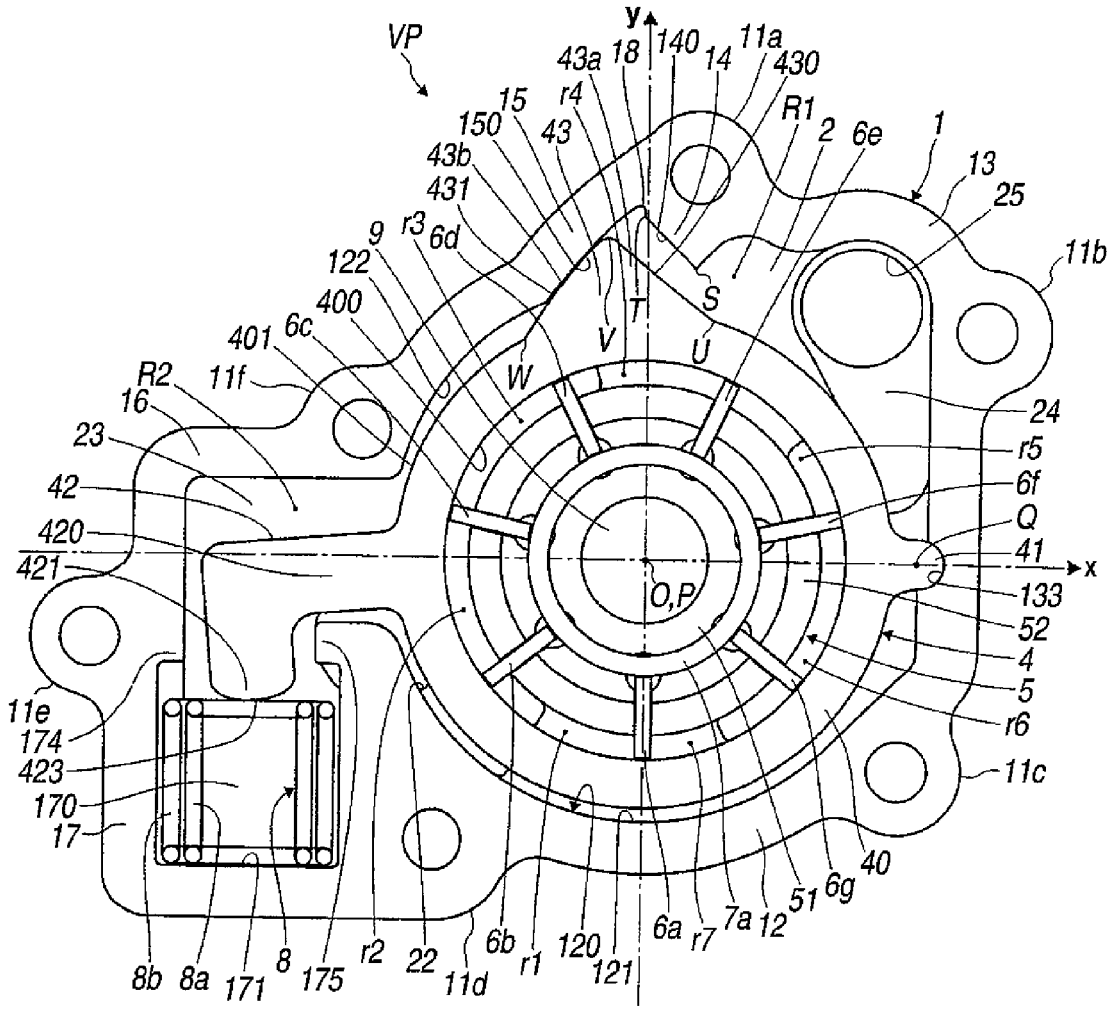
FIG. 6 is a front view of the pump in the first embodiment (minimum eccentricity state).

FIGS. 2 and 6 are front views of the pump VP under a state where the front cover 3 has been removed, as viewed from the positive side of z-axis. FIG. 3 is a cross-sectional view of the pump VP, taken along a plane including the center axis O of drive shaft 9. That is, FIG. 3 is a view of the pump VP when viewed in a direction A of FIG. 2. Hereinafter, for purpose of explanation, orthogonal coordinates regarding the center O as a coordinate origin are defined. X-axis of the orthogonal coordinates is set perpendicularly to an axis of the biasing member 8, and y-axis of the orthogonal coordinates is set parallel to the axis of the biasing member 8. A positive direction of x-axis is defined by a side of a discharge hole 25 relative to y-axis (center O), and a negative direction of y-axis is defined by a side of the biasing member 8 relative to x-axis (center O). The drive shaft 9 (rotor 5) rotates around the center O in the clockwise direction of FIG. 2.

FIG. 2 shows an initial setting state (maximum eccentricity state) of the pump VP in which the eccentricity amount of cam ring 4 is at its maximum and in which a swing amount of the cam ring 4 (i.e., a swing angle of cam ring 4 by its swing motion) is at its minimum (=zero). The eccentricity amount of cam ring 4 is represented by an amount of displacement of the center P of inner circumferential surface 400 relative to the rotation center O of rotor 5, namely, is represented by a distance between the center O and the center P. FIG. 6 shows an operating state (minimum eccentricity state) of the pump VP in which the swing amount of cam ring 4 is at its maximum and in which the eccentricity amount of cam ring 4 is at its minimum, namely, in which a relative displacement amount between the center P and the center O is equal to 0 (P=O). Hereinafter, the position of the cam ring 4 under the initial setting state will be referred to as "initial setting position", and the position of the cam ring 4 under the operating state of FIG. 6 will be referred to as "minimum eccentricity position".

(Structure of Housing)

The housing body 1 is constituted by a circumferential wall including the bolt-hole forming portions 11*a* to 11*f* at predetermined intervals. At predetermined regions of the circumferential wall, the housing body 1 includes a cam-ring-main-body receiving portion 12, a discharge hole forming portion 13, a protruding portion 14, a choke forming portion (flow-restricting portion) 15, an arm receiving portion 16 and a biasing-member receiving portion 17. Z-axis directional widths of these respective portions 11 to 17 are designed to be substantially identical with one another, namely have an approximately equal magnitude of H.

The cam-ring-main-body receiving portion 12 is formed in a substantially tubular shape (hollow circular-cylindrical shape) and is accommodating a main body portion 40 of the cam ring 4. An inner circumferential surface 120 of the cam-ring-main-body receiving portion 12 is in a substantially circular shape regarding the center O as its origin, as viewed in the z-axis direction. The inner circumferential surface 120 includes a y-axis negative-side inner circumferential surface 121 and a y-axis positive-side inner circumferential surface 122. A radius of the y-axis negative-side inner circumferential surface 121 is substantially constant. On the other hand, a radius of the y-axis positive-side inner circumferential surface 122 at a given point of the y-axis positive-side inner circumferential surface 122 becomes gradually larger as the given point is advanced in the y-axis positive direction, slightly as compared with the radius of the inner circumferential surface 121.

The discharge hole forming portion 13 is provided in an x-axis positive and y-axis positive side of the housing body 1, so as to protrude in the radially outer direction of the housing body 1. An x-axis positive-side inner circumferential surface 131 of the discharge hole forming portion 13 is formed in a linear shape substantially parallel to y-axis, as viewed in the z-axis direction. A y-axis positive-side portion of the discharge hole forming portion 13 extends substantially in the x-axis direction between the bolt-hole forming portions 11*a* and 11*b*. An inner circumferential surface 132 of the y-axis positive-side portion of discharge hole forming portion 13 is formed in a circular-arc shape along an outer circumference of the discharge hole 25 (i.e. along a shape of the discharge hole 25) provided in the rear cover 2.

The inner circumferential surface 131 is formed with a pivot setting portion 133 provided at a point on x-axis (a point through which x-axis passes). This pivot setting portion 133 is formed over the z-axis directional entire range of the housing body 1; and is a concave portion formed in a substantially semicircle shape regarding the point (swing fulcrum) Q as its center, as viewed in the z-axis direction. A radius of the pivot setting portion 133 is slightly smaller than those of the bolt holes 110*a* to 110*f*. An x-axis directional position of the point Q is approximately equal to that of the x-axis positive-side inner circumferential surface 131 of discharge hole forming portion 13, i.e., the point Q substantially accords with the inner circumferential surface 131 with respect to x-coordinate. A y-axis directional position of the point Q is approximately equal to that of the center O, i.e., the point Q is located on x-axis. A y-axis negative-side portion of the discharge hole forming portion 13 relative to the pivot setting portion 133 is formed to be a little thicker than a y-axis positive-side portion of the discharge hole forming portion 13 relative to the pivot setting portion 133.

The protruding portion 14 is formed continuously from the discharge hole forming portion 13, and is located in the y-axis positive side of the housing body 1. Moreover, the protruding portion 14 is located at an x-axis positive-directional region slightly beyond the center O (y-axis). The protruding portion 14 is provided on a radially inner side of the bolt-hole forming portion 11*a* (bolt hole 110*a*). Hereinafter, a side or direction toward the center O will be referred to as "radially inner side" or "radially inner direction", and moreover, a side or direction away from the center O will be referred to as "radially outer side" or "radially outer direction". The protruding portion 14 is a stopper forming portion protruding in the radially inner direction. The protruding portion 14 is formed in a substantially triangle shape having its vertex S in a radially inner side of the protruding portion 14, as viewed in the z-axis direction. An x-axis positive side of the protruding portion 14 (x-axis positive-directional sideline of the above-mentioned triangle) is continuous with the inner circumferential surface 132 of discharge hole forming portion 13 via a smoothly curved surface. An x-axis negative side of the protruding portion 14 (x-axis negative-directional sideline of the above-mentioned triangle) includes a contact surface 140.

The contact surface 140 is formed over a z-axis directional entire range (of a part) of the inner circumferential surface of the housing body 1. The contact surface 140 is parallel to z-axis, and is a plane facing in the x-axis negative and also y-axis negative direction. An angle between y-axis and the contact surface 140 is equal to $\alpha$ ($0° < \alpha < 90°$). The contact surface 140 is inclined by a slight angle in a counterclockwise direction of FIG. 2 with respect to a straight line Q-S (when regarding the point Q as its center). Note that this straight line Q-S is an imaginary line passing through the point Q and the y-axis negative-directional end (vertex S) of the contact surface 140.

The choke forming portion 15 is provided adjacent to (next to) the protruding portion 14, and is sandwiched between the protruding portion 14 and an x-axis positive side (of the y-axis positive-side portion) of the cam-ring-main-body receiving portion 12. The choke forming portion 15 includes a choke forming surface (flow-restricting surface) 150 formed in an inner circumferential side of the choke forming portion 15. The choke forming surface 150 is a moderately curved surface formed in an circular-arc shape regarding the point Q as its center, as viewed in the z-axis direction. The choke forming surface 150 is adjacent to the contact surface 140, and forms some angle with the contact surface 140. As viewed in the z-axis direction, the choke forming surface 150 and the contact surface 140 are arranged so as to form a substantially triangle shape having its vertex in their radially outer sides. An angle between the both surfaces 150 and 140 is equal to $\beta$ ($\beta \approx 90°$) as viewed in the z-axis direction.

A notched groove 18 is provided at a boundary between the choke forming surface 150 and the contact surface 140, and is adjacent to a y-axis positive-directional (x-axis negative directional) end T of the contact surface 140. The notched groove 18 is a concave portion obtained by drilling the housing body 1 from the contact surface 140 in the x-axis positive and y-axis positive direction. The notched groove 18 is formed in the inner circumferential surface of the housing body 1, over the z-axis directional entire range of the inner circumferential surface of the housing body 1. An x-axis negative side of the notched groove 18 is smoothly continuous with the choke forming surface 150 (i.e., without forming a large angle therebetween), and on the other hand, an x-axis positive side of the notched groove 18 is continuous with the contact surface 140 so as to form some angle therebetween.

The arm receiving portion 16 and the biasing-member receiving portion 17 are integrally formed in a substantially hollow rectangular parallelepiped shape, and are provided in the x-axis negative and y-axis negative side of the housing body 1 (cam-ring-main-body receiving portion 12). These of the arm receiving portion 16 and biasing-member receiving portion 17 are formed to bulge out (to protrude in an expanded condition) in the radially outer direction. The arm receiving portion 16 is provided to straddle x-axis, and is formed with an arm-portion receiving chamber 160. The arm-portion receiving chamber 160 is formed on an inner circumference of the arm receiving portion 16, and receives or accommodates an arm portion 42 of the cam ring 4. The arm-portion receiving chamber 160 is formed in a substantially rectangular shape regarding x-axis direction as its longitudinal direction, as viewed in the z-axis direction. The arm-portion receiving chamber 160 is surrounded by a surface 161 substantially parallel to x-axis and a surface 162 substantially parallel to y-axis, at two sides of the arm-portion receiving chamber 160. The arm-portion receiving chamber 160 is open to the inner circumferential side (space) of the cam-ring-main-body receiving portion 12, on an x-axis positive side of the arm-portion receiving chamber 160. The arm-portion receiving chamber 160 is open to an after-mentioned spring chamber 170, on a y-axis negative side of the arm-portion receiving chamber 160.

The biasing-member receiving portion 17 is provided to be continuous with an x-axis negative side of (a y-axis negative-side portion of) the cam-ring-main-body receiving portion 12. The biasing-member receiving portion 17 is formed with the spring chamber 170 for accommodating or receiving the biasing member 8, inside an inner circumference of the biasing-member receiving portion 17. The spring chamber 170 is formed in a substantially rectangular shape regarding y-axis direction as its longitudinal direction, as viewed in the z-axis direction. The spring chamber 170 is surrounded by a bottom surface 171 substantially parallel to x-axis and two side surfaces 172 and 173 substantially parallel to y-axis, at three sides of the spring chamber 170. The spring chamber 170 is open to the arm-portion receiving chamber 160, on a y-axis positive side of the spring chamber 170. This opening portion (of spring chamber 170) to the arm-portion receiving chamber 160 is formed by stopping portions 174 and 175 which face each other in the x-axis direction. The stopping portions 174 and 175 are formed to extend over the z-axis directional entire range of the housing body 1. The x-axis negative-directional stopping portion 174 protrudes from a y-axis positive-directional end of the side surface 172 of spring chamber 170 in the x-axis positive direction by a predetermined amount. The x-axis positive-directional stopping portion 175 protrudes from a y-axis positive-directional end of the side surface 173 of spring chamber 170 in the x-axis negative direction by a predetermined amount. That is, an x-axis directional width (a distance between the stopping portions 174 and 175 in the x-axis direction) of the opening portion of spring chamber 170 is shorter than an x-axis directional width of the spring chamber 170 except the opening portion.

Figure 4:
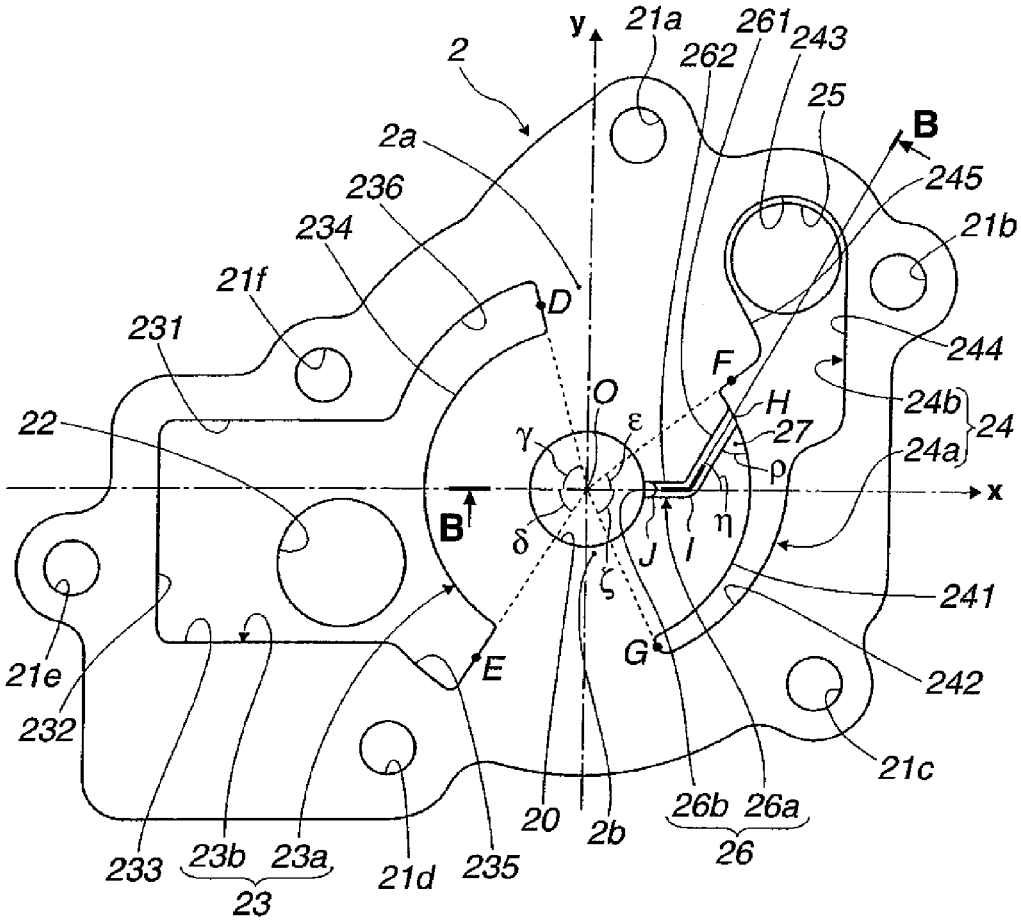
FIG. 4 is a front view of a rear cover in the first embodiment.

FIG. 4 is a front view of the rear cover 2, as viewed from the z-axis positive side. The rear cover 2 is formed with the bearing hole 20, the bolt holes 21*a* to 21*f*, a suction hole 22, a suction port 23, a discharge port 24, the discharge hole 25 and a bearing oil-feeding groove 26.

When the cam ring 4 swings, a z-axis negative-side surface 4*b* of the cam ring 4 slides in contact with (moves along) a z-axis positive-side surface 2*a* of the rear cover 2 (see FIG. 3). Therefore, the z-axis positive-side surface 2*a* has undergone a machining process with a high accuracy of flatness, surface roughness and the like, in a sliding range of the cam ring 4. In the explanations of the respective embodiments according to the present invention, the "slide (sliding)" or "slide in contact" means not only a state where one member (surface) relatively moves directly in contact with another member (surface), but also a state where one member (surface) relatively moves indirectly in contact with another member (surface) on condition that an oil film has been formed between the one member and the another member.

The suction port 23 is a groove (space) formed to have a predetermined depth in the surface 2*a* of rear cover 2. The suction port 23 includes a groove (space) 23*a* formed in a falcate (sublunate) shape having a predetermined width, and a groove (space) 23*b* formed in a rectangular shape. The rectangular-shaped groove 23*b* is formed on an x-axis negative side of the falcate-shaped groove 23*a* and is formed to cause a y-axis directional center of the groove 23*b* to be deviated from a y-axis directional center of the groove 23*a* in the y-axis negative direction. The rectangular-shaped groove 23*b* is continuous with the falcate-shaped groove 23*a*. As viewed so in the z-axis direction; a y-axis positive-side edge 231 of the rectangular-shaped groove 23*b* extends in the x-axis direction, and is located to substantially accord with (overlap with) the inner circumferential surface 161 of the arm receiving portion 16 of housing body 1. As viewed in the z-axis direction; an x-axis negative-side edge 232 of the rectangular-shaped groove 23*b* extends in the y-axis direction, and is located to substantially accord with (overlap with) the inner circumferential surface 162 of the arm receiving portion 16. Moreover, as viewed in the Z-axis direction; a y-axis negative-side edge 233 of the rectangular-shaped groove 23*b* extends in the x-axis direction, and is located to cross an inside of the spring chamber 170 of housing body 1.

As viewed in the z-axis direction, an inner circumferential edge 234 which is a radially-inner side edge of the falcate-shaped groove 23*a* is formed in a circular-arc shape regarding the center O as a center of this circular-arc shape, over a predetermined range of angle (∠DOE). An outer circumferential edge of the falcate-shaped groove 23*a* which is a radially-outer side edge of the falcate-shaped groove 23*a* is formed in a circular-arc shape. As viewed in the z-axis direction, a y-axis negative-side portion 235 of this outer circumferential edge is located to substantially accord with (overlap with) the y-axis negative-side inner circumferential surface 121 of the cam-ring-main-body receiving portion 12 of housing body 1. A y-axis positive-side portion 236 of the outer circumferential edge of the falcate-shaped groove 23*a* is also formed in a circular-arc shape regarding the center O as its center. As viewed in the z-axis direction, the y-axis positive-side portion 236 is located to have some distance (margin) from the y-axis positive-side inner circumferential surface 122 of cam-ring-main-body receiving portion 12 in the radially inner direction. A portion of the falcate-shaped groove 23*a* which is continuous with a y-axis negative side portion of the rectangular-shaped groove 23*b* has a greater radial width than a portion of the falcate-shaped groove 23*a* which is continuous with a y-axis positive side portion of the rectangular-shaped groove 23*b*. An angle between (negative direction of) x-axis and an imaginary straight line connecting the center O with the y-axis positive-directional end D of falcate-shaped groove 23*a* is equal to $\gamma$ ($0° < \gamma < 90°$. An angle between (negative direction of) x-axis and an imaginary straight line connecting the center O with the y-axis negative-directional end E of falcate-shaped groove 23*a* is equal to $\delta$($0° < \delta < \gamma$).

The suction hole 22 is an opening portion passing through the rear cover 2 in the z-axis direction, and is formed in a circular-cylindrical shape. A diameter of the suction hole 22 is slightly greater than that of the bearing hole 20. As viewed in the z-axis direction, the suction hole 22 is located within a range of the suction port 23, and is deviated in the y-axis negative direction from a center of the suction port 23. Specifically, the suction hole 22 is located in an x-axis positive side of the rectangular-shaped groove 23*b*, and is located at a position somewhat advanced from the x-axis in the y-axis negative direction. The suction hole 22 is open to the suction port 23 so as to partly straddle the falcate-shaped groove 23*a*. The suction hole 22 is communicated with the suction port 23, and thereby communicated through the suction port 23 with the inside (space) of the housing body 1. The suction hole 22 functions as a passage for sucking working oil into the inside of pump VP.

As shown in FIG. 2, as viewed in the z-axis direction; a y-axis negative side of the suction hole 22 is located to partly overlap with the stopping portion 175, and an x-axis positive side of the suction hole 22 is located to partly overlap with the cam ring 4. Moreover, the inner circumferential edge 234 of falcate-shaped groove 23*a* is located on an inner circumferential side of the cam ring 4 (i.e., located radially inside the inner circumferential surface 400 of cam ring 4). The y-axis positive-side outer circumferential edge 236 is located to overlap with the cam ring 4. That is, an radially-inner side of falcate-shaped groove 23*a* is open to the inner circumferential space (pump chambers r1 to r4) of cam ring 4. The other portion (rectangular-shaped groove 23*b* and a part of the y-axis negative side of falcate-shaped groove 23*a*) of the suction port 23 and the suction hole 22 are open to an outer circumferential side of the cam ring 4, namely open to a radially outside (backpressure chamber R2) of outer circumferential surface of cam ring 4.

The discharge port 24 is a groove (space) formed to have a predetermined depth in the surface 2*a* of rear cover 2. The discharge port 24 includes a groove (space) 24*a* formed in a falcate shape, and a groove (space) 24*b* formed in a raindrop shape. An inner circumferential edge 241 of the falcate-shaped groove 24*a* is formed in a circular-arc shape regarding the center O as its center, and has a radius substantially equal to that of the inner circumferential edge 234 of falcate-shaped groove 23*a* of suction port 23. The falcate-shaped groove 24*a* (the inner circumferential edge 241) is provided over a predetermined range of angle (∠FOG). An outer circumferential edge 242 of the falcate-shaped groove 24*a* is formed in a circular-arc shape regarding the center O as its center, but a radius (distance to the center O) of this arc-shaped outer circumferential edge 242 at a given point of the outer circumferential edge 242 becomes slightly larger gradually as the given point is advanced in the y-axis positive direction. That is, the falcate-shaped groove 24*a* is designed to allow a width of falcate-shaped groove 24*a* to become slightly broader from a y-axis negative-directional end thereof toward a y-axis positive-directional end thereof. An angle between (positive direction of) x-axis and an imaginary straight line connecting the center O with the y-axis positive-directional end F of the falcate-shaped groove 24*a* is equal to $\epsilon$ ($0° < \epsilon < \delta$). An angle between (positive direction of) x-axis and an imaginary straight line connecting the center O with the y-axis negative-directional end G of falcate-shaped groove 24*a* is equal to $\zeta$ ($\epsilon < \zeta < \gamma$).

The raindrop-shaped groove 24*b* is continuous with the falcate-shaped groove 24*a*, and is provided on an x-axis positive and y-axis positive side of the falcate-shaped groove 24*a*. An edge 243 of the raindrop-shaped groove 24*b* which is in a y-axis positive side of the raindrop-shaped groove 24*b* is formed in a circular-arc shape. The y-axis positive-side edge 243 surrounds an outer circumference of the discharge hole 25 through a slight width, namely, so as to have a slight margin between the y-axis positive-side edge 243 and a shape of discharge hole 25. As viewed in the z-axis direction, the y-axis positive-side edge 243 is located to substantially accord with (overlap with) the inner circumferential surface 132 of discharge hole forming portion 13 of housing body 1. A width of the raindrop-shaped groove 24*b* at a given point of the raindrop-shaped groove 24*b* becomes narrower gradually as the given point is advanced in the y-axis negative direction. An x-axis positive-side edge 244 of the raindrop-shaped groove 24*b* is formed in a straight-line shape, and is located to substantially accord with (overlap with) the inner circumferential surface 131 of the discharge hole forming portion 13, as viewed in the z-axis direction. An x-axis negative-side edge 245 of the raindrop-shaped groove 24*b* is formed in a straight-line shape, and is continuous with the falcate-shaped groove 24*a* on a y-axis negative side of the edge 245.

The discharge hole 25 is an opening portion passing through the rear cover 2 in the z-axis direction, and is formed in a circular-cylindrical shape. A diameter of the discharge hole 25 is slightly smaller than that of the bearing hole 20. The discharge hole 25 is provided in an x-axis positive and y-axis positive side of the rear cover 2. The discharge hole 25 is communicated with the discharge port 24, and thereby is communicated through the discharge port 24 with the inside of housing body 1. The discharge hole 25 functions as a passage for discharging working oil to an outside of the pump VP. The discharge hole 25 is connected to a main oil gallery of the engine so as to be communicated with the respective sliding portions of the engine and the variable valve operating apparatus.

As shown in FIG. 2, the inner circumferential edge 241 of the falcate-shaped groove 24*a* is located on the inner circumferential side of the cam ring 4 (i.e., located radially inside the inner circumferential surface 400 of cam ring 4). The outer circumferential edge 242 is located to substantially overlap with the cam ring 4 as viewed in the z-axis direction. That is, a radially-inner side of the falcate-shaped groove 24*a* is open to the inner circumferential space (pump chambers r5 to r7) of cam ring 4. The discharge hole 25 is located on the outer circumferential side of the cam ring 4 (i.e., located radially outside the outer circumferential surface of cam ring 4). As viewed in the z-axis direction, the discharge hole 25 does not overlap with the cam ring 4. The discharge hole 25 and the raindrop-shaped groove 24*b* are open to the outer circumferential side of cam ring 4, namely open to a radially outer space (control chamber R1) of the cam ring 4.

Figure 5:
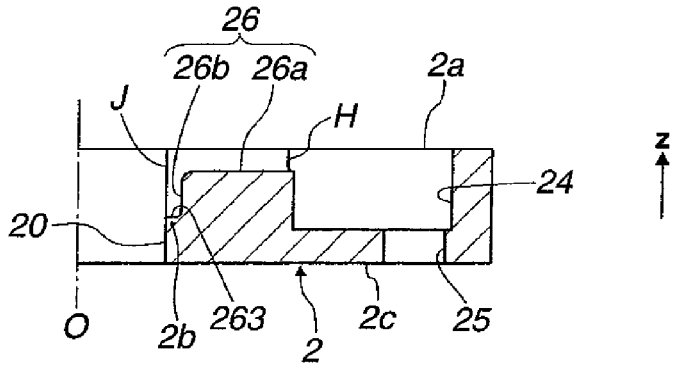
FIG. 5 is a cross-sectional view of a bearing oil-feeding groove in the first embodiment, taken along a line B-B of FIG. 4 (as viewed in a direction of arrows B and B).

FIG. 5 is a schematic cross sectional view of FIG. 4, taken along a B-B line. FIG. 5 shows a cross section of the bearing oil-feeding groove 26. The bearing oil-feeding groove 26 includes a lateral groove (oil feeding groove) 26*a* and a longitudinal or axial groove (oil draining groove) 26*b*. The lateral groove 26*a* is formed in the z-axis positive-side surface 2*a* of rear cover 2 to have a predetermined depth. The longitudinal groove 26*b* is formed in an inner circumferential surface of the bearing portion 2*b* (bearing hole 20). The bearing oil-feeding groove 26 communicates the discharge port 24 with the bearing hole 20 so that working oil is supplied from the discharge port 24 to the bearing hole 20. Thereby, a lubricating performance of the drive shaft 9 is ensured. The bearing oil-feeding groove 26 is molded together when the rear cover 2 is molded by means of die forming (Aluminum Die Casting).

The lateral groove 26*a* is formed to be bent in the y-axis positive direction, i.e., is formed in a dogleg shape as viewed in the z-axis direction. The lateral groove 26*a* includes a first groove 261 and a second groove 262. The first groove 261 linearly extends from an end H at which the first groove 261 is connected with a y-axis positive end portion of the falcate-shaped groove 24*a*, to an end I which exists on the x-axis, in the x-axis negative and also y-axis negative direction. The second groove 262 linearly extends from the end I to an end J at which the second groove 262 is connected with the bearing hole 20 (longitudinal groove 26*b*), in the x-axis negative direction. The first groove 261 is longer than the second groove 262. A distance between the end H and the end I is longer than a distance between the end I and the end J.

In other words, the second groove 262 extends from the end 3 existing on the side of bearing hole 20, to a predetermined point (the end I), in the radial direction (of drive shaft 9). The first groove 261 extends from the predetermined point (the end I), to the end H existing on the side of discharge port 24 (falcate-shaped groove 24*a*), in a direction inclined from the radial direction (of drive shaft 9). The end I of second groove 262 is located radially inside an after-mentioned (radially inner) base end portion of the vane 6. In other words, the first groove 261 is a portion of the lateral groove 26*a* which is inclined from a rotational direction of drive shaft 9, in a sliding range of vane 6 on (the surface 2*a* of) the rear cover 2.

A direction in which the first groove 261 extends from the end I is inclined or tilted from the extending direction of the second groove 262 (the radial direction of drive shaft 9 or the rising-and-falling direction of vane 6), in a direction opposite to the rotational direction of drive shaft 9. This "direction opposite to the rotational direction of drive shaft 9" means an inverse-rotational direction of drive shaft 9 (counterclockwise direction of FIG. 4). The first groove 261 is provided between the discharge port 24 (falcate-shaped groove 24*a*) and the bearing hole 20, and is located in a discharge port's side (radially outside the second groove 262) of an area given between the discharge port 24 and the bearing hole 20. This discharge port's side of the area is a range in which the vane 6 slides in contact with the surface 2*a*. Hence, "the first groove 261 is inclined in the direction opposite to the rotational direction of drive shaft 9" specifically means that an offset amount (deviation amount) at a given point of the first groove 261 in the inverse-rotational direction of drive shaft 9 with respect to a line passing through the end I in the radial direction of drive shaft 9 becomes greater as the given point of first groove 261 becomes farther from the bearing hole 20 (the center O). In other words, a predetermined angle between the first groove 261 and the second groove 262 is equal to $\eta$ ($0° < \eta < 90°$). That is, this predetermined angle $\eta$ is provided in the inverse-rotational direction of drive shaft 9 relative to the extending direction of second groove 262. The lateral groove 26*a* constituted by the first groove 261 and the second groove 262 is formed to protrude in the rotational direction (clockwise direction of FIG. 4) of drive shaft 9, as viewed in the z-axis direction.

Moreover, the end H of first groove 261 at which the first groove 261 is connected with the discharge port 24 (falcate-shaped groove 24*a*) is adjacent to an edge portion 27 of the rear cover 2 in the rotational direction of drive shaft 9. An angle of the edge portion 27, i.e., an angle produced between the first groove 261 and the inner circumferential edge 241 of falcate-shaped groove 24*a* is equal to $\rho$ (acute angle: $0° < \rho < 90°$).

The longitudinal groove 26*b* is formed by drilling the inner circumference of the bearing portion 2*b* (bearing hole 20) from the end J of lateral groove 26*a* linearly in the z-axis negative direction. The longitudinal groove 26*b* is provided over a predetermined range in the z-axis direction. A bottom portion 263 which is a z-axis negative-directional end portion of the longitudinal groove 26*b* is located at a point somewhat advanced in the z-axis negative direction from a point indicating the half of z-axis directional width of rear cover 2. The longitudinal groove 26*b* introduces working oil from the lateral groove 26*a* to the inner circumference of bearing hole 20 (and the outer circumference of drive shaft 9). On the other hand, a z-axis negative-side end portion of the bearing hole 20, i.e., an end portion of bearing hole 20 which is open to a z-axis negative-side surface 2*c* of the rear cover 2 is communicated with an external space of housing HSG, and hence is exposed to atmospheric pressure. Working oil supplied from the discharge port 24 through the longitudinal groove 26*b* to the bottom portion 263 of longitudinal groove 26*b* lubricates the bearing portion 2*b* (bearing hole 20), then passes through a clearance (gap) between the drive shaft 9 and the bearing hole 20, and then drains to the external space of pump substantially receiving the atmospheric pressure.

The bearing hole 30 of front cover 3 is formed on an inner circumference of a boss portion (the bearing portion 3*b*) protruding in the z-axis positive direction, as shown in FIG. 3. A z-axis negative-side surface 3*a* of the front cover 3 has undergone a machining process with a high accuracy of flatness and the like, in a sliding range of the cam ring 4, in the same manner as the surface 2*a* of rear cover 2.

(Structure of Cam Ring)

The cam ring 4 is a movable member disposed to be able to slide on the rear cover 2 and the front cover 3, while holding the rotor 5 inside the cam ring 4. The cam ring 4 is integrally formed of a sintered metal having easy workability, such as an iron-based metallic material. The cam ring 4 includes the main body portion 40, a pivot portion 41, the arm portion 42 and a protruding portion 43. A z-axis directional width of the cam ring 4 is substantially constant at the respective portions 40 to 43, and is approximately equal to the magnitude H of z-axis directional width of housing body 1.

The main body portion 40 is in a tubular shape (circular-ring shape), and receives the rotor 5 in its inner circumferential space. A radial directional width of the main body portion 40 is substantially constant over an entire perimeter of the main body portion 40. Each of the inner circumferential surface 400 and an outer circumferential surface 401 of cam ring 4 is provided in a substantially circular shape as viewed in the z-axis direction. The center P is a center axis of the inner circumferential surface 400 (and the outer circumferential surface 401).

The pivot portion 41 is a protruding portion which protrudes from the outer circumferential surface 401 of main body portion 40 and which is formed integrally with the main body portion 40. The pivot portion 41 is formed over a z-axis directional entire range of the cam ring 4. A tip portion of the pivot portion 41 is formed to have a curved surface which is formed in a substantially semicircle shape having its curvature (radius) equal to that of the pivot setting portion 133 of housing body 1, as viewed in the z-axis direction. The cam ring 4 is received inside the housing body 1, under the condition where the pivot portion 41 has been set (disposed) into the pivot setting portion 133. Under this set condition, a center of the semicircle shape of pivot portion 41 is substantially identical with the center Q of semicircle shape of the pivot setting portion 133.

The semicircle-shaped tip portion of pivot portion 41 is in surface-contact with the pivot setting portion 133 over the z-axis directional entire range of housing body 1, and is disposed to be able to slide on the pivot setting portion 133 (in a rotational direction about the center Q). The cam ring 4 is supported to allow the cam ring 4 to rotate about the center Q (around the pivot portion 41 or pivot setting portion 133) along the x-y plane relative to the housing body 1. That is, the center Q functions as the swing fulcrum of cam ring 4 as mentioned above. By this rotation (swing), the center axis P of inner circumferential surface 400 of cam ring 4 (main body portion 40) makes an offset (i.e., is deviated) from the center axis O while remaining parallel to the center axis O of drive shaft 9. That is, the center P and the center O are provided to allow the center P to become eccentric relative to the center O.

A z-axis positive-side surface 4*a* of cam ring 4 faces the z-axis negative-side surface 3*a* of front cover 3, and the z-axis negative-side surface 4*b* of cam ring 4 faces the z-axis positive-side surface 2*a* of rear cover 2. That is, the rear cover 2 and the front cover 3 are provided as the sidewalls, so as to be opposed to the both side surfaces 4*a* and 4*b* of cam ring 4. The cam ring 4 can swing around the swing fulcrum Q between these both sidewalls, by sliding on the surfaces 2*a* and 3*a* under the condition where the cam ring 4 is in contact with the surfaces 2*a* and 3*a*.

The arm portion 42 protrudes from the outer circumferential surface 401 of main body portion 40, and is formed integrally with the main body portion 40. The arm portion 42 includes an arm body 420 and a receiving portion 421. The arm body 420 extends in the x-axis negative direction, from a point existing on the outer circumferential surface 401 which is substantially symmetrical to the center Q (pivot portion 41) with respect to the center P. That is, the arm body 420 extends substantially from a cross point between the outer circumferential surface 401 and an imaginary line connecting the center P with the center Q. The receiving portion 421 is provided to extend from an x-axis negative-side end of the arm body 420 in the y-axis negative direction. Under the initial setting state of FIG. 2, a y-axis positive-side surface 422 of the arm body 420 faces through a slight clearance to the inner circumferential surface 161 of arm receiving portion 16, and hence is not in contact with the inner circumferential surface 161. A y-axis negative-side surface of the arm body 420 faces a y-axis positive-side surface of the stopping portion 175 through a predetermined clearance given between these y-axis negative-side surface of arm body 420 and y-axis positive-side surface of stopping portion 175.

A y-axis negative-side end surface 423 of the receiving portion 421 is a curved surface, and is formed in a gentle-curve shape projecting in the y-axis negative direction, as viewed in the z-axis direction. Under the initial setting state of FIG. 2, the end surface 423 is located to overlap with an x-axis negative-side surface of the stopping portion 175 in the y-axis direction (as viewed in the x-axis direction). Moreover, a center of the receiving portion 421 substantially accords or overlaps with a center of the spring chamber 170 in the x-axis direction (as viewed in the y-axis direction). An x-axis directional width of the receiving portion 421 is smaller than an x-axis directional width (i.e., distance between the stopping portions 174 and 175) of the opening portion of spring chamber 170.

The protruding portion 43 protrudes from the outer circumferential surface 401 of main body portion 40, and is formed in a substantially triangle shape causing its width to become narrower with an advance in the radially outer direction. The protruding portion 43 is formed integrally with the main body portion 40. The protruding portion 43 is located at a y-axis positive-side end of the main body portion 40 and substantially at an x-axis directional center of the main body portion 40 (i.e., to overlap with y-axis as viewed in the z-axis direction). The protruding portion 43 includes a contact portion 43*a* in an x-axis positive side thereof, and a choke forming portion (flow-restricting portion) 43*b* in an x-axis negative side thereof. That is, the contact portion 43*a* is provided in one side of the protruding portion 43 which is closer to the swing fulcrum Q, and the choke forming portion 43*b* is provided in another side of the protruding portion 43 which is relatively far from the swing fulcrum Q.

The contact portion 43*a* includes a contact surface 430. The contact surface 430 is formed in an x-axis positive-directional side surface of the protruding portion 43, and is a flat surface parallel to z-axis. The contact surface 430 is formed over a z-axis directional entire range of the cam ring 4, and constitutes a part of the outer circumferential surface 401 of cam ring 4. As viewed in the z-axis direction, an angle between a tangent to the outer circumferential surface 401 at a boundary point U and the contact surface 430 is approximately equal to 45°. At this boundary point U, the contact portion 43*a* starts to protrude from the main body portion 40. Under the state where the cam ring 4 has been disposed inside the housing HSG, the contact surface 430 faces in the x-axis positive and y-axis positive direction.

As viewed from the positive side of z-axis, the contact surface 430 is inclined by a slight angle (about the point U) in the counterclockwise direction of FIG. 2 with respect to a line Q-U. This slight angle is approximately equal to the angle between the contact surface 140 of housing body 1 and the line Q-S. Note that the line Q-U is an imaginary line passing through the point Q and the point U. Therefore, as shown in FIG. 2, when the contact portion 43*a* becomes in contact with the protruding portion 14 of housing body 1, the contact surface 140 substantially overlaps with (is fitted to) the contact surface 430 as viewed in the z-axis direction so that the contact surfaces 140 and 430 become in contact with (just meet) each other.

The choke forming portion 43*b* includes a choke forming surface (flow-restricting surface) 431. The choke forming surface 431 is a curved surface formed in an x-axis negative-directional side surface of the protruding portion 43. The choke forming surface 431 is formed over a z-axis directional entire range of the cam ring 4, and constitutes a part of the outer circumferential surface 401 of cam ring 4. The choke forming surface 431 is adjacent to the contact portion 43*a* (contact surface 430) on an x-axis negative side of the contact surface 430. As viewed in the z-axis direction, the choke forming surface 431 is formed in a gentle circular-arc shape regarding the swing fulcrum Q as its center, and hence moves on a substantially identical curve (constant curve) when the cam ring 4 swings. That is, the choke forming surface 431 has a shape formed along a swing path (locus) of the cam ring 4. In other words, the shape of choke forming surface 431 is approximately identical with a swing path of the choke forming surface 431. Moreover, the choke forming surface 431 has a curvature (radius) approximately equal to that of the choke forming surface 150 of housing body 1.

Under the state that the cam ring 4 has been disposed inside the housing HSG, the choke forming surface 431 faces in the x-axis negative and also y-axis positive direction. As viewed in the z-axis direction, an (x-axis positive-directional) extension line of the choke forming surface 431 is directed toward an outer circumferential side relative to the inner circumferential surface 400 of the cam ring 4. An angle between a tangent to the outer circumferential surface 401 at a boundary point W and the choke forming surface 431 is approximately equal to 45°. At this boundary point W, the choke forming portion 43*b* starts to protrude from the main body portion 40. Moreover, as viewed in the z-axis direction, an angle between the contact surface 430 and the choke forming surface 431 is substantially equal to the angle β between the contact surface 140 and the choke forming surface 150 of the housing body 1.

At a boundary region V between the contact surface 430 and the choke forming surface 431, there is provided a round chamfering as viewed in the z-axis direction. That is, the contact surface 430 is continuous with the choke forming surface 431 through a smooth curved surface. This curved surface provided at the boundary region V is formed to be depressed from a plane including the contact surface 430 (namely, from an extension surface of contact surface 430) in the radially inner direction (toward a base side of the protruding portion 43).

(Details of Contact Portion and Choking Portion)

Figure 7:
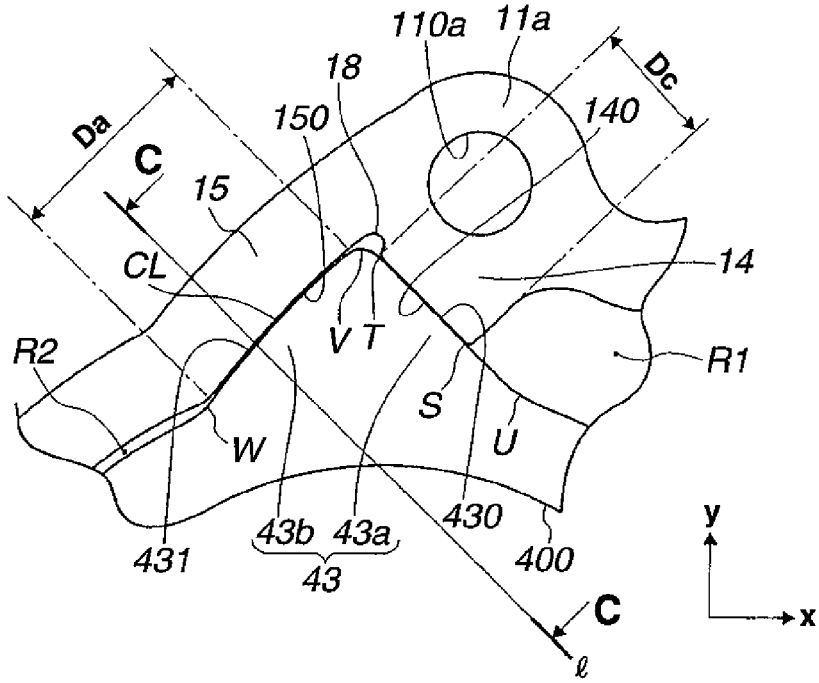
FIG. 7 is an enlarged view of a part in which a protruding portion of cam ring is received in the first embodiment (partial enlarged view of FIG. 2).
Figure 8:
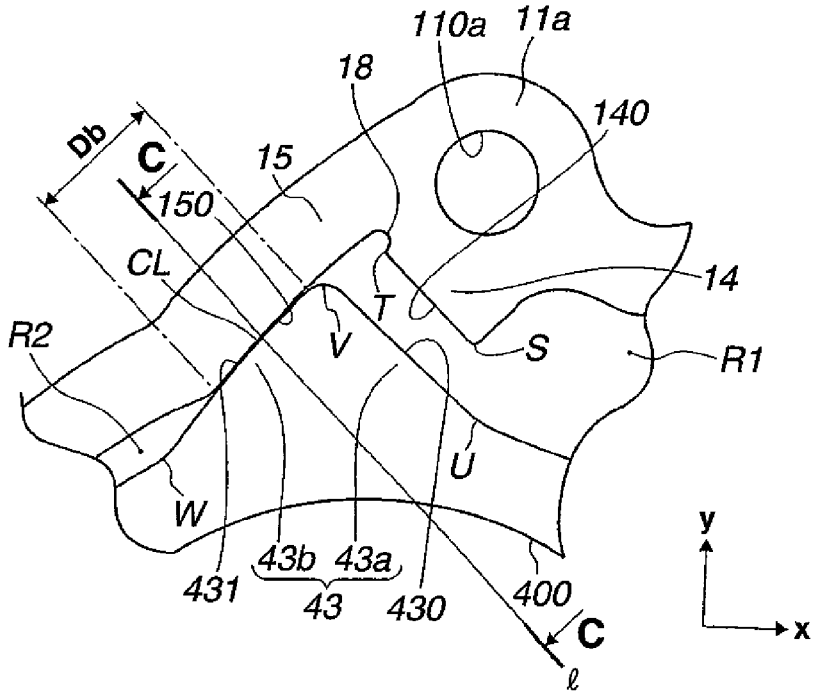
FIG. 8 is an enlarged view of the part in which the protruding portion of cam ring is received in the first embodiment (partial enlarged view of FIG. 6).
Figure 9:
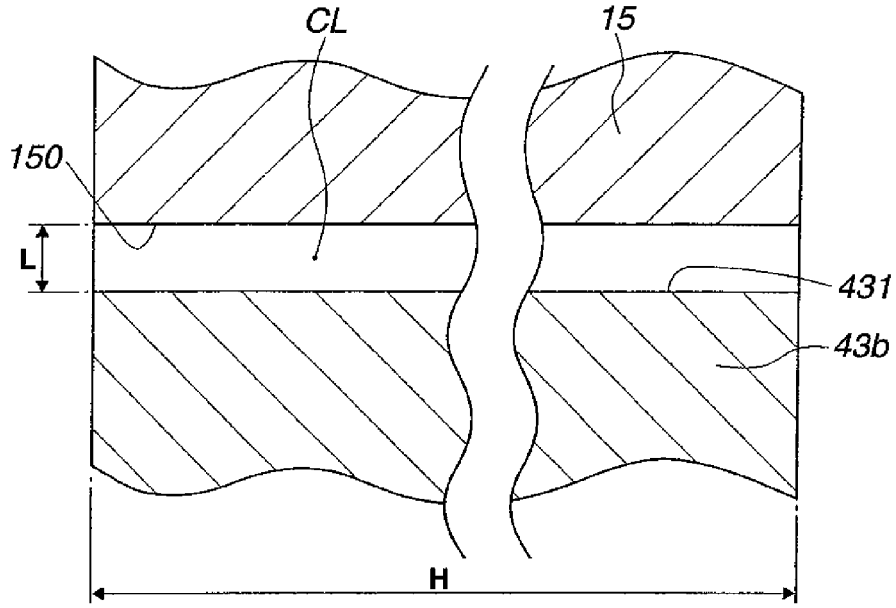
FIG. 9 is a cross-sectional view of FIGS. 7 and 8, taken along a line C-C of FIGS. 7 and 8 (as viewed in a direction of arrows C and C).

FIGS. 7 and 8 are enlarged views showing the protruding portion 43 of cam ring 4 which is received on inner circumferential sides of the protruding portion 14 and the choke forming portion 15 of the housing body 1. FIG. 7 is an enlarged view of FIG. 2, and FIG. 8 is an enlarged view of FIG. 6. FIG. 9 is a cross sectional view of FIG. 7 or 8 which is taken along a straight line l, as viewed in a direction indicated by arrows C. This straight line l passes through the point Q substantially perpendicularly to the choke forming surface 150.

As shown in FIG. 7, under the initial setting state, namely under the state where the center P is eccentric at a maximum from the center O, the contact surface 140 of housing body 1 which is flat is in plane-contact with the contact surface 430 of cam ring 4 which is also flat, over a z-axis directional entire range of the housing body 1 (cam ring 4). That is, under this state, the contact surface 140 is contacted by the contact surface 430, by means of a surface contact between the entire ranges of contact surface 140 and contact surface 430. Thus, since the contact portion 43*a* abuts on the protruding portion 14 under the initial setting state, the eccentricity amount of center P relative to the center O is prevented from becoming greater than its current level. Thereby, the swing of cam ring 4 in the direction that enlarges the eccentricity amount can be restricted. That is, the contact portion 43*a* and the protruding portion 14 function as a stopper portion.

Between the outer circumferential side of cam ring 4 and the inner circumferential side of the housing body 1, an x-axis positive-side space (after-mentioned control chamber R1) and an x-axis negative-side space (after-mentioned backpressure chamber R2) are formed in a fluid-tightly separated manner by regarding the plane-contact region between the contact surface 140 and the contact surface 430 as a boundary of these spaces. That is, the contact portion 43*a* and the protruding portion 14 function as a sealing portion under the initial setting state. A length (length between S and T) of the contact surface 140 in the circumferential direction of cam ring 4 is set at a predetermined value Dc. On the other hand, a length of the contact surface 140 in the z-axis direction is equal to H. Therefore, a (square measure) value of contact region of the stopper portion, namely, a value of contact area of the contact surface 140 or 430 is equal to Dc×H.

A slight clearance CL is provided between the choke forming portion 15 (choke forming surface 150) of housing body 1 and the choke forming portion 43*b* (choke forming surface 431) of cam ring 4. As shown in FIG. 9, a width of the clearance CL in an extending direction of the straight line l is set at a predetermined value L. The value L is sufficiently small, and the clearance CL is sufficiently narrow. Therefore, when the cam ring 4 swings, for example, under the state shown in FIG. 8; a flow of working oil between the x-axis positive-side space (after-mentioned control chamber R1) and the x-axis negative-side space (after-mentioned backpressure chamber R2) is restricted or limited between the outer circumferential side of cam ring 4 and the inner circumferential side of housing body 1. In this case, these x-axis positive-side space (control chamber R1) and x-axis negative-side space (backpressure chamber R2) are defined by regarding a region of the clearance CL formed by the choke forming surface 150 opposed to the choke forming surface 431, as a boundary of these spaces (R1 and R2). That is, (the clearance CL formed by) the choke forming portions 15 and 43*b* function as a choking portion (sealing portion), over an overlap range between the choke forming surfaces 150 and 431 as viewed in a direction along the straight line l.

Each of the choke forming surfaces 150 and 431 is formed in a circular-arc shape regarding the swing fulcrum Q as its center, as viewed in the z-axis direction. A curvature (radius) of the circular-arc shape of the choke forming surface 150 is approximately equal to that of the choke forming surface 431. Hence, the width of clearance CL is substantially maintained at the predetermined value L, namely, varies very little, during the swing motion of the cam ring 4. In other words, a flow-passage cross-sectional area of working oil in the choking portion remains equal to L×H, namely, varies very little, even if the cam ring 4 swings. Note that this flow-passage cross-sectional area of working oil is a cross-sectional area of the clearance CL which is taken along a plane substantially perpendicular to a flow direction of working oil, namely, a (square measure) value of area of clearance CL shown in FIG. 9.

Explanations about a length of the flow-passage of working oil in the choking portion will now be given. Regarding the circumferential direction of cam ring 4, a circumferential size of the range over which the choke forming surface 150 overlaps with the choke forming surface 431 (flow-passage length D of the choking portion, i.e., circumferential size of the existing range of clearance CL) becomes smaller as the cam ring 4 swings from the initial setting state of FIG. 7 toward the state of FIG. 8 (state of maximum swing amount), namely as the swing amount becomes greater. The flow-passage length D is denoted by Da in FIG. 7, and is denoted by Db in FIG. 8 (Db<Da, Da: Db≈27:19). In other words, the choke forming surfaces 150 and 431 are designed such that a magnitude of the overlap range between the choke forming surfaces 150 and 431 when the swing amount of cam ring 4 is at its maximum is approximately 70% of a magnitude of the overlap range under the initial setting state, in the circumferential direction of cam ring 4.

A z-axis directional width of each of the choke forming portions 15 and 43*a* is equal to H. Therefore, a facing area in the choking portion, namely an area (square measure) value of the range over which the choke forming surfaces 150 faces and overlaps with the choke forming surfaces 431 is varied substantially between Da×H and Db×H. That is, this facing area becomes smaller as the swing amount becomes greater from the initial setting state. On the other hand, the values Da and Db are greater than the length Dc of the stopper portion (contact surface 140 of housing body 1) in the circumferential direction of cam ring 4. The following relations are satisfied: Da:Dc≈27:17, Db:Dc≈19:17. Therefore, under the initial setting state shown in FIG. 7, the facing area (Da×H) of the choking portion is greater than the contact area (Dc×H) of the stopper portion. Moreover, under the state shown in FIG. 8, the facing area (Db×H) of the choking portion is greater than the contact area (Dc×H) of the stopper portion (at the time of the initial setting state).

(Control Chamber)

Two chambers of the control chamber R1 and the backpressure chamber R2 are fluid-tightly separated between the outer circumferential surface 401 of cam ring 4 and the inner circumferential surface of housing body 1, inside the housing HSG. The control chamber R1 receives a relatively low pressure, and the backpressure chamber R2 is configured to receive a relatively high pressure. The control chamber R1 is provided on the outer-circumferential side of the cam ring 4 (i.e., radially outside the cam ring 4) and also in the x-axis positive and y-axis positive direction of the cam ring 4. In other words, the control chamber R1 is formed at a radially-outer region of cam ring 4 to which the discharge hole 25 is open and which is located in a direction that deviates the center P from the center O. The backpressure chamber R2 is formed at a region to which the suction hole 22 is open. The backpressure chamber R2 is communicated through the suction hole 22 with an oil pan so that the backpressure chamber R2 is maintained at the low pressure (atmospheric pressure). The backpressure chamber R2 includes a clearance enabling the cam ring 4 to swing.

Under the initial setting state of FIG. 2; the pivot portion 41 is in contact with the pivot setting portion 133 at the location of swing fulcrum Q, and the contact portion 43*a* is contact with the protruding portion 14 at the location of stopper portion. Accordingly, the control chamber R1 is formed separately from the backpressure chamber R2, on the outer circumferential side of cam ring 4. On the other hand, under the state where the cam ring 4 has swung so that the swing amount has become greater than 0, for example, under the state of FIG. 6; the pivot portion 41 is in contact with the pivot setting portion 133 at the location of swing fulcrum Q, and the flow of working oil is limited at the choking portion. Thereby, also in this state, the control chamber R1 is formed separately from the backpressure chamber R2.

That is, there is no sealing member or the like for separating the control chamber R1 from the backpressure chamber R2, on the outer circumferential side of cam ring 4. The both chambers R1 and R2 are formed separately from each other, by means of the stopper portion (mutual contact between contact portion 43*a* and protruding portion 14) under the initial setting state, and by means of the choking portion (clearance CL between choke forming portions 15 and 43*b*) under the swung state of cam ring 4. The cam ring 4 is arranged such that the outer circumferential surface of cam ring 4 does not become in touch (contact) with the inner circumferential surface of housing body 1 except for the contact portion 43*a* (contact surface 430) and the pivot portion 41.

The rotor 5 is formed basically in a circular cylindrical-column shape, and specifically has a shape obtainable by hollowing out a circular disc having a relatively small radius coaxially to the cylindrical-column shape from each of both bottom surfaces of this cylindrical-column shape. As shown in FIG. 3, a cross section of the rotor 5 which is taken along a plane including the center axis of rotor 5 (center O of drive shaft 9) is substantially in the form of I. The rotor 5 includes an inner circumferential portion 51 and an outer circumferential portion 52. The inner circumferential portion 51 is relatively thin in the z-axis direction, and the outer circumferential portion 52 is relatively thick in the z-axis direction. The inner circumferential portion 51 is formed with a through-hole 50 passing through a substantially center of the inner circumferential portion 51 in the z-axis direction. The through-hole 50 (i.e., rotor 5) is connected integrally with the drive shaft 9. The rotor 5 is rotatably accommodated inside the housing HSG. The rotor 5 is drivingly rotated by the engine, together with the drive shaft 9. Thereby, the rotor 5 rotates in synchronization with the crank shaft.

The rotor 5 is formed with seven slits 5*a* to 5*g* at substantially regular (even) intervals in a circumferential direction of rotor 5. Each of the seven slits 5*a* to 5*g* is formed radially, and have a predetermined width in the circumferential direction of rotor 5. As viewed in the z-axis direction, each of the seven slits 5*a* to 5*g* is formed by cutting into the above-mentioned cylindrical-column shape of rotor 5 from an outer circumferential surface 53 of the rotor 5 toward the center O (i.e., in a radially inner direction of rotor 5). Each of the seven slits 5*a* to 5*g* reaches a predetermined depth of the rotor 5 which does not allow the each slit 5*a* to 5*g* to reach the through-hole 50, in the radial direction. At a radially-inner base end portion of each of the seven slits 5*a* to 5*g*, a backpressure chamber 50*a* to 50*g* is formed in a substantially circular shape in cross section as viewed in the z-axis direction.

Each of the seven vanes 6*a* to 6*g* (collectively also called, vane 6) is formed in a thin plate shape. A z-axis directional width of each of the seven vanes 6*a* to 6*g* is substantially equal to the z-axis directional length H of rotor 5 (outer circumferential portion 52). The vane 6*a* has been inserted into the slit 5*a*, and is disposed to be slidable in the radial direction of rotor 5. In the same manner, the other vanes 6*b* to 6*g* have been disposed respectively into the slits 5*b* to 5*g*. A length of each of the vanes 6*a* to 6*g* in the radial direction of rotor 5 is approximately equal to the (radial) depth of each of the slits 5*a* to 5*g* including the backpressure chambers 50*a* to 50*g*. The vanes 6*a* to 6*g* are disposed to be able to rise (and fall) from the outer circumferential surface 53 of rotor 5 to the inner circumferential surface 400 of cam ring 4 (main body portion 40) and vice versa. According to the rotation of rotor 5; a z-axis negative side of each vane 6 slides on the surface 2*a* of rear cover 2, and a z-axis positive side of each vane 6 slides on the surface 3*a* of rear cover 3.

Each of a pair of vane rings 7*a* and 7*b* is formed in a ring shape whose outer diameter is smaller than that of the inner circumferential portion 51 of rotor 5. The pair of vane rings 7*a* and 7*b* are disposed on the inner circumferential portion 51 of rotor 5 respectively in the z-axis positive direction and in the z-axis negative direction. A z-axis directional width of the vane ring 7*a* is slightly smaller than a distance between a z-axis positive-side surface of the outer circumferential portion 52 of rotor 5 and a z-axis positive-side surface of the inner circumferential portion 51 of rotor 5. A z-axis directional width of the vane ring 7*b* is set in the same manner as the z-axis directional width of vane ring 7*a*. The vane ring 7*a* is arrange to be able to slide on the z-axis positive-side surface of the inner circumferential portion 51, and the vane ring 7*b* is arranged to be able to slide on the z-axis negative-side surface of the inner circumferential portion 51. The drive shaft 9 passes through the vane rings 7*a* and 7*b*, on the inner circumferential sides of vane rings 7*a* and 7*b* (i.e., radially inside the vane rings 7*a* and 7*b*). The radially inner base end portions of the vanes 6*a* to 6*g* are in contact with respective outer circumferential surfaces 70*a* and 70*b* of the vane rings 7*a* and 7*b*.

As shown in FIG. 3, the vane rings 7*a* and 7*b* support each vane 6*a* to 6*g* at two points (two-point support) by means of the above-mentioned contacts therebetween, as viewed in the x-axis direction. That is, the vane rings 7*a* and 7*b* function to press the vanes 6*a* to 6*g* in the radially outer direction of rotor 5. A radially-outer tip portion of each vane 6*a* to 6*g* pressed by the vane rings 7*a* and 7*b* is in contact with the inner circumferential surface 400 of cam ring 4.

That is, a distance between the inner circumferential surface 400 of cam ring 4 and the outer circumferential surface 70*a*, 70*b* of each vane ring 7*a*, 7*b* is designed to be substantially equal to the length of each vane 6*a* to 6*g* in the radial direction of rotor 5, in the condition where the center of the vane rings 7*a* and 7*b* is identical with the center P of inner circumferential surface 400. Therefore, with the rotation of rotor 5; the base end portions of vanes 6*a* to 6*g* slide in contact with the outer circumferential surfaces 70*a* and 70*b* of vane rings 7*a* and 7*b*, and the tip portions of vanes 6*a* to 6*g* slide in contact with the inner circumferential surface 400 of cam ring 4. In other words, the center of each vane ring 7*a*, 7*b* is positioned automatically to become identical with the center P of cam ring 4 because the base end portions of vanes 6*a* to 6*g* abut on the outer circumferential surfaces 70*a* and 70*b* of vane rings 7*a* and 7*b*.

The siding range of the vanes 6*a* to 6*g* on the surface 2*a* of rear cover 2 is a ring-shaped range given between the outer circumferential surface 70*a* of vane ring 7*a* and the inner circumferential surface 400 of cam ring 4, as viewed from the z-axis positive side. This ring-shaped sliding range somewhat moves, namely, a shape of this range varies in accordance with the eccentricity (swing) state of cam ring 4. Regardless of the eccentricity state of cam ring 4, an inner circumference of the ring-shaped sliding range (i.e., a sliding path of the base end portion of vane 6) is located somewhat radially outside the radially outer end I of second groove 262 (i.e., the radially inner end of first groove 261) formed in the surface 2*a*. In other words, the vanes 6*a* to 6*g*, i.e., the siding range of vanes 6*a* to 6*g* against the surface 2*a* are provided so as not to overlap with the second groove 262.

(Structure of Pump Chamber)

Pump structural members such as the rotor 5, the cam ring 4, the suction port 23, the discharge port 24, the vanes 6*a* to 6*g* and the like constitute pump actuating chambers. That is, the seven pump chambers r1 to r7 are formed to be fluid-tightly separated from one another, by spaces surrounded by the vanes 6*a* to 6*g*, the surface 3*a* of front cover 3, the surface 2*a* of rear cover 2, the outer circumferential surface 53 of rotor 5 and the inner circumferential surface 400 of cam ring 4. One pump chamber is formed between adjacent two vanes 6. The suction hole 22 is open to the rear cover 2, and is communicated through the suction port 23 with the pump chambers r1 to r3 which function as suction chambers. The discharge hole 25 is open to the rear cover 2, and is communicated through the discharge port 24 with the pump chambers r5 to r7 which function as discharge chambers.

Under the initial setting position, the center P of inner circumferential surface 400 of cam ring 4 is offset (eccentric) relative to the rotation center O of rotor 5 in the y-axis positive direction. Hence, under this initial setting state, in one half of the entire region of pump is chambers which is located in the x-axis negative direction from the center O, a volume of pump chamber becomes greater in order as r1→r2→r3→r4 as the pump chamber is advanced in the y-axis positive direction. That is, the volume of pump chamber is increased in the rotational direction of rotor 5 (clockwise direction of FIG. 2). In another half of the entire region of pump chambers which is located in the x-axis positive direction from the center O, the volume of pump chamber becomes smaller in order as r4→r5→r6→r7, as the pump chamber is advanced in the y-axis negative direction. That is, the volume of pump chamber is reduced in the rotational direction of rotor 5. Therefore, according to the rotation of rotor 5; the volumes of respective pump chambers r1 to r3 are increased, and the volumes of respective pump chambers r4 to r7 are decreased.

The pump chambers r1 to r3 (including the pump chamber r4 until the rotor 5 has somewhat rotated from its position of FIG. 2 in the clockwise direction) which are located in the x-axis negative direction overlap with the suction port 23 (falcate-shaped groove 23*a*) as viewed in the z-axis direction, and are located to communicate with the suction port 23. On the other hand, the pump chambers r5 to r7 which are located in the x-axis positive direction overlap with the discharge port 24 (falcate-shaped groove 24*a*) as viewed in the z-axis direction, and are located to communicate with the discharge port 24. As viewed in the z-axis direction, an angle between mutually-opposed two surfaces of adjacent two vanes 6 at center P (i.e., angle between imaginary extension planes of the mutually-opposed two surfaces) is smaller than angles ∠DOF and ∠EOG (see FIG. 4). Therefore, it is prevented that one pump chamber is concurrently communicated with both of the suction port 23 and discharge port 24. These relations are satisfied regardless of the swing amount of cam ring 4 because the deviation due to the eccentricity between center O and center P is relatively minute.

When the rotor 5 rotates; a suction stroke (process) during which working fluid is sucked from the suction port 23 to the pump chambers r1 to r3 is done in the x-axis negative side of the entire region of pump chambers beyond the rotation center O. That is, the pump chambers r1 to r3 are suction chambers. On the other hand, a discharge stroke (process) during which working fluid is discharged from the pump chambers r5 to r7 to the discharge port 24 is done in the x-axis positive side of the entire region of pump chambers beyond the rotation center O. That is, the pump chambers r5 to r7 are discharge chambers. A degree (rate of change of volume) at which the volume of each of the suction chambers r1 to r3 and the discharge chambers r5 to r7 varies in the rotation direction of rotor 5 is varied (increased or decreased) in accordance with the swing mount of cam ring 4 from its initial setting position. That is, a discharge flow amount (pump capacity) per one rotation of the pump VP can be varied.

Working fluid discharged to the discharge port 24 is introduced to the control chamber R1 and the backpressure chambers 50*a* to 50*g* of rotor 5, so that the vanes 6*a* to 69 are pushed out in the radially outer direction. Additionally, each vane 6*a* to 6*g* is pushed out in the radially outer direction also by means of centrifugal force applied to the vane 6*a* to 6*g* itself. Thereby, the tip portion of each vane 6*a* to 6*g* slides in contact with the inner circumferential surface 400 of cam ring 4, at the time of operation of the engine. At the time of stop of the engine, namely when the pump VP is not rotating, the vane rings 7*a* and 7*b* hold the vanes 6*a* to 6*g* to push the vanes 6*a* to 6*g* in the radially outer direction. Therefore, the a fluid-tightness of pump chamber can be secured promptly at the time of operation start of the engine so that a responsivity of pump discharge pressure can be improved. Moreover, a collision noise (contact noise) can be suppressed which is generated when the vanes 6*a* to 6*g* pop up in the radially outer direction and thereby collide with the inner circumferential surface 400 of cam ring 4 at the time of start of pump rotation.

(Structure of Biasing Member)

The biasing member 8 includes a first coil spring 8*a* having a relatively small diameter and a second coil spring 8*b* having a relatively large diameter. The biasing member 8 is accommodated or received in the back-pressure chamber R2, more specifically in the spring chamber 170 of housing body 1. The biasing member 8 is totally constructed as a double spring. The first coil spring 8*a* is disposed on an inner circumferential side of the second coil spring 8*b*, substantially coaxially to the second coil spring 8*b*. The first coil spring 8*a* is provided to cause a winding direction of the first coil spring 8*a* to be opposite to a winding direction of the second coil spring 8*b*.

As shown in FIG. 2, an outer diameter (a diameter of outer circumferential surface) of the first coil spring 8*a* is somewhat larger than the x-axis directional width of the receiving portion 421, and is slightly smaller than the x-axis directional width (distance between the stopping portions 174 and 175) of the opening portion of spring chamber 170. An outer diameter of the second coil spring 8*b* is larger than the x-axis directional width of the opening portion of spring chamber 170, and is smaller than a z-axis directional length of the receiving portion 421 (and z-axis directional lengths of the stopping portions 174 and 175 of spring chamber 170).

Y-axis negative-side ends of the first and second coil springs 8*a* and 8*b* are arranged on the bottom surface 171 of spring chamber 170. A y-axis positive-side end of the first coil spring 8*a* is not caught by the stopping portions 174 and 175, but is in contact with the y-axis negative-side end surface 423 of receiving portion 421 by passing through the opening portion of spring chamber 170. Specifically, both (z-axis directional) radial ends of y-axis positive-side end portion of the first coil spring 8*a* abut on the end surface 423 of receiving portion 421. The first coil spring 8*a* is received in the spring chamber 170 under the state where the first coil spring 8*a* has been compressed with an initial setting load W between the housing body 1 (bottom surface 171 of spring chamber 170) and the arm portion 42 (receiving portion 421) of cam ring 4.

On the other hand, a y-axis positive-side end of the second coil spring 8*b* is stopped or caught by the stopping portions 174 and 175. More specifically, both (x-axis directional) radial ends of y-axis positive-side end portion of the second coil spring 8*b* abut on y-axis negative-side ends of the stopping portions 174 and 175. The second coil spring 8*b* is received in the spring chamber 170 under the state where the second coil spring 8*b* has been compressed with an initial setting load W3 between the bottom surface 171 of spring chamber 170 and the stopping portions 174 and 175.

(Operation of Pump)

The biasing member 8 always generates a biasing force Fs that biases or urges the arm portion 42 in one direction (in the y-axis positive direction) inside the back-pressure chamber R2. Thereby, a moment of force Mb which functions to rotate (swing) the cam ring 4 about the fulcrum Q in a direction that increases the eccentricity amount of center P from the center O is generated. That is, the moment of force Mb is generated around the fulcrum Q in the clockwise direction of FIG. 2. In other words, the biasing member 8 biases the cam ring 4 in a direction that increases a volume difference between a pump chamber having a largest volume value (r4 under the state of FIG. 2) and a pump chamber having a smallest volume value (r1, r7 under the state of FIG. 2) among the pump chambers r1 to r7, namely, in a direction that increases the rate of volume change in the pump chambers r1 to r7. The outer circumferential surface 401 (contact surface 430) of cam ring 4 is swung in the above-mentioned direction and becomes in contact with the inner circumferential surface (contact surface 140) of housing body 1. Hereinafter, a moment of force which is generated by the first coil spring 8*a* will be denoted by Mb1, and a moment of force which is generated by the second coil spring 8*b* will be denoted by Mb2.

Even when the pump VP is under operation, only the low pressure of backpressure chamber R2 (i.e., pressure lower than that of the control chamber R1 or discharge port 24, more specifically, atmospheric pressure) is applied to a portion of the outer circumferential surface of cam ring 4 which faces the backpressure chamber R2. Accordingly, practically no force capable of swinging the cam ring 4 about the fulcrum Q is applied from the back-pressure chamber R2 to the cam ring 4. Moreover, a fluid pressure received by the inner circumferential surface 400 of cam ring 4 from the respective pump chambers is substantially symmetrical with respect to an imaginary straight line Q-P. Hence, this received pressure generates practically no moment of force that swings the cam ring 4 about the fulcrum Q.

On the other hand, working oil is supplied from the discharge port 24 into the control chamber R1 which is located in the direction that increases the eccentricity by means of biasing force of the basing member 8. Thereby, a high pressure of the control chamber R1 (i.e., discharge pressure higher than atmospheric pressure) is applied to a portion of the outer circumferential surface 401 of cam ring 4 (main body portion 40) which faces the control chamber R1. Accordingly, the cam ring 4 is pressed and biased by this fluid pressure. A biasing force Fl of this fluid pressure (hereinafter referred to as "control pressure") increases according to the increase of a pump rotational speed (discharge pressure), and generates a moment of force Ma that rotates (swings) the cam ring 4 about the fulcrum Q in a direction that reduces the eccentricity amount of center P from the center O (direction that brings the center P closer to the center O). That is, the moment of force Ma is generated around the fulcrum Q in the counterclockwise direction of FIG. 2. Accordingly, the control chamber R1 swings the cam ring 4 against the biasing force of biasing member 8, so that the rate of volume change of pump chamber r (i.e., pump capacity) is reduced.

When the rotational speed of pump VP is low, the pump VP is under the initial setting state as shown in FIG. 2. That is, because the pressure (control pressure) of discharge port 24 is low, the biasing force Fl applied from the control chamber R1 to the cam ring 4 is low. Hence, the clockwise moment Mb (Mb1) generated by the biasing member 8 (first coil spring 8*a*) is greater than the counterclockwise moment Ma generated by the control pressure. Therefore, the cam ring 4 is positioned in the initial setting position shown in FIG. 2 which has the maximum eccentricity.

The biasing force Fl functioning to swing the cam ring 4 against the biasing force of biasing member 8 increases as the control pressure becomes higher with the increase of the pump rotational speed. When the control pressure reaches a predetermined value, a magnitude of the moment Ma generated by the control pressure becomes substantially equal to a magnitude of the moment Mb1 generated by the biasing member 8 (first coil spring 8*a*). When the control pressure becomes higher than the predetermined value; the moment Ma becomes greater than the moment Mb1, and hence the cam ring 4 starts to swing from the maximum-eccentricity position of FIG. 2 in the counterclockwise direction. At this time; the contact surface 430 of cam ring 4 is made to depart (get away) from the contact surface 140 of housing body 1, and the arm portion 42 moves in the y-axis negative direction so as to compress the first coil spring 8*a*. The receiving portion 421 moves toward the opening portion of spring chamber 170 while compressing the first coil spring 8*a*.

When the pump rotational speed (control pressure) becomes a predetermined value, the end surface 423 of receiving portion 421 becomes in contact with the y-axis positive-side end of second coil spring 8*b* which has been received in the spring chamber 170 under the state where the y-axis positive-side end of second coil spring 8*b* has been stopped at the stopping portions 174 and 175. At this time, the eccentricity amount (distance between the centers O and P) of cam ring 4 is equal to a predetermined value given between its maximum value (FIG. 2) and its minimum value (FIG. 6). When the pump rotational speed (control pressure) is kept within a predetermined range, the magnitude of moment Ma by the control pressure is lower than or equal to the sum of the moment Mb1 by the first coil spring 8*a* and the moment Mb2 by the second coil spring 8*b*. At this time, the cam ring 4 does not swing, and is maintained in its predetermined position (corresponding to the above-mentioned predetermine value of eccentricity amount). Hereinafter, this state will be referred to as "hold state", and the position of cam ring 4 under this hold state will be referred to as "hold position". The rate of volume change of pump chambers r1 to r7 under this hold state is smaller than that under the initial setting state, and is greater than that under the minimum-eccentricity state.

When the pump rotational speed (control pressure) increases beyond the predetermined range, the moment Ma becomes greater than the moment Mb (=Mb1+Mb2). Hence, the cam ring 4 restarts the swing motion from the hold position in the counterclockwise direction. At this time, the end surface 423 of receiving portion 421 enters (moves into) the spring chamber 170, namely, moves in the y-axis negative direction so as to compress both of the first coil spring 8*a* and second coil spring 8*b*.

When the pump rotational speed (control pressure) reaches a predetermined value, the center P agrees (match) with the center O so that the eccentricity amount of cam ring 4 (distance between the centers O and P) becomes equal to 0 (minimum eccentricity) as shown in FIG. 6. At this time, the magnitude of moment Ma becomes substantially equal to the magnitude of moment Mb, and hence the moment Ma and the moment Mb are balanced out. No moment of force that swings the cam ring 4 is generated in the clockwise and counterclockwise directions, and hence, the cam ring 4 does not swing any more in any direction. Under this minimum-eccentricity state, the volume difference between the y-axis positive directional pump chamber r4 (or the like) and the y-axis negative directional pump chamber r1 or r7 (or the like) is at minimum (substantially equal to 0). It is noted that the eccentricity amount of cam ring 4 under the minimum-eccentricity state does not have to be equal to 0, namely, the center P under the minimum-eccentricity state may be offset from the center O by a predetermined some amount, according to the present invention.

Next, a relation between the load W and a displacement amount of the biasing member 8 will now be explained. The displacement amount is a deformation amount (spring displacement) of the first coil spring 8*a* and/or the second coil spring 8*b*, and corresponds to the swing amount (swing angle) of cam ring 4 in the counterclockwise direction. The load W is a spring load of the first coil spring 8*a* and the second coil spring 8*b*, and corresponds to the biasing force Fs of the first coil spring 8*a* and the second coil spring 8*b*. In other words, the load W corresponds to the moment Mb (Mb1, Mb2).

Under the initial setting position of cam ring 4 shown in FIG. 2, the spring load is equal to the initial setting load W1 of first coil spring 8*a*. While the cam ring 4 is swinging from the initial setting position toward the above-mentioned hold position, (when the cam ring 4 is located between the initial setting position and the hold position), only the first coil spring 8*a* is compressed and deformed. Hence, at this time, the spring load increases in proportion to the displacement amount of first coil spring 8*a* (from the initial setting state) with a gradient dependent on a spring constant of the first coil spring 8*a*. Immediately before the cam ring 4 reaches the hold position, the spring load becomes equal to W2 (>W1) corresponding to (a current magnitude of) the displacement amount of first coil spring 8*a*. The moment Mb generated by the biasing member 8 has a magnitude dependent on the spring load of first coil spring 8*a*, when the cam ring 4 is located between the initial setting position and the hold position.

When the cam ring 4 has swung up to the hold position, the second coil spring 8*b* also becomes able to be compressively deformed in addition to the first coil spring 8*a*. Therefore, when the swing amount minutely increases under the state where the cam ring 4 is in the hold position; the spring load increases rapidly and discontinuously from the magnitude W2 to a magnitude W4 (=W2+W3), with little change of the spring displacement. This magnitude W4 is the sum of the initial setting load W3 of second coil spring 8*b* and the magnitude W2. Hence, at this time, also the moment Mb by the biasing member 8 increases discontinuously.

While the cam ring 4 is swinging from the hold position to the minimum-eccentricity position shown in FIG. 6, (when the cam ring 4 is located between the hold position and the minimum-eccentricity position), both of the first coil spring 8*a* and the second coil spring 8*b* are compressively deformed. Hence, the spring load is the sum of the loads of first and second coil springs 8*a* and 8*b*, and increases in proportion to the displacement amount of first and second coil springs 8*a* and 8*b* (from the hold position) with a gradient dependent on the sum of spring constants of the first and second coil springs 8*a* and 8*b*. When the cam ring 4 reaches the minimum-eccentricity position, the spring load becomes equal to a load W5 (>W4) corresponding to (a current magnitude of) the displacement amount of first and second coil springs 8*a* and 8*b*. The moment Mb generated by the biasing member 8 has a magnitude (Mb1+Mb2) dependent on the sum of the spring loads of first and second coil springs 8*a* and 8*b*, when the cam ring 4 is located between the hold position and the minimum-eccentricity position.

As explained above, a characteristic of the biasing member 8 is designed nonlinearly. The load W is increased discontinuously as the swing amount of cam ring 4 becomes greater. That is, the spring load increases in a stepwise change (discontinuously) at the hold position of cam ring 4. Moreover, a coefficient of elasticity of the biasing member 8, namely, a load (biasing force) per unit displacement amount is equal to the spring constant of first coil spring 8*a* within a swing range given between the initial setting position and the hold position, and is equal to the sum of the spring constants of first and second coil springs 8*a* and 8*b* within a swing range given between the hold position and the minimum-eccentricity position. That is, the coefficient of elasticity of biasing member 8 increases discontinuously at the time of the hold position.

Such a nonlinear characteristic can be obtained by providing the first coil spring 8*a* for always biasing the cam ring 4 irrespective of the swing amount, and providing the second coil spring 8*b* for applying its biasing force only when the cam ring 4 swings beyond the predetermined amount. That is, one spring (first coil spring 8*a*) urges or biases the cam ring 4 when the swing amount of cam ring 4 is small, and on the other hand, the plurality of springs (first and second coil springs 8*a* and 8*b*) urge or bias the cam ring 4 when the swing amount of cam ring 4 becomes large. By such structures, the nonlinear characteristic can be achieved.

Figure 10:
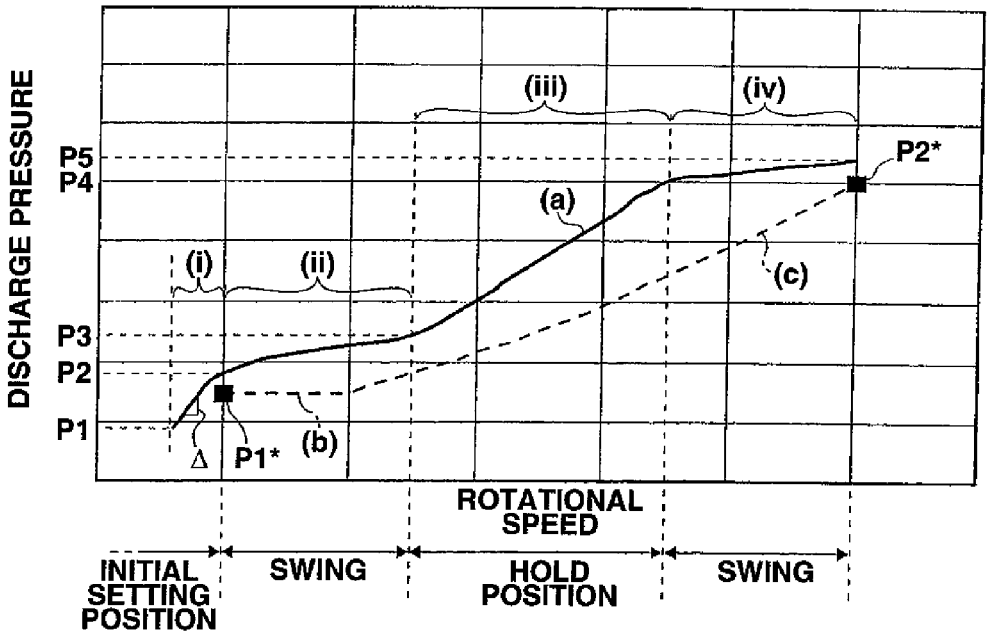
FIG. 10 is a graph showing a hydraulic characteristic of the pump in the first embodiment.

FIG. 10 is a graph showing a characteristic (hydraulic characteristic) of the discharge pressure of pump VP in relation to a rotational speed of the engine (pump rotational speed). A solid line (a) denotes a hydraulic characteristic of the pump VP in this first embodiment. Dotted lines (b) and (c) denote a hydraulic characteristic which is generally desired for the engine.

The hydraulic pressure (oil pressure) which is desired for the engine is determined mainly by a hydraulic pressure necessary for lubrication of a bearing portion of the crank shaft. Hence, as shown by the dotted line (c), the hydraulic pressure which is desired for the engine has a tendency to increase with the increase of engine speed. Moreover, in a case that a variable valve operating apparatus is used for an improvement of fuel economy and/or a reduction of exhaust emission or the like, the discharge pressure of the pump is used as an actuation source for this variable valve operating apparatus. Accordingly, in order to ensure an actuation responsivity of this apparatus, a predetermined magnitude P1* of the pump discharge pressure is desired from the time of low engine speed, as shown by the dotted line (b). Therefore, the hydraulic characteristic necessary for whole of the engine is shown by a line connecting the dotted line (b) with the dotted line (c).

Since the pump VP in the first embodiment according to the present invention allows its capacity to vary in accordance with the engine rotational speed, a power loss is suppressed to improve the fuel economy. At that time, the pump VP in the first embodiment achieves the hydraulic characteristic as shown in the solid line (a) of FIG. 2 by the above-mentioned nonlinear characteristic of biasing member 8. The characteristic shown by the solid line (a) will now be explained by segmenting this characteristic into rotational-speed regions (i) to (iv) of FIG. 10.

After the engine is started, the moment Mb1 generated by the initial setting load W1 of biasing member 8 (first coil spring 8*a*) is greater than the moment Ma generated by the discharge pressure of pump VP (control pressure) in the region (i) in which the engine rotational speed is relatively low. In this region (i), the cam ring 4 is located in the initial setting position of FIG. 2. Since the eccentricity amount of cam ring 4 is at its maximum, the pump capacity becomes at its maximum. The discharge pressure rises up rapidly in response to the increase of engine rotational speed. In the region (i), the discharge pressure is swiftly uplifted from P1 to P2 as shown in FIG. 10. P2 is a value of the discharge pressure at which the cam ring 4 starts to swing against the biasing force of first coil spring 8*a*.

P2 is set at a value higher than the pump discharge pressure P1*(for example, a level of discharge pressure at which a locked state is released in the valve timing control apparatus including a mechanism for releasing the locked state by means of hydraulic pressure) which is capable of ensuring the actuation responsivity of variable valve operating apparatus. In other words, the pressure P1* is obtained in the rotational-speed region (i), and specifically, is realized a few seconds after an ignition key is turned on.

When the discharge pressure rises and becomes greater than or equal to the value P2, the moment Ma by the control pressure becomes greater than the moment Mb1 by the initial setting load W1 of biasing member 8 (first coil spring 8*a*). Hence, the cam ring starts to swing in the direction that reduces the eccentricity amount. In the region (ii), the discharge pressure rises from P2 to P3 in response to the rise of engine rotational speed. P3 is a value of discharge pressure at which the cam ring 4 starts to be held in the hold position. In the region between P2 to P3, the cam ring 4 continues to swing in the direction reducing the eccentricity amount if the moment Ma by the control pressure becomes greater than the moment Mb1 by the load (W1~W2) of biasing member 8 (the compressed so first coil spring 8*a*). During this swing, the increase of discharge pressure due to the increase of engine rotational speed (pump rotational speed) is cancelled out (counterbalanced) by the reduction of discharge pressure due to the reduction of pump capacity. Accordingly, in the region (ii), a rising gradient of the discharge pressure relative to the rise of engine rotational speed is smaller than that of the region (i). Therefore, in this region, the discharge pressure rises slowly.

When the discharge pressure rises and becomes equal to the value P3, the moment Ma by the control pressure becomes equal to the moment Mb1 by the load W2 of biasing member 8 (first coil spring 8*a*). In the region (iii), the discharge pressure rises from P3 to P4 in response to the rise of engine rotational speed. P4 is a value of discharge pressure at which the cam ring 4 restart to swing against the biasing force of the first and second coil springs 8*a* and 8*b*. In the region between P3 to P4, the moment Ma generated by the control pressure is balanced out by the moment Mb generated by the combined spring load W2~W4 of the first and second coil springs 8*a* and 8*b*. Therefore, the cam ring 4 does not swing, and is held in the hold position. The rate of change of volume in the pump chambers r1 to r7 at the time of hold position of cam ring 4 is smaller than that at the time of initial setting position of cam ring 4. Hence, the pump capacity in the region (iii) is smaller than that in the region (i). On the other hand, the pump capacity in the region (iii) is not reduced in a manner different from the region (ii) in which the cam ring 4 is swinging, but is a fixed value. Therefore, the rising gradient of discharge pressure relative to the rise of engine rotational speed in the region (iii) is smaller than that in the region (i) and larger than that in the region (ii). That is, in this region, the discharge pressure rises with a medium-degree gradient.

When the discharge pressure further rises and becomes higher than or equal to the value P4, the moment Ma generated by the control pressure becomes greater than the moment Mb generated by the spring load W4. The cam ring 4 restarts to swing in the direction that reduces the eccentricity amount of cam ring 4. In the region (iv), the discharge pressure rises from P4 to P5 in response to the rise of engine rotational speed. During this region, the cam ring 4 continues to swing in the direction reducing the eccentricity amount if the moment Ma by the control pressure becomes greater than the moment Mb by the load (W4~W5) of biasing member 8 (the compressed first and second coil springs 8*a* and 8*b*). Therefore, as the similar manner as the region (ii), the rising gradient of discharge pressure in the region (iv) relative to the rise of engine rotational speed is smaller than the regions (i) and (iii). Accordingly, the discharge pressure increases slowly in the region (iv).

As a whole, a shape of the hydraulic characteristic (a) which is obtained by combining the above rotational-speed regions (i) to (iv) is closely analogous to (similar to) a shape of the dotted line (b)-(c) which is the characteristic generally needed for the engine. In a medium speed range of engine, i.e., in the regions (ii) and (iii); the discharge pressure of pump VP rises according to so the rise of engine rotational speed, and also remains somewhat higher than that of the dotted line (b)-(c). Hence, the engine can be sufficiently lubricated. The value P5 of discharge pressure at the time of maximum rotational speed of engine is set at a value somewhat higher than a hydraulic pressure value P2* which is needed for the lubrication of engine at that time.

In the first embodiment, the actuation responsivity of variable valve operating apparatus can be ensured while reducing the power loss of engine caused by operating the pump. That is, in the pump VP in the first embodiment, an initial rising edge of the discharge pressure is made favorable by enlarging (making steeper) the gradient Δ of the region (i). Accordingly, a time elapsed between a start time of engine and a time point when a desired working oil pressure can be supplied to the variable valve operating apparatus can be shortened, so that the actuation responsivity of this apparatus can be enhanced. Moreover, by providing the biasing member 8 having the nonlinear characteristic, the discharge pressure characteristic (solid line (a)) of pump VP is brought closer to the minimum-necessary hydraulic characteristic (dotted line (b)-(c)) as much as possible, so that the discharge pressure is suppressed as a whole. Therefore, the power loss (energy consumption) due to an unnecessary rise of discharge pressure can be effectively reduced to improve a performance of fuel economy.

(Operation of Stopper Portion)

Under the initial setting state; the cam ring 4 is biased by the biasing member 8, and the outer circumferential so surface 401 (contact surface 430) of cam ring 4 is in contact with the contact surface 140 of housing body 1. Thereby, the cam ring 4 is positioned in the initial setting position (maximum eccentricity position), and concurrently, the control chamber R1 is separately formed. Since a sufficient sealing performance is secured by this contact, the fluid tightness of control chamber R1 can be ensured without sealing by use of any sealing member or the like. Thus, by ensuring the sealing performance under the initial setting state; the initial rising edge (in the rotational-speed region (i)) of discharge pressure is enhanced more reliably, and hence, the time elapsed after the start of engine until the necessary working oil pressure becomes capable of being supplied to the variable valve operating apparatus can be shortened more effectively. That is, a flow rate (flow quantity) is ensured by means of the sealing performance equivalent to a sealing member, at the time of maximum eccentricity (at the time of maximum theoretical discharge amount) needing a high volumetric efficiency. Therefore. the desired pump performance can be achieved without the reduction of initial pump efficiency.

Since the contact surface 430 of cam ring 4 is in surface-contact with the contact surface 140 of housing body 1, this contact area can be enlarged to enhance the sealing performance. Moreover, both of these contact surfaces 140 and 430 are flat planes. Hence, it is easy to form these contact surfaces 140 and 430 so that the processing cost thereof can be reduced as compared with, e.g., a case that the contact surfaces 140 and 430 are curved surfaces. Moreover, the contact surfaces 140 and 430 are in contact with each other, over the z-axis directional entire range of control chamber R1, so that the sealing performance of control chamber R1 can be more improved. In the same manner, since the pivot setting portion 133 and the pivot portion 41 are provided over the z-axis directional entire range of control chamber R1, the fluid tightness can be enhanced at the fulcrum Q so that the sealing performance of control chamber R1 can be enhanced.

Since the contact surface 140 is formed in the inner circumferential surface (as a part of the side surface of protruding portion 14) of housing body 1, it is unnecessary that some member is provided for the stopper portion. Thereby, it is easy to form the contact surface 140, resulting in a cost reduction and an improvement of assembling performance.

The protruding portion 43 (contact portion 43*a*) protrudes in the outer circumferential side of cam ring 4, as a portion of cam ring 4 on which the protruding portion 14 of housing body 1 abuts. Since this protruding portion 43 (contact portion 43*a*) becomes in contact with the protruding portion 14, it is unnecessary that some member is provided for the stopper portion. Thereby, it is easy to form the stopper portion, resulting in the cost reduction and the improvement of assembling performance.

The contact surface 140 of housing body 1 is formed of a material softer than the contact portion 43*a* of cam ring 4. Specifically, the housing body 1 is molded of aluminum-based metallic material, and the contact surface 140 is also formed of the aluminum-based metallic material. On the other hand, the cam ring 4 is mold of iron-based metallic material, and the contact portion 43*a* (contact surface 430) of cam ring 4 is also formed of the iron-based metallic material. Accordingly, even if there were some errors in dimensions between the respective components at the time of manufacturing or assembling; the shape of contact surface 140 gradually changes along the shape of contact portion 43*a* (contact surface 430), namely changes so as to fit the shape of contact portion 43*a*, as the pump VP is used repeatedly many times (as the number of times the contact surfaces 140 and 43*a* become in contact with each other at the stopper portion is increased). Thereby, a degree of adherence between the both contact surfaces 140 and 43*a* is improved. Therefore, the sealing performance at the stopper portion can be more enhanced under the initial setting state.

(Operation of Choking Portion)

The choking portion (choke forming portions 15 and 43*b*) is on the outer circumferential side of cam ring 4, and is formed at a part located in the direction (on y-axis positive directional side of cam ring 4) that deviates the cam ring 4 from the center O by the biasing force of biasing member 8. Also after the cam ring 4 starts to swing, the choking portion limits or restricts the flow of working oil between the control chamber R1 and the backpressure chamber R2. By virtue of this choking effect, the choking portion achieves a sealing function. Thereby, the control chamber R1 is separately formed, and the pressure within the control chamber R1 is maintained at a predetermined value so as to secure the generation of control pressure according to the pump rotational speed. Therefore, the pump VP can be properly operated while allowing the pump capacity of vane pump VP to be varied by the control pressure, even if the cam ring 4 swings.

That is, after the cam ring 4 starts to swing, the contact surface 430 of cam ring 4 gets away from the contact surface 140 of housing body 1 so that the stopper portion becomes incapable of fulfilling the sealing function. At the same time, a small amount of working oil comes to leak from the control chamber R1 (having a high pressure) through the choking portion (clearance CL) to the backpressure chamber R2 (having a low pressure). However, this leakage amount practically does not affect the control pressure. Alternatively, the choking portion limits or suppresses the leakage amount, in other words, functions to seal the control chamber R1. Thereby, the inside of the control chamber R1 is maintained at the predetermined pressure. Although this predetermined pressure is slightly lower than a pressure level in the case of no leakage, this predetermined pressure has a magnitude capable of generating the moment Ma sufficient to swing the cam ring 4.

The portion (backpressure chamber R2) of the outer circumference of cam ring 4 except the control chamber R1 is communicated with the suction hole 22, and is open to the atmosphere. Therefore, even if the working oil leaks from the choking portion and flows into this portion (backpressure chamber R2), it is suppressed that an extra hydraulic pressure is applied to the cam ring 4. Moreover, working oil leaked from the choking portion is sucked into the backpressure chamber R2 (suction port 23), and is collected and again supplied to the pump VP. Hence, an efficiency of the pump VP is improved. Moreover, since working oil amount to be supplied to the engine is in an oversupply condition when the cam ring 4 is swinging (during the regions (ii) to (iv)), the lubrication of engine does not receive an influence of the above-mentioned leakage.

A predetermined fluid pressure due to the above-mentioned leaked working oil is applied to the outer circumferential surface 401 of cam ring 4, over a range from the choke forming surface 431 to the arm portion 42. This fluid pressure slightly generates a moment of force in the direction that increases the swing amount of cam ring 4 (direction that reduces the eccentricity). In other words, the fluid pressure due to the above-mentioned leakage functions to assist the moment Ma generated by the control pressure, after the cam ring 4 starts to swing from the initial setting position. That is, the fluid pressure due to the above-mentioned leakage acts to slightly reduce the gradients (relative to engine rotational speed) of discharge pressure of the regions (ii) and (iv).

On the other hand, when the engine rotational speed transfers from the region (i) to the region (ii) and the cam ring 4 starts to swing, the contact surface 430 of cam ring 4 moves away from the contact surface 140 of housing body 1. Hence, a portion for separating the control chamber R1 (from the backpressure chamber R2) is changed from the stopper portion to the choking portion. That is, at this time, the choking portion starts to function to separately form the control chamber R1 in place of the stopper portion. Hence, a portion of the outer circumferential surface 401 which is facing the control chamber R1 comes to have its area (square measure value) increased by the area of contact surface 430. That is, at this time, an area receiving the discharge pressure (control pressure) in the outer circumferential surface 401 is rapidly increased by the area of contact surface 430. Thereby, the moment Ma which is caused by the control pressure is rapidly increased due to the above-mentioned increase of pressure-receiving area, and momentarily becomes greater than the moment Mb1 which is caused by the load W1 of biasing member 8 so that the cam ring 4 is made to swing at high speed. That is, the pump capacity rapidly decreases as compared with a case that the pressure-receiving area of control chamber R1 is not changed. The gradient of discharge pressure in FIG. 10 changes momentarily at higher rate (than at the time of the other rotational speed values in the region (ii)), i.e., the gradient is instantaneously decreased, when the rotational speed enters from the region (i) to the region (ii). However, even at this instant, the magnitude of discharge pressure is designed to remain greater than or equal to the value P1*. Therefore, no problem occurs due to this rapid change.

As explained above, the pump VP in the first embodiment can separately form the control chamber R1 irrespective of the swing state of cam ring 4 without providing any extra sealing member. Accordingly, the assembling performance is improved resulting in the reduction of cost. For example, in a case that a seal material arranged slidably in contact with an inner circumferential surface of housing and an elastic member for biasing this seal material toward the inner circumferential surface of housing so as to force the seal material to be in close contact with the inner circumferential surface are provided as sealing members for sealing between a control chamber and a backpressure chamber as disclosed by the patent document 1; the assembling of these members is not easy, and moreover, there is a risk that an assembling failure occurs. Hence, in this case, a quality of product becomes unstable. Moreover, a cost increase is caused due to the increase in number of components. In order to improve an assembling performance of these sealing members and to stabilize the quality of product, it is a relatively easy way that a pivot pin for functioning as a swing fulcrum of cam ring is provided as a member separate from the cam ring or the like and is mounted after the sealing members have been mounted, as disclosed by the patent document 1. However, in this case, the number of components is further increased and also an assembling man-hour is increased, so that the cost reduction is difficult to achieve. Contrary to this, in the first embodiment according to the present invention, since the control chamber R1 is separately formed by the choking portion without providing any extra sealing member, the assembling performance is improved while stabilizing the quality of product and attaining a remarkable cost reduction (in view points of the number of components, the assembling performance and the like). Moreover, an additional pivot pin does not need to be provided, and the swing fulcrum (pivot portion 41) can be formed integrally with the cam ring. Therefor, the above-mentioned advantageous effects are further enhanced.

The choke forming surfaces 150 and 431 (choking portion) are in concentric circular-arc shapes (having the approximately equal curvature) each of which is formed by defining the swing fulcrum Q as its center. The choke forming surfaces 150 and 431 have a shape along the swing path of cam ring 4. Accordingly, even when the cam ring 4 swings, the flow-passage cross-sectional area (square-measure value of the clearance CL in FIG. 9) of the choking portion remains equal to L×H, namely, varies very little. Accordingly, a variation of a resistance (difficulty of flowing working oil in the choking portion with respect to the fluid pressure of control chamber R1) of the choking portion can be maintained at constant level (linear variation) relative to the swing amount of cam ring 4 (relative to the variation of flow-passage length D of the choking portion). Therefore, an amount of working oil which is leaked out from the choking portion when the pump VP is under operation can be calculated easily, so that a setting of characteristic of the pump VP becomes easy.

The stopper portion (contact surface 430) is provided at a portion of the cam ring 4 (protruding portion 43) which is relatively close to the swing fulcrum Q, and the choking portion (choke forming surface 431) is provided at a portion of the cam ring 4 which is more distant from the swing fulcrum Q than the stopper portion. Accordingly, the contact by the stopper portion (contact surface 430) can perform the stopper function and ensure the sealing function before the start of swing of the cam ring 4, and then the choking effect by the choking portion (choke forming surface 431) can ensure the sealing function after the start of swing of cam ring 4.

The stopper portion (protruding portion 14, contact portion 43*a*) is arranged adjacent to the choking portion (choke forming portion 15, 43*b*). More specifically, the protruding portion 43 protrudes in a substantially triangular shape from (the main body portion 40 of) the cam ring 4. One side surface (the contact surface 430 of contact portion 43*a*) of the protruding portion 43 abuts on (contact surface 140 of) the protruding portion 14 of housing body 1, and another side surface (the choke forming surface 431 of choke forming portion 43*b*) of the protruding portion 43 cooperates with the choke forming portion 15 (choke forming surface 150) of housing body 1 to form or define the choking portion therebetween.

Accordingly, the stopper portion and the choking portion can be formed all together, only by forming one protrusion in the outer circumferential portion (on the outer circumference of main body portion 40) of the cam ring 4. Hence, the manufacturing of these portions is easy so that the processing cost can be reduced, and the structure of pump can be simplified. Moreover, a size of the pump VP can be suppressed because a necessary space is saved. Furthermore, because the shape of protruding portion 43 is substantially like a triangle; the manufacturing can be made easier, and a root portion of the protruding portion 43 which receives some force when becoming in contact with the protruding portion 14 (contact surface 140) of housing body 1 can be made to have a high rigidity.

In a case that the stopper portion and the choking portion are provided away from each other, the pressure-receiving area of the outer circumferential surface of cam ring 4 in the control chamber is instantaneously increased by an area ranging between the stopper portion and the choking portion (not only the area of contact surface), when the cam ring 4 starts to swing so as to pull the both contact surfaces of stopper portion away from each other. Contrary to this, because the stopper portion and the choking portion are provided next to each other in the first embodiment according to the present invention, the rapid change of pressure-receiving area of the control chamber R1 can be suppressed (down to an amount of the area of contact surface 140, 430) when the cam ring 4 starts to swing.

In the first embodiment, the stopper portion (contact surface 140, 430) and the choking portion (choke forming surface 150, 431) are provided to have some angle therebetween. That is, the contact surface 430 and the choke forming surface 431 of the cam ring 4 form a mountain shape having the vertex angle β as viewed in the z-axis direction. In the same manner, the contact surface 140 and the choke forming surface 150 of the housing body 1 define both side surfaces of a substantially triangle-shaped concave portion given between the protruding portion 14 and the choke forming portion 15. That is, the contact surface 140 and the choke forming surface 150 of the housing body 1 form a valley shape having the bottom angle β as viewed in the z-axis direction. Accordingly, when the cam ring 4 starts to swing (immediately after the cam ring 4 has started to swing), a slight clearance is produced between the contact surfaces 140 and 430. At this time, the angle β exists between a choked flow passage produced by this clearance and the flow passage of the choking portion adjacent to this choked flow passage of slight clearance. Because of this bend of flow passage, a flow-passage resistance as a whole is enlarged so that a sealing performance at the time of swing start (immediately after the swing start) can be enhanced.

At a boundary between the contact surface 140 and the choke forming surface 150 which are formed in the housing inner-circumferential surface, there is provided a notch groove 18. The notch groove 18 is formed to notch or cut into the boundary portion between the contact surface 140 and the choke forming surface 150, in a direction in which the inner circumferential surface (contact surfaces 140) of housing body 1 and the outer circumferential surface (contact surface 430) of cam ring 4 are made away from each other, i.e., in the x-axis positive and y-axis positive direction perpendicular to the contact surfaces 140 and 430. Thus, since "escape portion" is provided, the both contact surfaces 140 and 430 can more reliably become in surface-contact with each other. That is, by forming the notch groove 18; an interference between the contact surface 140 of housing body 1 and the contact portion 43*a* (contact surface 430) of cam ring 4, and a reduction of sealing performance due to an uplift (occurrence of a clearance between both contact surfaces 140 and 430) or the like can be avoided in the stopper portion. Moreover, also in the side of cam ring 4, a boundary portion V between the contact surface 430 and the choke forming surface 431 is chamfered, i.e., is formed with a round chamfered portion. Thereby, the contact surface 430 is depressed or curved in the direction that brings the outer circumferential surface (contact surface 430) of cam ring 4 away from the inner circumferential surface (contact surfaces 140) of housing body 1. Hence, the above-mentioned effects can be obtained more reliably.

The facing area (Da×H) of the choking portion is designed to be greater than the contact area (Dc×H) of the stopper portion under the maximum eccentricity state (the initial setting state shown in FIGS. 2 and 7). That is, the circumferential length Da of the choke forming surface 150 is set longer than the circumferential length Dc of the stopper portion (contact surface 140). Accordingly, even when the choke forming surfaces 150 and 431 have been shifted parallel from each other at the time of swing of cam ring 4, the flow-passage length of the choking portion (i.e., the facing overlap therebetween) is sufficiently secured (≥Db) so that the sealing performance can be ensured in the choking portion. On the other hand, because the stopper portion has only to perform the stopper function, the stopper portion may be reduced in size. Therefore, by designing the contact area (circumferential lengths of both contact surfaces 140 and 430) of the stopper portion to be smaller than the facing area of the choking portion (under the initial setting state), the pump VP is downsized.

The biasing member 8 is provided in a portion (back-pressure chamber R2) of the radially outer space (outer circumferential space) of cam ring 4 which is other than the control chamber R1. The biasing member 8 is located on the side opposite to the location of swing fulcrum Q relative to the cam ring 4. Accordingly, an arm for the moment Mb which is caused around the swing fulcrum Q by the biasing force of biasing member 8 is long (as compared with a case that the biasing member 8 is disposed on the side same as the location of swing fulcrum Q). Thereby, the biasing force Fs of biasing member 8 can be set small. That is, even if the biasing force Fs is small, the moment Mb having a sufficiently large magnitude can be produced. Specifically, the biasing member 8 is disposed within the spring chamber 170 to allow the biasing member 8 to bias the cam ring 4 (arm portion 42), at the most distant location from the point Q, i.e., at a location substantially symmetrical to the point Q with respect to the center P of inner circumferential surface of cam ring 4. Hence, the moment Mb can be maximized. Therefore, the biasing force Fs can be reduced so that the biasing member 8 is can be downsized. Hence, whole of the pump VP can be downsized to improve a layout flexibility.

(Operation of Bearing Oil-Feeding Groove)

The bearing oil-feeding groove 26 is formed in the rear cover 2, and working oil is actively introduced to the bearing hole 20 through the bearing oil-feeding groove 26. Accordingly, the bearing hole 20 can be smoothly lubricated so that a durability of the bearing portion 2*b* can be improved. Since the bearing oil-feeding groove 26 is communicated with the discharge port 24, a high-pressure working oil is supplied from the discharge port 24 to the bearing hole 20. Hence, an amount of supply oil can be sufficiently secured so that the bearing portion 2*b* can be lubricated more smoothly.

When any one of the vanes 6 has rotated and moved up to its position overlapping with the bearing oil-feeding groove 26 (lateral groove 26*a*) in the z-axis direction while rising and falling from and into the rotor 5, at least a part of the vane 6 is deviated from (does not overlap with) the lateral groove 26*a* irrespective of the eccentricity state of cam ring 4. That is, the range in which the vane 6 passes over the lateral groove 26*a* while sliding on the surface 2*a* is given so as to overlap with the first groove 261 (in the z-axis direction). The first groove 261 is oblique to the radial direction of rotor 5, namely is formed to have some angle between the extending direction of first groove 261 and the rising-and-falling direction of vane 6. Therefore, when the vane 6 reaches its position which overlaps with the first groove 261, the vane 6 intersects with the first groove 261 as viewed in the z-axis direction irrespective of the eccentricity state of cam ring 4. At this time, a part of the vane 6 which is other than this intersection part (overlapping part) is away from the lateral groove 26*a* (first groove 261) and is located on a part (near the first groove 261) of the surface 2*a* of rear cover 2.

Accordingly, the vane 6 does not drop or sink into the lateral groove 26*a* (first groove 261). Therefore, a smooth rotation of the rotor 5, namely, a smooth operation of the pump VP is achieved. Moreover, the vane 6 and the rear cover 2 can be prevented from being damaged or worn away, so that a durability of the pump VP can be enhanced. Particularly, this advantage becomes more effective in a case that the pump VP is used up to in a high rotational-speed region, for example, in a case that the speed of pump VP is doubled. Moreover, since the vane 6 is prevented from dropping into the lateral groove 26*a* also at the time of stop of pump VP, it can be suppressed that the vane 6 is caught in the lateral groove 26*a* at the time of restart of pump VP. Hence, the vane 6 and the rear cover 2 can be effectively prevented from being damaged or worn.

Moreover, since the drop of vane 6 can be prevented as explained above, a groove width of the lateral groove 26*a* (a width in a direction perpendicular to the extending direction of lateral groove 26*a*) may be designed to be larger to some degree than a width of the vane 6 (a width in a direction perpendicular to an extending direction of vane 6 in the x-y plane) as viewed in the z-axis direction. In this case, it becomes easy to remove the rear cover 2 from a metallic die when the rear cover 2 is molded by means of aluminum die casting.

Moreover, the lateral groove 26*a* is formed to be bent. Namely, the lateral groove 26*a* includes the second groove 262 which extends from the end 3 located adjacent to the bearing hole 20, to the end I in the radial direction of rotor 5; and the first groove 261 which extends from the end I to the end H located adjacent to the discharge port 24, in a direction inclined from the radial direction of rotor 5. Since the second groove 262 extending in the radial direction of rotor 5 is provided, there is an advantage in tapering (draft angle) when the rear cover 2 is molded by aluminum die casting (metallic mold). Especially, the removal from the die becomes easy by molding the longitudinal groove 26*b* concurrently with the second groove 262. The end I of first groove 261 is located radially inside the range (locus of the base end portion of vane 6) over which the vane 6 slides on the surface 2*a* while rising and falling from and into the rotor 5, irrespective of the eccentricity state of cam ring 4. Accordingly, each of the vanes 6*a* to 6*g* does not overlap with the second groove 262 within the above-mentioned sliding range of vane 6 (as viewed in the z-axis direction). Therefore, an interference between each vane 6 and the bending portion (end I) of lateral groove 26*a* is prevented so that the wearing-away or the like can be suppressed more effectively.

The first groove 261 overlapping with the sliding range of vane 6 (radially outside the second groove 262) is inclined from the radial direction (the second groove 262) of drive shaft 9, toward the counter-rotational direction of drive shaft 9. Hence, after the vane 6 starts to overlap with the first groove 261, an intersection point between the vane 6 and the first groove 261 moves in the radially inner direction in accordance with the rotation of drive shaft 9 (rotor 5). Working oil rotating to follow the vane 6 is at first supplied to a radially outer portion of the first groove 261. Then, this working oil is pushed out in the radially inner direction within the first groove 261, i.e., in a direction toward the second groove 262 and the longitudinal groove 26*b* (bearing hole 20), as the intersection point moves in the radially inner direction. Thus, by virtue of the inclined structure of first groove 261, working oil can be actively guided from the lateral groove 26*a* to the bearing hole 20 when the vane 6 slides on the lateral groove 26*a*. Particularly, in the case that the pump VP is used up to in a high rotational-speed region, the advantage by virtue of this structure becomes more effective, because the amount of working oil to be supplied to the bearing hole 20 can be secured more easily.

The bottom portion 263 of longitudinal groove 26*b* which is formed in the inner circumferential surface of bearing hole 20 is provided within a range between the end of housing inner side (z-axis positive side) of the bearing hole 20 and the (z-axis negative directional) predetermined point. Accordingly, the inside of bearing hole 20 can be effectively lubricated by the longitudinal groove 26*b*. Moreover, contrary to a case that the longitudinal groove 26*b* is provided over z-axis directional entire range of the bearing hole 20, it is suppressed that working oil excessively leaks through the longitudinal groove 26*b* to an external space of the housing so that fluid pressure (discharge pressure) within the control chamber R1 can be prevented from being reduced. On the other hand, the bottom portion 263 of longitudinal groove 26*b* is communicated through a slight gap given between an outer circumferential surface of the drive shaft 9 and the circumferential surface of the bearing hole 20, with an end of housing outer side (z-axis negative side) of the bearing hole 20, so as to open to atmospheric pressure. Accordingly, through this slight gap, a moderate flow of working oil can be achieved from the bearing oil-feeding groove 26 (longitudinal groove 26*b*) which receives high pressure, toward an external space of housing which receives low pressure. Therefore, the flow amount introduced through the bearing oil-feeding groove 26 toward the bearing hole 20 can be sufficiently secured so that the bearing portion 2*b* (bearing hole 20) can be smoothly lubricated.

The bearing oil-feeding groove 26 does not need an accuracy and a surface roughness equivalent to a degree required by the surface 2*a* and the bearing hole 20 allowing the vane 6 and the drive shaft 9 to slide thereon. Hence, the bearing oil-feeding groove 26 is molded concurrently when the rear cover 2 is molded by means of die forming. Therefore, the processing cost can be reduced.

Effects in First Embodiment

Advantageous effects of the variable displacement oil pump VP in the first embodiment according to the present invention will now be listed.

(1) The pump VP according to the present invention includes: the rotor 5 configured to rotationally driven; the plurality of vanes 6 movable out from and into the outer circumferential portion of the rotor 5; the cam ring 4 which receives the rotor 5 and the plurality of vanes 6 in the inner circumferential space of cam ring 4, which cooperates with the side walls (rear cover 2 and front cover 3 provided on both the axial side surfaces of the cam ring 4), the rotor 5 and the plurality of vanes 6 to separately form the plurality of working-oil chambers (pump chambers r1 to r7), and which is configured to swing about the swing fulcrum Q to vary the eccentricity between the rotation center O of the rotor 5 and the center P of inner circumferential surface 400; the housing HSG which receives the cam ring 4 therein, which includes the discharge portion (discharge port 24) open to at least one (discharge chambers r5 to r7) of the plurality of working-oil chambers (pump chambers r1 to r7) from at least one (rear cover 2) of the side walls (rear cover 2 and front cover 3), wherein the at least one (r5 to r7) of the plurality of working-oil chambers reduces its volume when the center P of inner circumferential surface 400 of cam ring 4 becomes eccentric relative to the rotation center O of rotor 5, and which includes the suction portion (suction port 23) open to at least one (suction chambers r1 to r3) of the plurality of working-oil chambers (pump chambers r1 to r7) from at lest one (rear cover 2) of the side walls (rear cover 2 and front cover 3), wherein the at least one (suction chambers r1 to r3) of the plurality of working-oil chambers to which the suction portion (suction port 23) is open increases its volume when the center P of inner circumferential surface 400 of cam ring 4 becomes eccentric relative to the rotation center O of rotor 5; the biasing member 8 configured to bias the cam ring 4 in a direction that enlarges the eccentricity between the rotation center O of rotor 5 and the center P of inner circumferential surface 400 of cam ring 4; the contact surface 140 configured to become in contact with the outer circumferential surface (contact surface 430) of cam ring 4 by means of biasing force applied to the cam ring 4 by the biasing member 8; the control chamber R1 which is separately formed by the contact surface 140 and the swing fulcrum Q (pivot setting portion 133, pivot portion 41) of cam ring 4 on the outer circumference of cam ring 4 when the contact surface 140 is in contact with the outer circumferential surface (contact surface 430) of cam ring 4, and which is configured to cause the cam ring 4 to swing against the biasing force of the biasing member 8 by the pressure introduced from the discharge portion (discharge port 24) to the control chamber R1; and the choking portion (choke forming surface 431) formed on the outer circumferential surface 401 of cam ring 4 so as to maintain a pressure of the control chamber R1 even when the cam ring 4 swings.

Accordingly, the control chamber R1 can be isolated without using a special-purpose sealing member so that the pressure of control chamber R1 is maintained at a constant pressure. Hence, the number of components (structural parts) can be reduced while improving the assembling performance and reducing the cost. Moreover, since the control chamber R1 is separately formed by the contact surface 140, the sealing performance can be improved before the cam ring 4 starts to swing. Thereby, the pump performance (discharging performance) can be sufficiently secured.

(2) The rotor 5 is rotationally driven by the internal combustion engine.

Accordingly, the rotational speed of pump VP has a synchronism with the rotational speed of the engine. Since the pump capacity can be varied according to the rotational speed of engine, the fuel economy can be improved. Moreover, the pump VP supplies a necessary working oil to the engine. That is, generally, as a performance of variable displacement oil pump for an internal combustion engine, it is necessary to ensure a sufficient discharging performance before the swing start of cam ring 4, but it is not necessary to secure so high discharging performance after the swing start of cam ring 4. Therefore, in the case that the pump VP having the advantageous effect mentioned in above (1) is applied to the engine, a pump performance desired by the engine can be satisfied with a reduction in cost and the like.

(3) The outer circumferential space (backpressure chamber R2) of the cam ring 4 which is other than the control chamber R1 is communicated with the suction portion (suction port 23).

Accordingly, it can be suppressed that an undesired extra hydraulic pressure applies to the cam ring 4 even if working oil leaks through the choking portion. Moreover, a favorable efficiency of the pump VP can be achieved.

(4) The biasing member 8 is disposed on a side opposite to the location of swing fulcrum Q relative to cam ring 4, in the outer circumferential space (backpressure chamber R2) of cam ring 4 which is other than the control chamber R1.

Accordingly, the biasing member 8 can be downsized. Thereby, the pump VP can be downsized so that a degree of freedom in layout is enhanced.

(5) The swing fulcrum Q (pivot setting portion 133, pivot portion 41) is formed over the entire axial range of the cam ring 4.

Accordingly, a fluid tightness at the swing fulcrum Q can be enhanced to improve the sealing performance of the control chamber R1.

(6) The contact surface 140 becomes in contact with the entire axial range of the outer circumferential surface (contact surface 430) of cam ring 4.

Accordingly, a fluid tightness at the contact surface can be enhanced to improve the sealing performance of the control chamber R1.

(7) The outer circumferential surface 401 of cam ring 4 includes the flat surface (contact surface 430), and the contact surface 140 is a flat surface configured to become in contact with the flat surface (contact surface 430) of cam ring 4 by means of surface contact.

Accordingly, the contact area (abutting area) can be increased to enhance the sealing performance.

(8) The contact surface 140 is formed of a material softer than the cam ring 4.

Accordingly, the shape of contact surface 140 varies in conformity with the shape of cam ring 4 so that a degree of intimate contact (tightness) between the contact surface 140 and the cam ring 4 is enhanced. Therefore, the sealing performance at the contact portion (stopper portion) can be enhanced.

(9) The contact surface 140 is formed in the inner circumferential surface (side surface of the protruding portion 14) of the housing HSG (housing body 1).

Accordingly, an extra member for constituting the housing-side contact portion (stopper portion) does not need to be provided. Moreover, this contact surface 140 is easy to form. Therefore, the assembling performance can be improved with the reduction in cost.

(10) The contact surface 140 is formed in the inner circumferential surface of the housing (housing body 1) molded of an aluminum-based metallic material; and the cam ring 4 is molded of an iron-based metallic material.

Accordingly, the advantageous effects mentioned in above (8) and (9) can be obtained.

(11) The choking portion (clearance CL between the choke forming surfaces 431 and 150) is formed to prevent its flow-passage cross-sectional area from changing even when the cam ring 4 swings.

Accordingly, the leakage amount from the choking portion can be easily calculated, and thereby a setting of the pump characteristic becomes easy.

(12) The control chamber R1 is provided at a portion of outer circumferential space of cam ring 4 which is located in the direction that enlarges the eccentricity of cam ring 4 and which is between the contact portion (stopper portion) and the swing fulcrum Q of cam ring 4. This control chamber R1 is open to the discharge portion (discharge port 24). Moreover, the choking portion (choke forming surface 431) is formed in a portion of outer circumferential surface 401 of cam ring 4 which is located in the direction that enlarges the eccentricity of the cam ring 4. This choking portion (choke forming surface 431) has a shape extending along the swing path of cam ring 4.

Accordingly, the flow-passage cross-sectional area of the choking portion varies very little even if the cam ring 4 swings. Therefore, the advantageous effect mentioned in above (11) can be obtained.

(13) The contact surface 140 is located adjacent to the choking portion (choke forming surface 431).

Accordingly, the rapid change of the pressure-receiving area (moment of force Ma caused by the control pressure) of the control chamber R1 at the time of swing start of cam ring 4 is suppressed so that a stable pump characteristic can be obtained.

(14) The contact surface (140, 430) and the choking portion (choke forming surface 150, 430) are provided to form some angle between the contact surface (140, 430) and the choking portion (choke forming surface 150, 430).

Accordingly, the flow-passage resistance is increased at the time of swing start, and thereby the sealing performance can be enhanced.

(15) The contact surface 140 and the choking portion (choke forming surface 150) are formed in the inner circumferential surface of housing HSG; and the boundary portion between the contact surface 140 and the choking portion (choke forming surface 150) is notched in a direction in which the outer circumferential surface of cam ring 4 and the inner circumferential surface of housing are made away from each other when the cam ring 4 swings.

Thus, since the "escape portion" is provided, the contact surface 140 can more reliably become in contact with the outer circumferential surface (contact surface 430) of cam ring 4 even in the case that the contact surface 140 and the choking portion (choke forming surface 150) are provided adjacent to each other to form some angle therebetween as mentioned in above (13) and (14). The reduction of sealing performance due to the uplift or the like can be avoided.

(16) The cam ring 4 includes the protrusion (protruding portion 43) protruding in the radially outer direction of cam ring 4; and the contact portion (contact surface 140 of housing body 1) becomes in contact with this protrusion.

Accordingly, the contact portion (protruding portion 43) which is provided to the cam ring 4 is easy to form, so that the cost can be reduced.

(17) The protrusion (protruding portion 43) protrudes substantially in a triangle shape; one side surface (contact surface 430 of contact portion 43*a*) of the triangle-shaped protrusion becomes in contact with the contact portion (contact surface 140 of housing body 1); and the choking portion (choke forming surface 431) is provided in another side surface (choke forming portion 43*b*) of the triangle-shaped protrusion.

Accordingly, the advantageous effects mentioned in above (13), (14) and (16) can be obtained. Moreover, the contact portion (stopper portion) and the choking portion which should be provided to the cam ring 4 can be formed concurrently with each other by simply forming one protrusion in the outer circumferential portion of cam ring 4. Hence, the structure can be simplified to reduce the processing cost. Moreover, the space can be saved to enable the size of the pump VP to be suppressed. Furthermore, by forming the protrusion (protruding portion 43) in a substantially triangle shape; it becomes easier to form the contact portion (stopper portion) and the choking portion, and also, a rigidity of the protrusion which makes contact with the contact portion (contact surface 140 of housing body 1) can be made high.

(18) The contact portion (contact surface 140) becomes in contact with a first portion (contact portion 43*a*) of the cam ring 4 (protruding portion 43); and the choking portion (choke forming surface 431) is provided in a second portion (choke forming portion 43*b*) of the cam ring 4. This first portion is closer to the swing fulcrum Q than the second portion.

Accordingly, before the cam ring 4 starts to swing, namely under the initial setting state, the stopper function can be performed while ensuring the sealing performance of the control chamber R1, by the contact of the first portion (contact portion 43*a*). After the cam ring 4 starts to swing, the sealing performance of the control chamber R1 can be ensured by the choking effect of the second portion (choke forming portion 43*b*) which is more distant from the swing fulcrum Q than the first portion.

(19) The (facing) area Da×H of the choking portion is larger than the contact area Dc×H between the contact portion (contact surface 140) and the outer circumferential surface (contact surface 430) of cam ring 4 under the state (initial setting state) that the cam ring 4 is eccentric at its maximum relative to the rotor 5.

Accordingly, the sealing performance in the choking portion can be sufficiently secured at the time of swing of the cam ring 4. Thereby, the contact portion (stopper portion) can be downsized.

Second Embodiment

In a pump VP according to a second embodiment, the notched groove 18 is not provided at the boundary portion between the choke forming surface 150 and the contact surface 140 in the inner circumferential surface of housing body 1. Since the other structures in the second embodiment are similar as the first embodiment, the explanations thereof will be omitted by giving reference signs same as the first embodiment to the corresponding structural parts.

Figure 11:
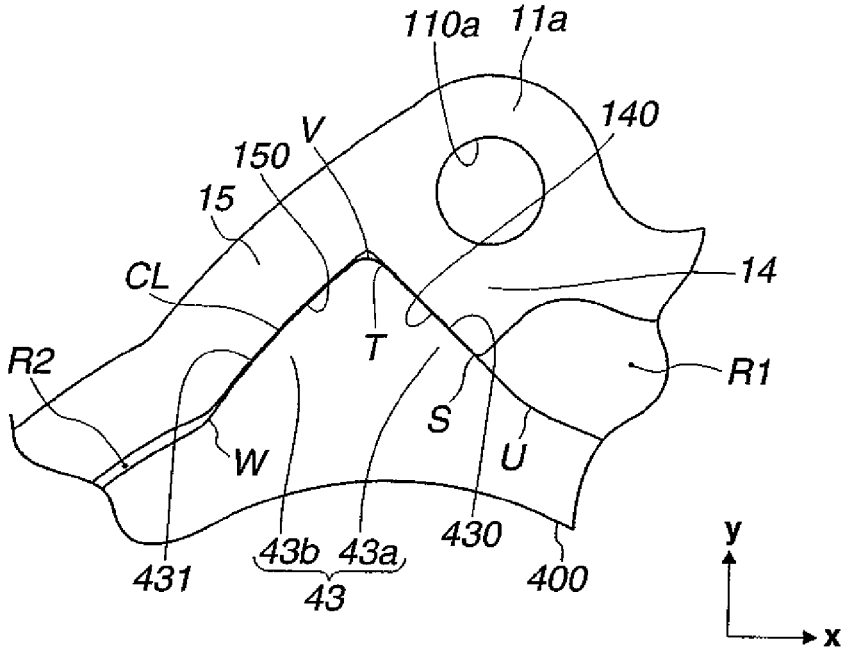
FIG. 11 is an enlarged view of the part in which the protruding portion of cam ring is received in a second embodiment according to the present invention (initial setting state).

FIG. 11 is an enlarged view of a part in which the protruding portion 43 of cam ring 4 is received in the second embodiment, under the initial setting state in the same manner as FIG. 7 of the first embodiment. Contrary to the first embodiment, the contact surface 140 extends beyond the end T toward the choke forming portion 15 (toward y-axis positive side), and then is connected through a small round boundary with the choke forming surface 150, in the housing body 1. In the cam ring 4, in the same manner as the first embodiment, there is provided the round chamfering at the boundary region V between the contact surface 430 and the choke forming surface 431. The contact surface 430 is depressed in the direction in which the inner circumferential surface (contact surfaces 140) of housing body 1 and the outer circumferential surface (contact surface 430) of cam ring 4 are made away from each other.

Thus, since "escape portion" is provided to the cam ring 4; the both contact surfaces 140 and 430 can more reliably become in surface-contact with each other, and the interference between the contact surface 140 of housing body 1 and the contact portion 43*a* (contact surface 430) of cam ring 4 and the reduction of sealing performance due to the uplift (occurrence of a clearance between both contact surfaces 140 and 430) or the like can be prevented in the stopper portion. That is, unlike the first embodiment, the surface contact between the contact surfaces 140 and 430 is ensured only by forming the round chamfering at the boundary region V of cam ring 4 without forming the notched groove 18 in the inner circumferential surface of housing body 1. Therefore, a process for forming the notched groove 18 can be omitted so that the manufacturing cost can be reduced while obtaining the similar effect as the first embodiment.

Third Embodiment

In a pump VP according to a third embodiment, the notched groove 18 is not provided at the boundary region between the choke forming surface 150 and the contact surface 140 in the inner circumferential surface of housing body 1, in the same manner as the second embodiment. Unlike the second embodiment, there is provided a flat chamfering at the boundary region V between the contact surface 430 and the choke forming surface 431 of the cam ring 4. Since the other structures in the third embodiment are similar as the second embodiment, the explanations thereof will be omitted by giving reference signs same as the second embodiment to the corresponding structural parts.

Figure 12:
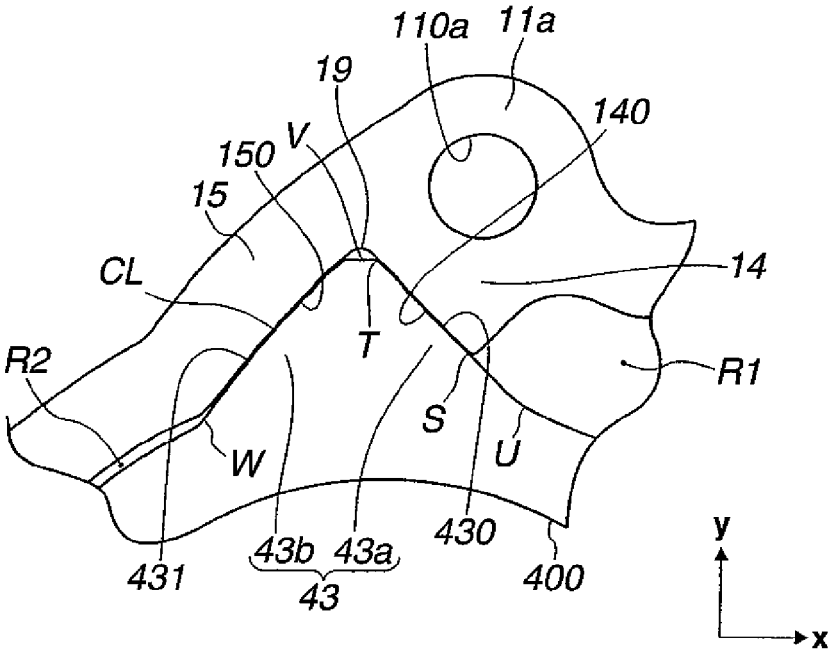
FIG. 12 is an enlarged view of the part in which the protruding portion of cam ring is received in a third embodiment according to the present invention (initial setting state).

FIG. 12 is an enlarged view of a part in which the protruding portion 43 of cam ring 4 is received in the third embodiment, in the same manner as FIG. 11 of the second embodiment. In the third embodiment, when chamfering the boundary region V between the contact surface 430 and the choke forming surface 431, the boundary region V is cut to form a flat plane having an angle of substantially 45° relative to the both surfaces 430 and 431. That is, the boundary region V includes a flat chamfered portion which is provided along a plane forming the angle of approximately 45 degrees with the both surfaces 430 and 431. Accordingly, the contact surface 430 is depressed or dropped in the direction in which the inner circumferential surface (contact surfaces 140) of housing body 1 and the outer circumferential surface (contact surface 430) of cam ring 4 are made away from each other.

Thus in the third embodiment, the flat chamfering is simply formed instead of the round chamfering of the second embodiment. Therefore, not only the effects similar as the second embodiment can be obtained, but also the processing cost can be more reduced because a processing of the flat chamfering is easy.

Fourth Embodiment

In a pump VP according to a fourth embodiment, the protruding portion 14 of housing body 1 is formed to become in line-contact with the contact portion 43*a* of cam ring 4, not in surface-contact with the contact portion 43*a*. Since the other structures in the fourth embodiment are similar as the first embodiment, the explanations thereof will be omitted by giving reference signs same as the first embodiment to the corresponding structural parts.

Figure 13:
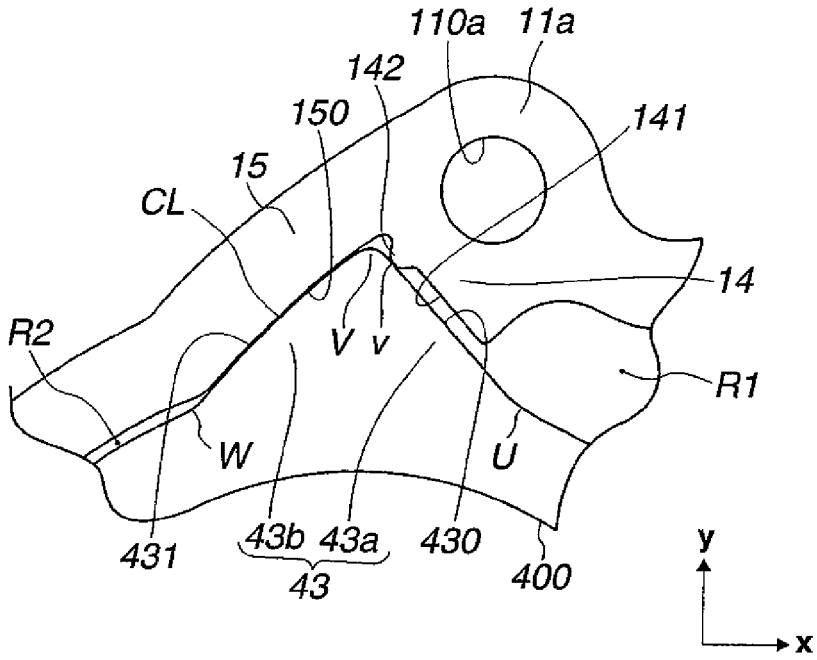
FIG. 13 is an enlarged view of the part in which the protruding portion of cam ring is received in a fourth embodiment according to the present invention (initial setting state).

FIG. 13 is an enlarged view of a part in which the protruding portion 43 of cam ring 4 is received in the fourth embodiment, under the initial setting state in the same manner as FIG. 7 of the first embodiment. The protruding portion 14 of housing body 1 is formed substantially in a triangle shape having a vertex (tip portion) in the radially inner side of protruding portion 14 as viewed in the z-axis direction. The protruding portion 14 includes a base bottom surface 141 in an x-axis negative side of protruding portion 14 (as an x-axis-negative-directional side surface of the triangle shape). The base bottom surface 141 is formed over a z-axis directional entire range of the inner circumferential surface of housing body 1, and is a flat surface facing in the x-axis negative and y-axis negative direction. An angle between the base bottom surface 141 and the y-axis is substantially equal to the angle between the contact surface 140 and the y-axis in the first embodiment. The base bottom surface 141 is continuous through a small round boundary with the choke forming surface 150. Under the initial setting state of FIG. 13, the base bottom surface 141 is substantially parallel to the contact surface 430 of cam ring 4.

A protrusion 142 is provided at a y-axis-positive (x-axis-negative) end of the base bottom surface 141 which is adjacent to the choke forming surface 150. The protrusion 142 is a convex portion formed to protrude or bulge from the base bottom surface 141 in an x-axis negative and y-axis negative direction. The protrusion 142 is formed over a z-axis directional entire range of the inner circumferential surface of housing body 1. The protrusion 142 is formed as a small circular-arc-shaped curve as viewed in the z-axis direction. In other words, the protruding portion 14 of housing body 1 in the fourth embodiment has a shape obtained by shaving off the contact surface 140 of protruding portion 14 of housing body 1 of the second embodiment (FIG. 11) down to a depth of the base bottom surface 141 except only the protrusion 142.

A vertex of the protrusion 142 abuts on (a region v adjacent to the boundary region V in) the contact surface 430 of cam ring 4. The protrusion 142 and the contact surface 430 are in contact with each other along a line extending in the z-axis direction. Thus, since the protruding portion 14 (protrusion 142) of housing body 1 is in line-contact with the contact portion 43*a* (contact surface 430) of cam ring 4, the swing of cam ring 4 in the direction that increases the eccentricity amount of cam ring 4 is restricted. Moreover, the control chamber R1 is fluid-tightly separated from the backpressure chamber R2 because the region v at which the contact surface 430 is in line-contact with the protrusion 142 functions as a boundary between the control chamber R1 and the backpressure chamber R2. That is, the contact portion 43*a* (contact surface 430) and the protruding portion 14 (protrusion 142) serves as the stopper portion and the sealing portion under the initial setting state.

Unlike the case of surface contact as the first embodiment, a surface pressure of the region undergoing the line contact, namely, a concentrated stress which is applied to (in the vicinity of the vertex of) the protrusion 142 and (the region v abutting on the protrusion 142 in) the contact surface 430 is relatively high. Accordingly, under the initial setting state, a contact surface pressure is increased so that the sealing performance can be improved. Particularly, since the housing body 1 (protrusion 142) is formed of aluminum-based metallic material, the housing body 1 is softer than the cam ring 4 (contact surface 430) formed of iron-based metallic material. Accordingly, when a high surface pressure is applied by the line contact at the time of contact at the stopper portion, (the vertex of) the protrusion 142 having a relatively low strength is deformed or crushed a little. Thereby, an error in dimensions or shape is absorbed so that a degree of adhesion of the both can be enhanced at the contact region. Therefore, the sealing performance of the stopper portion can be more improved. In other words, a processing accuracy as required in the case that the both contact surfaces are made in surface contact with each other is unnecessary in this fourth embodiment. Hence, the sealing performance can be ensured while reducing the processing cost as compared with the first embodiment.

Moreover, the protrusion 142 is provided on a side of base bottom surface 141 which is near the connecting portion between the stopper portion and the choking portion, i.e., at a part (y-axis positive end) of base bottom surface 141 which is near the connecting region between the base bottom surface 141 and the choke forming surface 150. Accordingly, when the cam ring 4 starts to swing to cause the contact surface 430 of cam ring 4 to become not in contact with the protrusion 142 of housing body 1; the change of the area of cam ring 4 which is receiving the control pressure is small, i.e., the area of the outer circumferential surface 401 of cam ring 4 which is facing the control chamber R1 has a small change. That is, as viewed in the z-axis direction, a range of contact surface 430 to which the fluid pressure of control chamber R1 is applied produces little difference between a moment before the swing start (a distance between the points U and v) and a moment after the swing start (a distance between the points U and V). Accordingly, when the cam ring 4 starts to swing, the change of moment Ma due to the control pressure is small. Hence, the cam ring 4 can smoothly start to swing. Since a rapid change of the pump capacity can be prevented, the pump VP can be operated stably.

(20) The contact surface (protrusion 142) becomes in contact with the outer circumferential surface (contact surface 430) of cam ring 4 by means of line contact along the axial direction of the cam ring 4.

Accordingly, the contact surface-pressure is high so that the sealing performance can be improved. Particularly, in the case that any one of the outer circumferential surface (contact surface 430) of cam ring 4 and the contact surface (protrusion 142) is made of a material softer than another of the outer circumferential surface (contact surface 430) of cam ring 4 and the contact surface (protrusion 142), the degree of adhesion therebetween is enhanced to improve the sealing performance.

Fifth Embodiment

In a pump VP according to a fifth embodiment, the protruding portion 14 of housing body 1 and the contact portion 43*a* of cam ring 4 are formed to become in line-contact with each other, in the similar manner as the fourth embodiment. Unlike the fourth embodiment, the protrusion is provided to the cam ring 4, not to the housing body 1. Since the other structures in the fifth embodiment are similar as the fourth embodiment, the explanations thereof will be omitted by giving reference signs same as the fourth embodiment to the corresponding structural parts.

Figure 14:
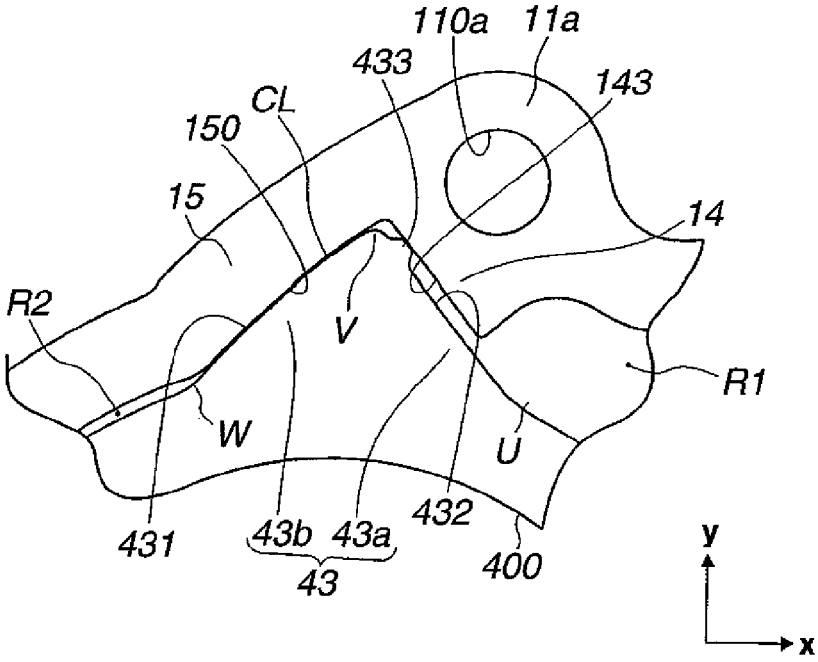
FIG. 14 is an enlarged view of the part in which the protruding portion of cam ring is received in a fifth embodiment according to the present invention (initial setting state).

FIG. 14 is an enlarged view of a part in which the protruding portion 43 of cam ring 4 is received in the fifth embodiment, under the initial setting state in the same manner as FIG. 7 of the first embodiment. A contact surface 143 of housing body 1 in the fifth embodiment is formed in the similar manner as the base bottom surface 141 of the fourth embodiment. The protruding portion 14 of housing body 1 in the fifth embodiment has a shape obtained by shaving off the protruding portion 14 (contact surface 140) of the second embodiment (FIG. 11) in parallel down to the depth of base bottom surface 141 of the fourth embodiment. The contact portion 43*a* of cam ring 4 includes a base bottom surface 432 and a protrusion 433. The base bottom surface 432 is a flat surface given in the similar manner as the contact surface 430 of the first embodiment, and is formed over a z-axis-directional entire range of cam ring 4 as an x-axis-positive side surface of the protruding portion 43. The boundary region V between the base bottom surface 432 and the choke forming surface 431 is formed with a round chamfering which is smaller than that of the first embodiment.

The protrusion 433 is provided at a y-axis-positive end of base bottom surface 432 which is adjacent to the choke forming surface 431. The protrusion 433 is a convex portion formed to protrude or bulge from the base bottom surface 432, and formed over a z-axis-directional entire range of the outer circumferential surface of cam ring 4. The protrusion 433 is formed as a small circular-arc-shaped curve as viewed in the z-axis direction. A vertex (top portion) of the protrusion 433 abuts on the contact surface 143 of housing body 1, specifically, abuts on a part of the contact surface 143 which is adjacent to a boundary between the contact surface 143 and the choke forming surface 150. The protrusion 433 and the contact surface 143 are in contact with each other along a line extending in the z-axis direction. By this line contact, the contact portion 43*a* (protrusion 433) and the protruding portion 14 (contact surface 143) serves as the stopper portion and the sealing portion under the initial setting state, in the same manner as the fourth embodiment.

Accordingly, in the same manner as the fourth embodiment, when a high surface pressure because of the line contact is applied at the time of contact of the stopper portion, the contact surface 143 having a strength lower than the protrusion 433 is deformed or crushed a little. Thereby, an error in dimensions or shape is absorbed so that the sealing performance can be enhanced at the contact region. Moreover, since the protrusion 433 is provided in a side of the base bottom surface 432 which is near the connecting portion between the stopper portion and the choking portion, the area receiving the control pressure is made to change to a small degree when the cam ring 4 starts to swing, in the same manner as the fourth embodiment. Therefore, the pump VP can be stably operated. That is, effects similar as the above-mentioned item (20) according to the fourth embodiment can be obtained.

Sixth Embodiment

In a pump VP according to a sixth embodiment, a protrusion is provided to the cam ring 4 and is formed to become in line-contact with the protruding portion 14 of housing body 1 in the same manner as the fifth embodiment. Unlike the fifth embodiment, a round chamfering (radius of curvature) of the protrusion is large. Since the other structures in the sixth embodiment are similar as the fifth embodiment, the explanations thereof will be omitted by giving reference signs same as the fifth embodiment to the corresponding structural parts.

Figure 15:
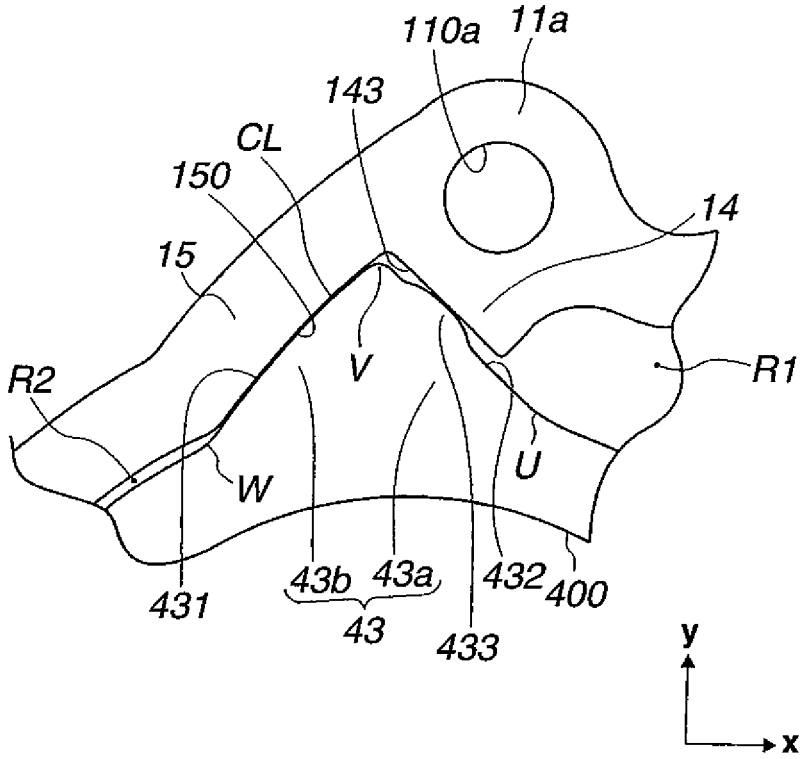
FIG. 15 is an enlarged view of the part in which the protruding portion of cam ring is received in a sixth embodiment according to the present invention (initial setting state).

FIG. 15 is an enlarged view of a part in which the protruding portion 43 of cam ring 4 is received in the sixth embodiment, under the initial setting state in the same manner as FIG. 7 of the first embodiment. The contact surface 143 of housing body 1 in the sixth embodiment is same as that of the fifth embodiment. The contact portion 43*a* of cam ring 4 includes the base bottom surface 432 and a protrusion 433. The boundary region V between the base bottom surface 432 and the choke forming surface 431 is formed with a round chamfering which is greater than that of the fifth embodiment.

The protrusion 433 is provided at a y-axis-positive region of the base bottom surface 432 which is adjacent to the choke forming surface 431. The protrusion 433 faces the contact surface 143 of housing body 1. A round chamfering (radius of curvature) of the protrusion 433 is larger than that of the fifth embodiment. The protrusion 433 is formed as a large circular-arc-shaped convex curve ranging over slightly less than a half of the base bottom surface 432, as viewed in the z-axis direction. A vertex of the protrusion 433 becomes in contact with (a substantially central portion of) the contact surface 143 of housing body 1. The protrusion 433 and the contact surface 143 are in contact with each other along a line extending in the z-axis direction.

In the same manner as the fifth embodiment, when a high surface pressure because of the line contact is applied at the time of contact of the stopper portion, the contact surface 143 having a strength lower than the protrusion 433 is deformed or crushed a little. Thereby, an error in dimensions or shape is absorbed. Under the state that the contact surface 143 has deformed a little so as to increase the degree of adhesion to the protrusion 433, strictly speaking, the protrusion 433 and the contact surface 143 abut on each other by means of surface contact having a little width, not by means of line contact. Accordingly, from a viewpoint of contact area, the structure of this embodiment is more advantageous than the case that the protrusion 433 and the contact surface 143 abut on each other by means of line contact as the fifth embodiment. Moreover, since the surface pressure in this embodiment is higher than the case that the contact surfaces 140 and 430 are in contact with each other by use of substantially whole areas of the surfaces 140 and 430 as in the first embodiment, the structure in this sixth embodiment is more advantageous than the first embodiment from the viewpoint of contact surface pressure. On the other hand, the surface pressure in this sixth embodiment is lower than the case that the line contact occurs over a narrow range as in the fifth embodiment. Hence in the sixth embodiment, it can be suppressed that the contact surface pressure is extremely enlarged. Therefore, the structure of the sixth embodiment has an advantage that the surface pressure can be set appropriately in accordance with each strength of the materials of housing body 1 and cam ring 4. The change of pressure-receiving area at the time of swing start of cam ring 4 is larger than that of the fifth embodiment, but is smaller than that of the first embodiment. Hence, the rapid change of pump capacity can be suppressed as compared with the first embodiment, so that the pump VP can be operated stably.

Seventh Embodiment

In a pump VP according to a seventh embodiment, the flow-passage cross-sectional area of the choking portion is reduced when the cam ring 4 swings. Since the other structures in the seventh embodiment are similar as the first embodiment, the explanations thereof will be omitted by giving reference signs same as the first embodiment to the corresponding structural parts.

Figure 16:
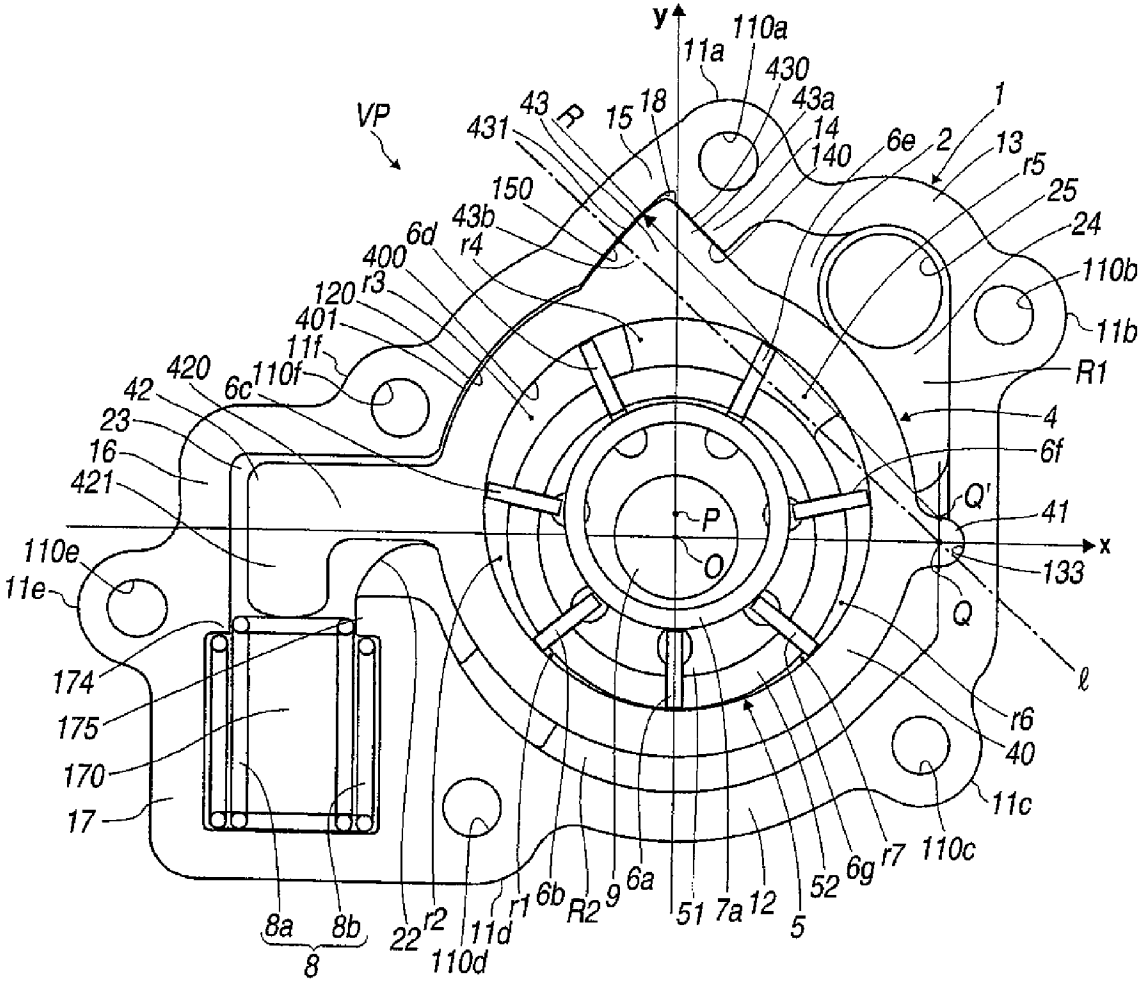
FIG. 16 is a front view of pump in a seventh embodiment according to the present invention (initial setting state).
Figure 17:
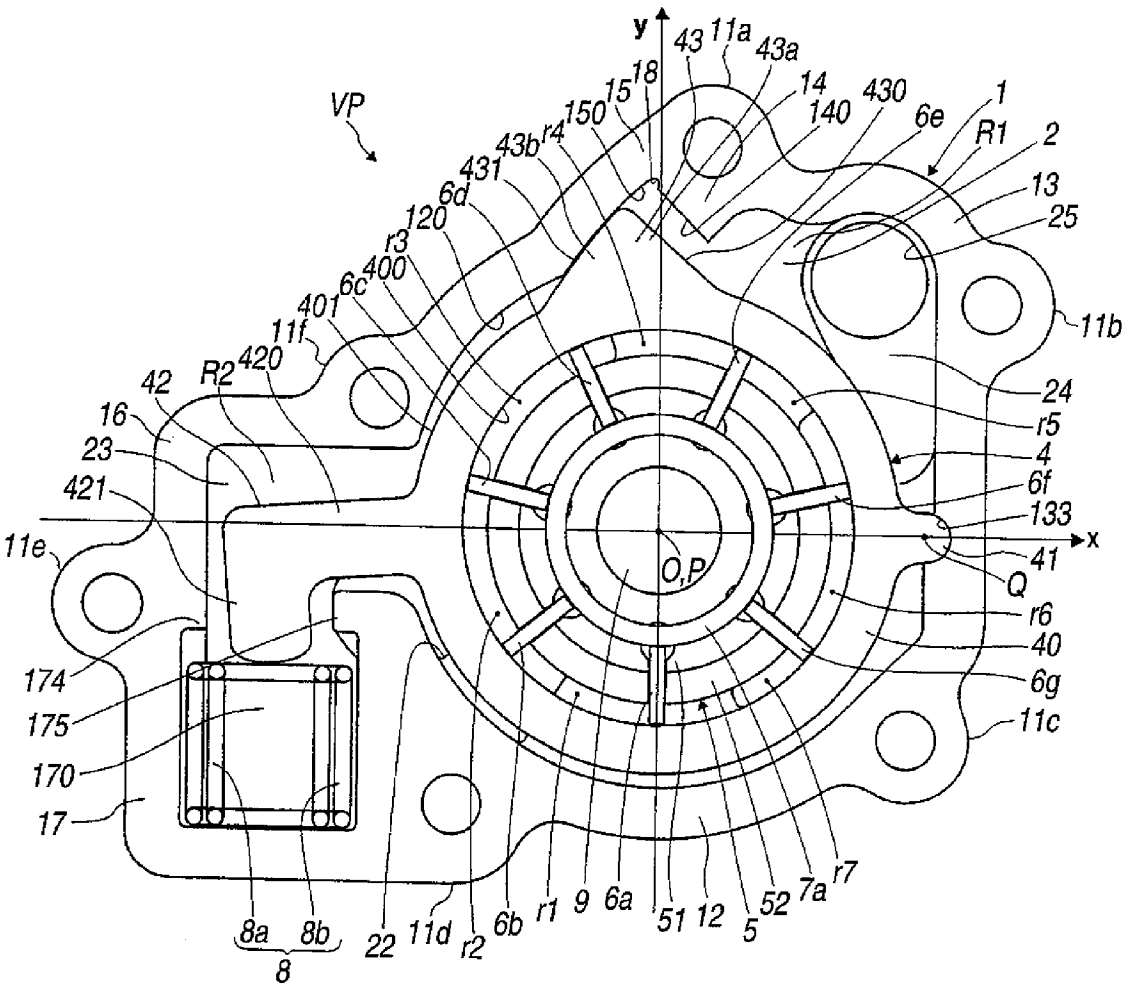
FIG. 17 is a front view of the pump in the seventh embodiment (minimum eccentricity state).
Figure 18:
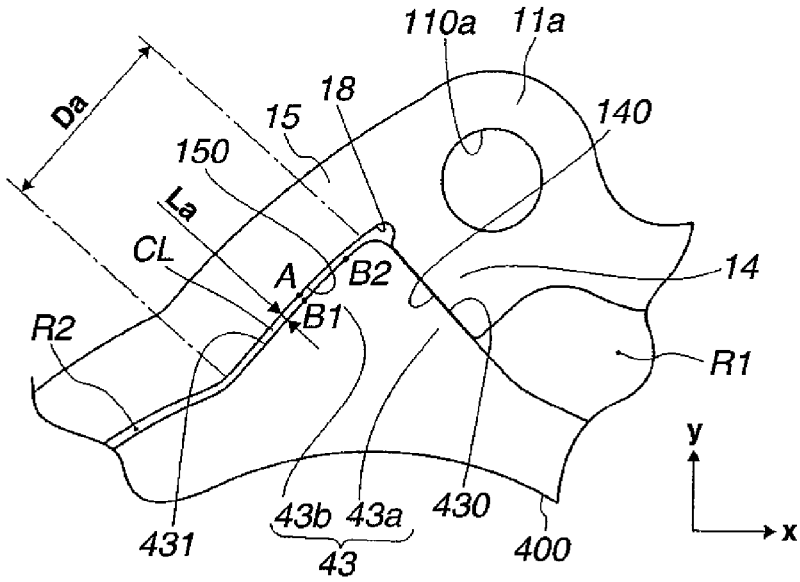
FIG. 18 is an enlarged view of the part in which the protruding portion of cam ring is received in the seventh embodiment (partial enlarged view of FIG. 16).
Figure 19:
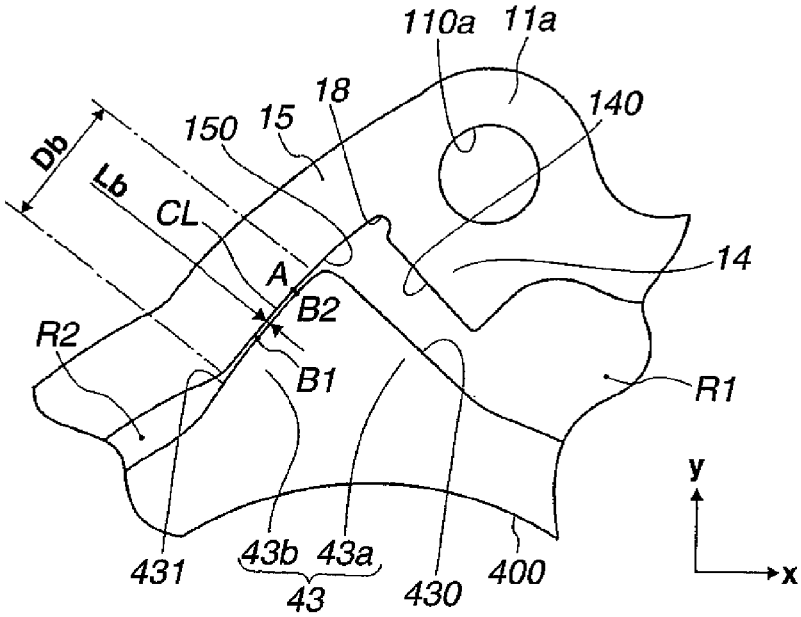
FIG. 19 is an enlarged view of the part in which the protruding portion of cam ring is received in the seventh embodiment (partial enlarged view of FIG. 17).

FIG. 16 is a front view of pump VP according to the seventh embodiment under a state that the front cover 3 has been detached, as viewed from the z-axis-positive side. FIG. 16 shows the initial setting state (maximum eccentricity state) in which the swing amount of cam ring 4 is at its minimum. FIG. 17 shows a state (minimum eccentricity state) in which the swing amount of cam ring 4 is at its maximum. FIGS. 18 and 19 show a part in which the protruding portion 43 of cam ring 4 is received by the housing body 1. FIG. 18 is an enlarged view of this part under the state of FIG. 16, and FIG. 19 is an enlarged view of this part under the state of FIG. 17.

The choke forming surface 150 of housing body 1 is a gentle circular-arc-shaped curve which uses a point Q' as its center, as viewed in the z-axis direction. The point Q' is located substantially at the same location as the swing fulcrum Q in the x-axis direction, and is offset (deviated) from the swing fulcrum Q by a predetermined distance in the y-axis positive direction. Moreover, the point Q' is located to overlap with an outer circumferential surface of the pivot portion 41 as viewed in the z-axis direction, namely accords with the outer circumferential surface of pivot portion 41 relative to y-axis-directional location. The choke forming surface 431 of cam ring 4 is a curve having the substantially same curvature (curvature radius) as the choke forming surface 150 of housing body 1. Under the initial setting position, as viewed in the z-axis direction, the choke forming surface 431 is formed in a gentle circular-arc shape which uses the point Q' as its center. The point Q' is located to be offset (deviated) from the imaginary straight line l in a direction opposite to the drive-shaft center O, namely is located on a far side of the imaginary straight line l relative to the drive-shaft center O. This imaginary straight line l is passing through the swing fulcrum Q and is substantially perpendicular to the choke forming surface 150 in the same manner as the first embodiment.

As shown in FIG. 18, under the initial setting state, the width (dimension in a direction substantially perpendicular to the surface 150) of the clearance CL between the choke forming surfaces 150 and 431 is set at a predetermined value La. This predetermined value La is substantially constant over an entire range of the choke forming surface 150, under the initial setting state. This predetermined value La is equal to the width L of clearance CL of the first embodiment. A point of the choke forming surface 431 of cam ring 4 which faces a given point "A" on the choke forming surface 150 of housing body 1 is a point B1 under the initial setting state, and then is a point B2 under the minimum eccentricity state. Since the point Q' is offset from the imaginary straight line l in the direction opposite to the center O as mentioned above, a distance between the point Q and the point B2 is longer slightly by a predetermined amount than a distance between the point Q and the point B1. Accordingly, when viewed at the point "A", a width Lb (distance between the point "A" and the point B2) of the clearance CL under the minimum eccentricity state shown in FIG. 19 is shorter than the width La (distance between the point "A" and the point B1) of the clearance CL under the initial setting state shown in FIG. 18 by an amount corresponding to the above-mentioned predetermined amount.

Thus, when the cam ring 4 swings about the swing fulcrum Q, the choke forming surface 431 of cam ring 4 is deviated from the swing path (circular-arc regarding the fulcrum Q as its center) of cam ring 4 so as to move toward the choke forming surface 150. Thereby, the width of clearance CL is gradually reduced from the value La to the value Lb. In other words, the flow-passage cross-sectional area (cross-sectional area of the clearance CL) of working oil in the choking portion is gradually reduced from a value La×H to a value Lb×H as the cam ring 4 swings. On the other hand, the flow-passage length of the choking portion is shortened gradually from the value Da to the value Db as the cam ring 4 swings. Therefore, it is suppressed that the resistance of the choking portion which is proportional to the flow-passage length and is inversely proportional to the flow-passage cross-sectional area is changed when the cam ring 4 swings.

In the seventh embodiment, in consideration of the flow-passage length and the leakage amount in the choking portion, the flow-passage cross-sectional area of the choking portion is designed to be reduced when the cam ring 4 is swinging. The resistance as the choking portion is made to be less varied than the first embodiment (in which the width of clearance CL is maintained at the value L so that the flow-passage cross-sectional area is maintained at the value L×H even if the cam ring 4 swings). Thereby, working-oil amount which leaks through the choking portion into the backpressure chamber R2 is limited to cause the leakage working-oil amount to become substantially constant when the cam ring 4 swings. Therefore, a moment of force which occurs (in a range between the choke forming portion 43*b* and the arm portion 42 of cam ring 4) due to the leakage working oil and which is applied to the cam ring 4 to swing the cam ring 4 becomes substantially constant. Accordingly, the cam ring 4 can be operated more reliably as planned in design. Moreover, a more stable sealing performance than the first embodiment can be obtained in the choking portion. Therefore, the leakage amount is more suppressed, and the efficiency of pump VP can be enhanced.

(21) The choking portion (clearance CL given between the choke forming surfaces 150 and 431) is formed to reduce its flow-passage cross-sectional area when the cam ring 4 swings.

Accordingly, the movement of the cam ring 4 and the sealing performance of the choking portion can be more stabilized. Moreover, the efficiency of pump VP can be enhanced.

Eighth Embodiment

Figure 20:
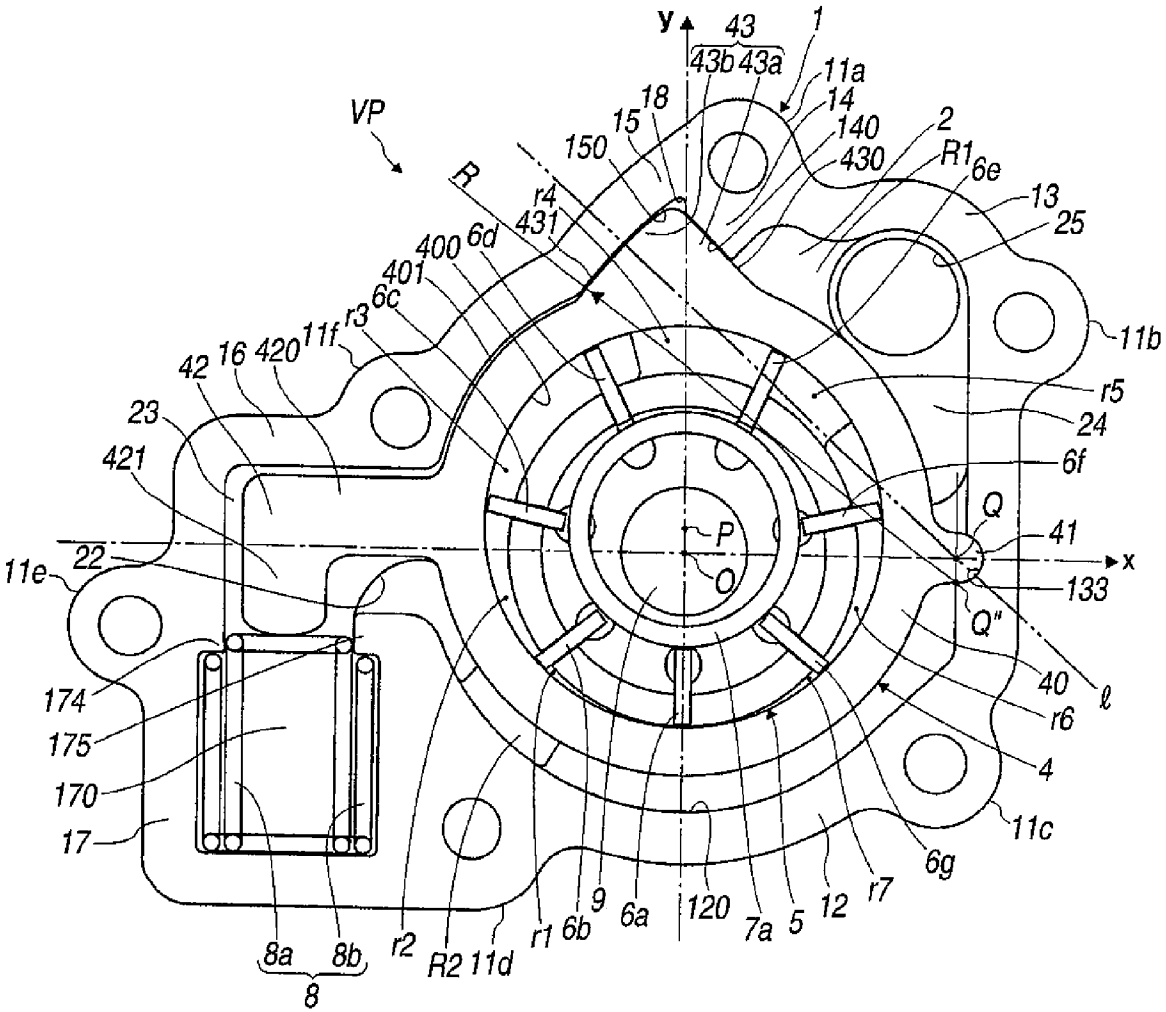
FIG. 20 is a front view of pump in an eighth embodiment according to the present invention (initial setting state).
Figure 21:
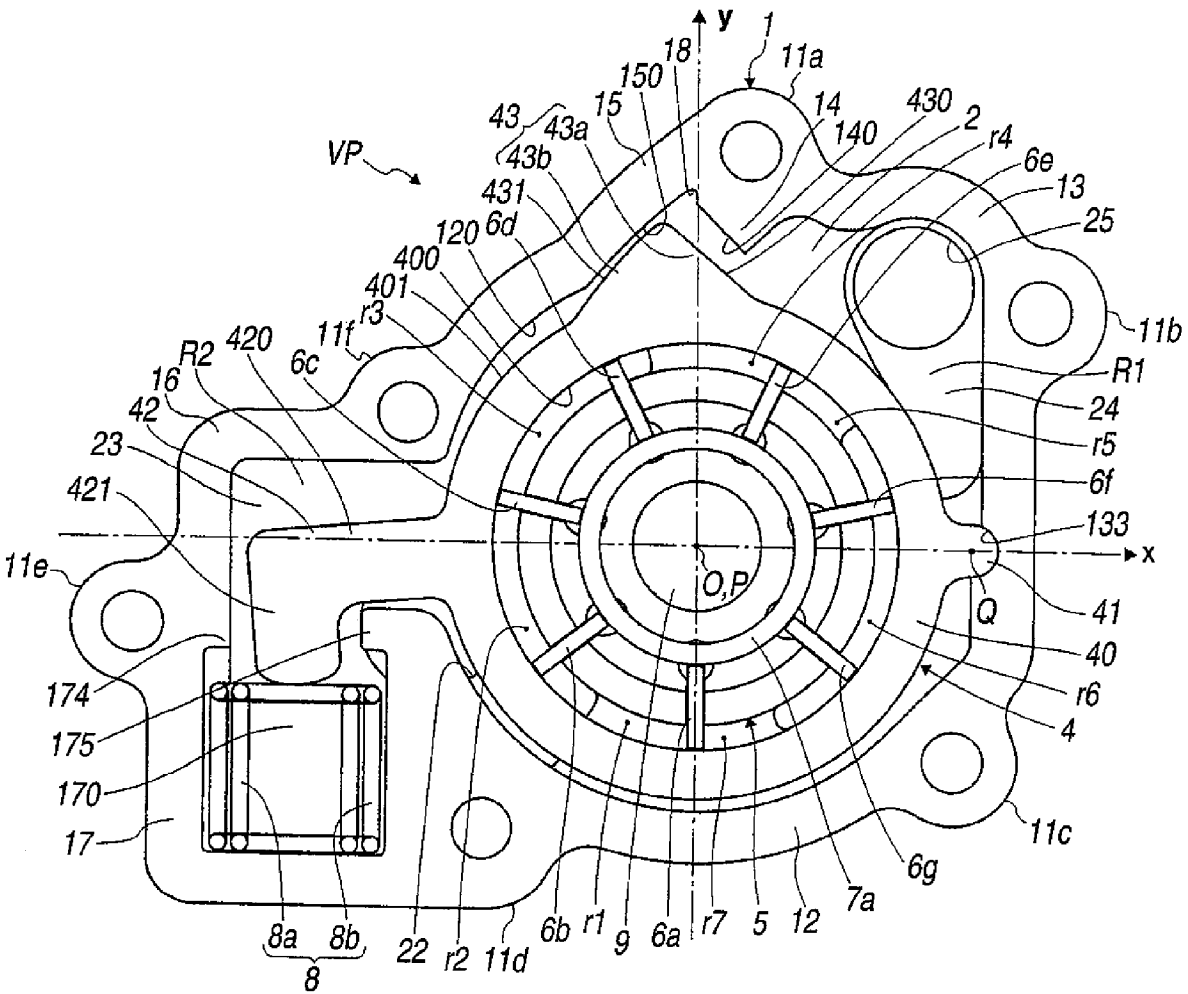
FIG. 21 is a front view of the pump in the eighth embodiment (minimum eccentricity state).
Figure 22:
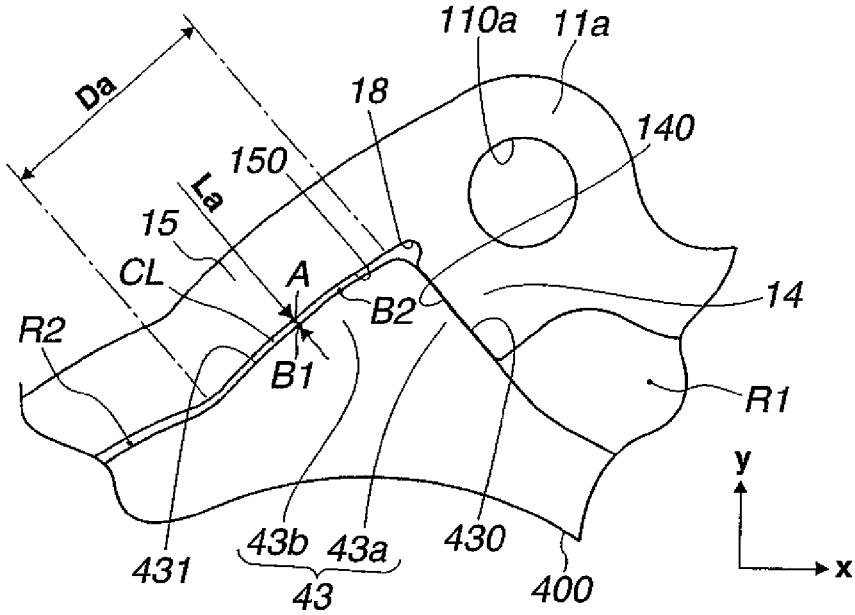
FIG. 22 is an enlarged view of the part in which the protruding portion of cam ring is received in the eighth embodiment (partial enlarged view of FIG. 20).
Figure 23:
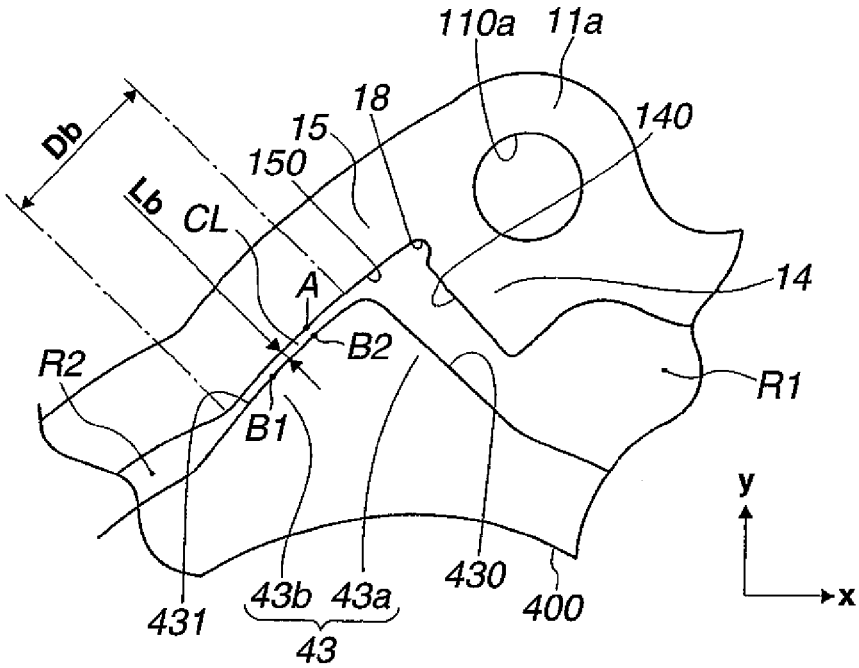
FIG. 23 is an enlarged view of the part in which the protruding portion of cam ring is received in the eighth embodiment (partial enlarged view of FIG. 21).

In a pump VP according to an eighth embodiment, contrary to the seventh embodiment, the flow-passage cross-sectional area of the choking portion is increased when the cam ring 4 swings. Since the other structures in the eighth embodiment are similar as the first embodiment, the explanations thereof will be omitted by giving reference signs same as the first embodiment to the corresponding structural parts. FIGS. 20 and 21 are front views of pump VP according to the eighth embodiment under a state that the front cover 3 has been detached, as viewed from the z-axis-positive side. FIG. 20 shows the initial setting state (maximum eccentricity state), and FIG. 21 shows the minimum eccentricity state. FIG. 22 is a partial enlarged view of FIG. 20, and FIG. 23 is a partial enlarged view of FIG. 21.

The choke forming surface 150 of housing body 1 is a gentle circular-arc-shaped curve which uses a point Q" as its center, as viewed in the z-axis direction. The point Q" is located substantially at the same location as the swing fulcrum Q in the x-axis direction, and is offset (deviated) from the swing fulcrum Q by a predetermined distance in the y-axis negative direction. Moreover, the point Q" is located to overlap with the outer circumferential surface of the pivot portion 41 as viewed in the z-axis direction, namely accords with the outer circumferential surface of pivot portion 41 relative to y-axis-directional location. The choke forming surface 431 of cam ring 4 is a curve having the substantially same curvature (curvature radius) as the choke forming surface 150 of housing body 1. Under the initial setting position, as viewed in the z-axis direction, the choke forming surface 431 is formed in a gentle circular-arc shape which uses the point Q" as its center. The point Q" is located to be offset (deviated) from the imaginary straight line l in a direction toward the drive-shaft center O, namely is located on a near side of the imaginary straight line l relative to the drive-shaft center O. This imaginary straight line l is passing through the swing fulcrum Q and is substantially perpendicular to the choke forming surface 150 in the same manner as the first embodiment.

As shown in FIG. 22, under the initial setting state, the width (dimension in a direction substantially perpendicular to the surface 150) of the clearance CL between the choke forming surfaces 150 and 431 is set at a predetermined value La. This predetermined value La is substantially constant over an entire range of the choke forming surface 150 under the initial setting state. This predetermined value La is smaller than the width L of clearance CL of the first embodiment. A point of the choke forming surface 431 of cam ring 4 which faces a given point "A" on the choke forming surface 150 of housing body 1 is a point B1 under the initial setting state, and then is a point B2 under the minimum eccentricity state. Since the point Q" is offset from the imaginary straight line l in the direction toward the center O as mentioned above, a distance between the point Q and the point B2 is slightly shorter by a predetermined amount than a distance between the point Q and the point B1. Accordingly, when viewed at the point "A", a width Lb (distance between the point "A" and the point B2) of the clearance CL under the minimum eccentricity state shown in FIG. 23 is larger than the width La (distance between the point "A" and the point B1) of the clearance CL under the initial setting state shown in FIG. 22 by an amount corresponding to the above-mentioned predetermined amount.

Thus, when the cam ring 4 swings about the swing fulcrum Q, the choke forming surface 431 of cam ring 4 is deviated from the swing path (circular-arc regarding the fulcrum Q as its center) of cam ring 4 so as to move away from the choke forming surface 150. Thereby, the width of clearance CL is gradually increased from the value La to the value Lb. In other words, the flow-passage cross-sectional area (cross-sectional area of the clearance CL) of working oil in the choking portion is gradually increased from a value La×H to a value Lb×H as the cam ring 4 swings. On the other hand, the flow-passage length of the choking portion is shortened gradually from the value Da to the value Db as the cam ring 4 swings. Therefore, the resistance of the choking portion which is proportional to the flow-passage length and which is inversely proportional to the flow-passage cross-sectional area is reduced to a large degree as the cam ring 4 swings.

In the eighth embodiment, in consideration of the flow-passage length and leakage amount of the choking portion, the resistance as the choking portion is made to be varied to a lager degree than the first embodiment (in which the width of clearance CL is maintained at the value L so that the flow-passage cross-sectional area is maintained at the value L×H even if the cam ring 4 swings). That is, the flow-passage cross-sectional area of the choking portion is designed to be smaller than the first embodiment at the time of swing start of cam ring 4, and then to be enlarged at higher speed in response to the swing of cam ring 4. Thereby, the flow-passage cross-sectional area becomes larger than that of the first embodiment when the cam ring 4 has swung beyond a predetermined swing amount. Hence, the working oil amount which leaks through the choking portion into the backpressure chamber R2 is varied from a small amount to a large amount with a high variation rate thereof, as the cam ring 4 swings. Moreover, a moment of force which occurs (in a range between the choke forming portion 43*b* and the arm portion 42 of cam ring 4) due to the leakage working oil and which is applied to the cam ring 4 to swing the cam ring 4 increases from a small value to a large value with a high variation rate thereof.

Figure 24:
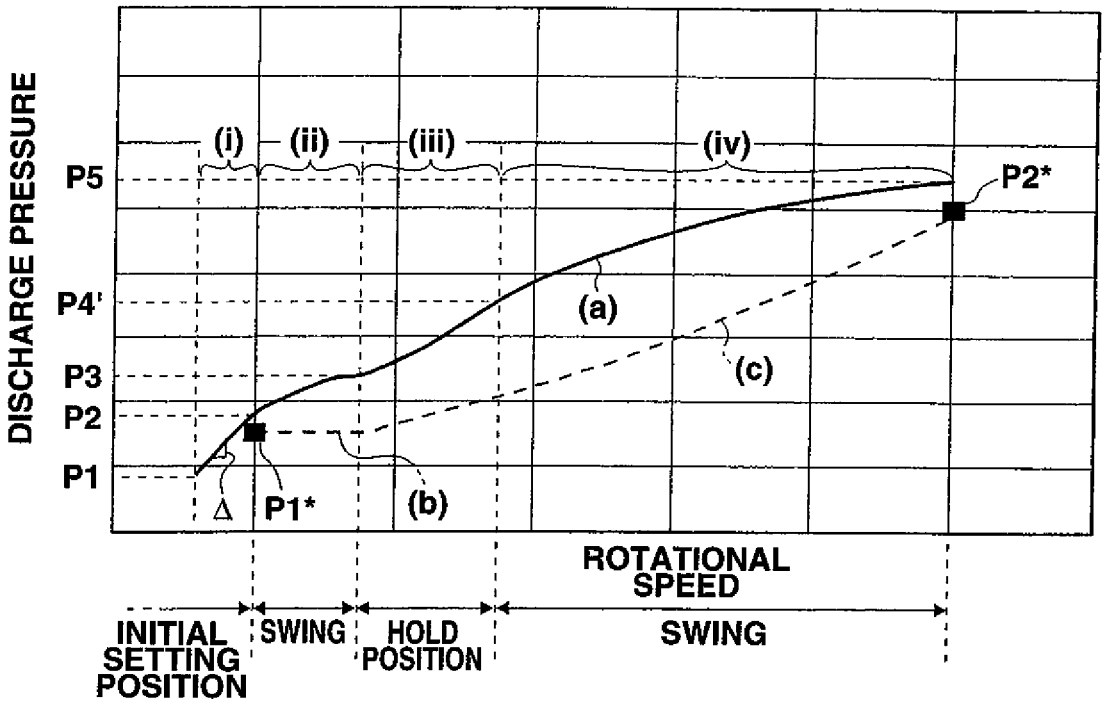
FIG. 24 is a graph showing a hydraulic characteristic of the pump in the eighth embodiment.

Accordingly, the pump VP according to the eighth embodiment obtains a hydraulic characteristic (a) as shown in FIG. 24. A characteristic during the rotational-speed region (i) is similar as the first embodiment (FIG. 10). Since the width La of clearance CL is set to be smaller than the width L of the first embodiment, the leakage amount from the choking portion is small during the region (ii) which is at a beginning of the swing. Hence, the discharge pressure rises more rapidly than the first embodiment with respect to the increase of rotational speed. Thereby, a rotational-speed range of the region (ii) is narrower than the first embodiment. During the region (iii) corresponding to the hold position, the leakage amount from the choking portion is larger than the first embodiment, and hence, the moment of force functioning to swing the cam ring 4 is larger than the first embodiment. Thereby, from a stage where the discharge pressure is lower (from a time point when the moment Ma caused by the control pressure is smaller) than that of the first embodiment, a moment of force caused by the leakage is additionally applied in the direction that swings the cam ring 4 so as to assist the moment Ma caused by the control pressure. Accordingly, the second coil spring 8*b* is compressed to restart the swing at a timing when the rotational speed is smaller than that of the first embodiment. Hence, a rotational-speed range of the region (iii) is narrower than the first embodiment, and a rotational-speed range of the region (iv) which is a late stage of the swing is broader than the first embodiment.

Thus, in the eighth embodiment, by using the double coil spring 8 (8*a* and 8*b*) identical with that of the first embodiment, a pump characteristic different from the first embodiment can be obtained. That is, a hydraulic characteristic can be obtained which is similar as a case of using a special nonlinear spring capable of varying its constant of spring relative to the swing angle of cam ring 4. Therefore, even if a desired characteristic to the pump VP is changed, this desire can be satisfied flexibly by properly adjusting a magnitude of the clearance CL (leakage amount). Moreover, because the leakage amount is increased in accordance with the increase of rotational speed, it can be suppressed that the pressure (discharge pressure) of the control chamber R1 excessively rises.

(22) The choking portion (clearance CL given between the choke forming surfaces 150 and 431) is formed to enlarge its flow-passage cross-sectional area when the cam ring 4 swings.

Accordingly, a desired hydraulic characteristic can be realized, and thereby, various requests of the pump VP can be flexibly satisfied.

Ninth Embodiment

In a pump VP according to a ninth embodiment, unlike the first embodiment, the stopper portion is provided at the arm portion 42 of cam ring 4. Since the other structures in the ninth embodiment are similar as the first embodiment, the explanations thereof will be omitted by giving reference signs same as the first embodiment to the corresponding structural parts.

Figure 25:
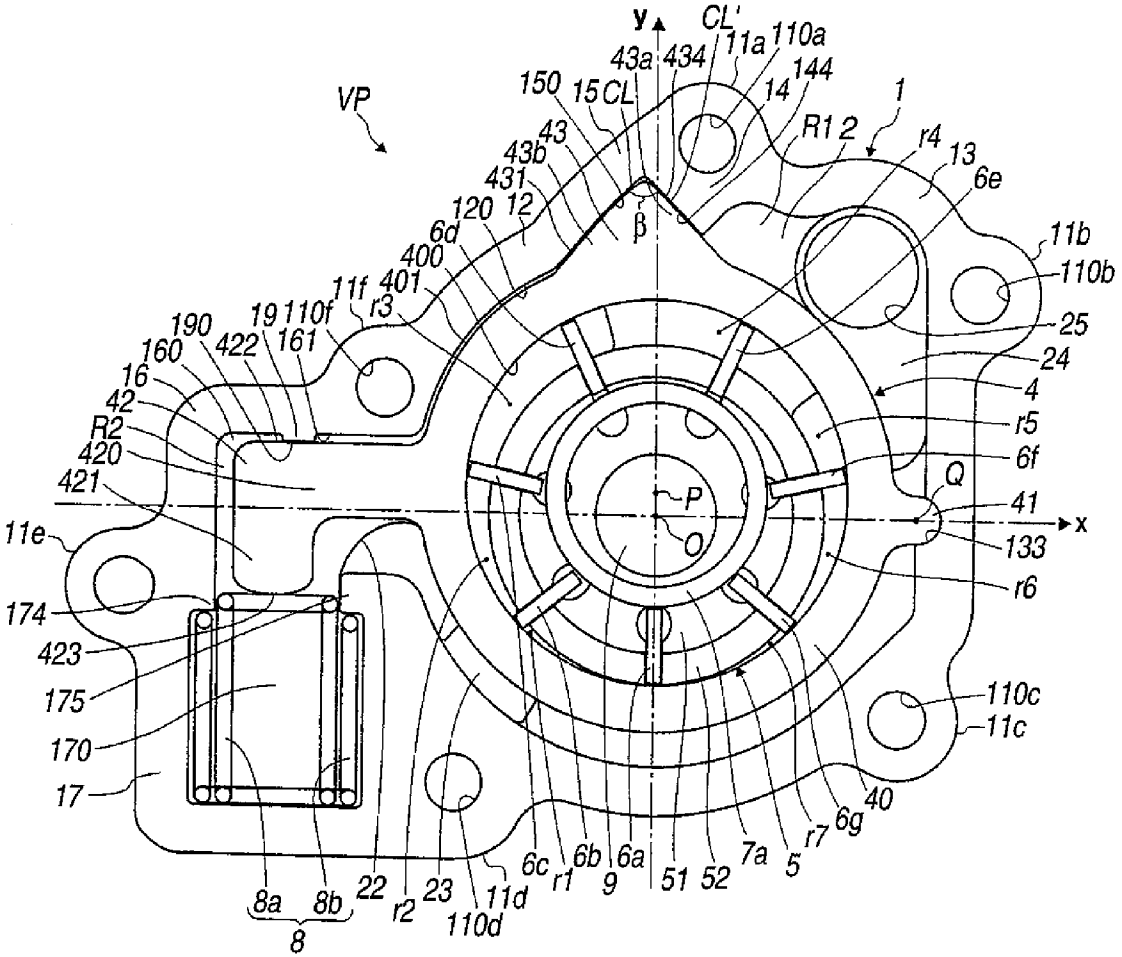
FIG. 25 is a front view of pump in a ninth embodiment according to the present invention (initial setting state).
Figure 26:
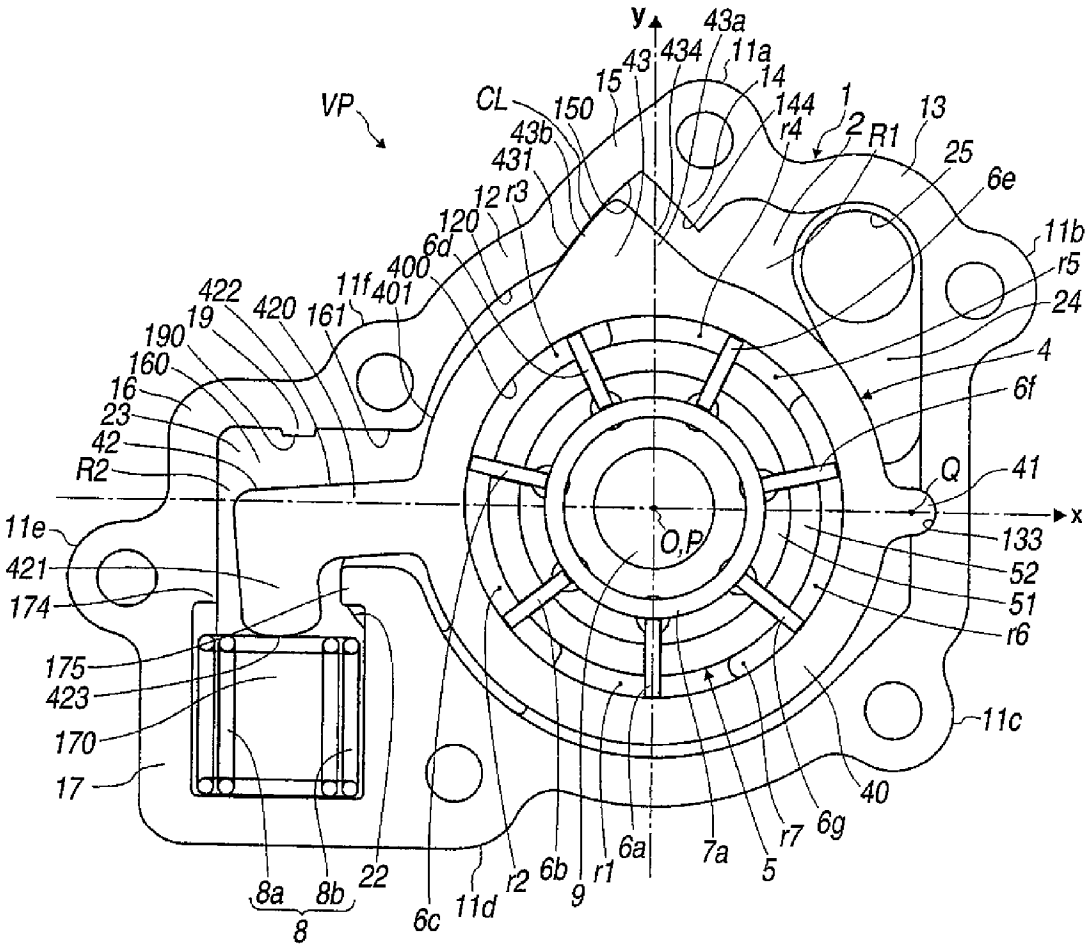
FIG. 26 is a front view of pump in the ninth embodiment (minimum eccentricity state).

FIGS. 25 and 26 are front views of pump VP according to the ninth embodiment under a state that the front cover 3 has been detached, as viewed from the z-axis-positive side. FIG. 25 shows the initial setting state (maximum eccentricity state), and FIG. 26 shows the minimum eccentricity state.

In the ninth embodiment, a choke forming surface 144 is formed in the x-axis negative side of the protruding portion 14 of housing body 1. The choke forming surface 144 is formed over a z-axis-directional entire range of the inner circumferential surface of housing body 1, and is a flat surface facing in x-axis negative and y-axis negative direction. The choke forming surface 144 has a flat-surface shape obtained by shaving off the protruding portion 14 parallel to the contact surface 140 of the first embodiment (see FIG. 2) from the contact surface 140 down to a predetermined depth. An angle between the choke forming surface 144 and the y-axis is substantially equal to the above-mentioned angle (α) of the contact surface 140. The choke forming surface 144 is connected through a small round boundary with the choke forming surface 150 of choke forming portion 15. That is, the protruding portion 14 includes the first choke forming surface 144, and the choke forming portion 15 includes the second choke forming surface 150. In this ninth embodiment, the notched groove 18 as provided in the first embodiment is not formed in the surface 144.

In the ninth embodiment, the protruding portion 43 of cam ring 4 includes a choke forming portion 43*a* in an x-axis positive side of the protruding portion 43. The choke forming portion 43*a* is formed in the same manner as the contact portion 43*a* of the first embodiment. The choke forming portion 43*a* includes a choke forming surface 434. The choke forming surface 434 is formed in the same manner as the contact surface 430 of the first embodiment. That is, the first choke forming portion 43*a* (first choke forming surface 434) is provided in a side of (the protruding portion 43 of) the cam ring 4 which is closer to the swing fulcrum Q, and the second choke forming portion 43*b* (second choke forming surface 431) is provided in a side of (the protruding portion 43 of) the cam ring 4 which is relatively distant from the swing fulcrum Q.

The inner circumferential surface 161 located in the y-axis positive side of the arm receiving portion 16 of housing body 1 is formed with a contact portion 19. The contact portion 19 protrudes in the y-axis negative direction, namely, toward an inside of the arm-portion receiving chamber 160. The contact portion 19 is formed over a z-axis-directional entire range of the housing body 1 (arm receiving portion 16). A contact surface 190 is formed at a y-axis negative end of the contact portion 19. The contact surface 190 is a flat surface approximately parallel to the x-axis, and is located away from the surface 161 in the y-axis negative direction by a predetermined distance. The contact surface 190 has a predetermined width in the x-axis direction.

The contact surface 190 of contact portion 19 faces the y-axis positive-side surface 422 of the arm body 420 of cam ring 4. Under the initial setting state shown in FIG. 25, the contact surface 190 is in surface-contact with the y-axis positive-side surface 422 over a z-axis-directional entire range of the surface 422. Thus, under the initial setting state, the contact portion 19 abuts on the arm body 420 so that the swing of cam ring 4 in the direction that increases the eccentricity amount is restricted or limited. That is, the contact portion 19 and the arm body 420 function as the stopper portion.

Under the initial setting state where the swing of cam ring 4 has been restricted by the stopper portion; the choke forming surface 144 of housing body 1 is substantially parallel to the choke forming surface 434 of cam ring 4, and a slight clearance CL' is provided between the both choke forming surfaces 144 and 434 facing each other. Since a width of this clearance CL' is sufficiently narrow, working-oil amount flowing through the clearance CL' is limited. Moreover, the choke forming surfaces 150 and 431 adjacent to the both choke forming surfaces 144 and 434 limit the flow of working oil by giving the clearance CL between the choke forming surfaces 150 and 431, in the same manner as the first embodiment. Accordingly, under the initial setting state; (the clearance CL' formed by) the protruding portion 14 (first choke forming surface 144) of housing body 1 and the first choke forming portion 43*a* of cam ring 4 function as a first choking portion (first sealing portion), and (the clearance CL formed by) the choke forming portion 15 (the second choke forming surface 150) of housing body 1 and the second choke forming portion 43*b* of cam ring 4 function as a second choking portion (second sealing portion).

Under the initial setting state, the flow of working oil between the control chamber R1 and the backpressure chamber R2 is limited at a boundary produced by the first and second choking portions. The both chambers R1 and R2 are fluid-tightly separated from each other by these choking functions. That is, the control chamber R1 is separately formed by means of the first and second choking portions and the swing fulcrum Q of cam ring 4 (the pivot portion 41 and pivot setting portion 133) radially outside the cam ring 4.

On the other hand, when the can ring 4 is swinging against the biasing force of biasing member 8, the both choke forming surfaces 144 and 434 depart from each other to broaden the clearance CL' in the first choking portion. Hence, the flow of working oil becomes not limited. In this state, in the same manner as the first embodiment, only the second choking portion functions as the choking portion (sealing portion). Accordingly, the control chamber R1 becomes separated by means of the second choking portion and the swing fulcrum Q of cam ring 4 (the pivot portion 41 and pivot setting portion 133), radially outside the cam ring 4.

In other words, under the initial setting state under which the swing of cam ring 4 has been stopped by the stopper portion (contact portion 19), the first choking portion is configured to cause the choke forming surface 144 of housing body 1 to face the outer circumferential surface 401 (first choke forming surface 434) of cam ring 4. On the other hand, the second choking portion is constituted between the second choke forming surface 150 of the housing body 1 and the outer circumferential surface 401 (second choke forming surface 431) of cam ring 4 irrespective of the swing state of cam ring 4.

Thus, in the ninth embodiment, under the initial setting state, the control chamber R1 is not separately formed by the contact at the stopper portion as in the first embodiment, but is separately formed by the choking at the first and second choking portions. By providing the two choking portions in the ninth embodiment, a flow passage between the control chamber R1 and the back-pressure chamber R2 is made long. Moreover, the first and second choking portions are arranged to form the angle β between the first and second choking portions, so that a direction of the flow passage changes at a boundary between the first and second choking portions (boundary portion between the first choke forming surface 434 and the second choke forming surface 431). Thus, since a length of the choking flow passage is made long and this choking flow passage is made to bend in midcourse, a collective resistance of the choking portions is large as a whole. Therefore, the sealing performance of control chamber R1 is improved without separating the control chamber R1 by a contact of two members.

The first choking portion is smaller in area (square measure) than the second choking portion. Specifically, under the initial setting state, a facing area between the both choke forming surfaces 150 and 431 in the second choking portion is approximately equal to Da×H (see FIG. 7). The value Da is set greater than a circumferential length of the first choking portion (first choke forming surface 144) in the circumferential direction of cam ring 4 (as viewed in the z-axis direction). Accordingly, under the initial setting state shown in FIG. 25, the facing area Da×H of the second choking portion is larger than a facing area of the both choke forming surfaces 144 and 434 of the first choking portion. Therefore, at the time of swing of the can ring 4, the flow passage length of the second choking portion is sufficiently secured so that the sealing performance of control chamber R1 can be properly secured in the second choking portion. Moreover, since the area (circumferential length) of the first choking portion is relatively short, the pump VP can be downsized.

Moreover, since the stopper portion (contact portion 19) is provided on a part of the arm portion 42 which is more distant from the swing fulcrum Q than the protruding portion 14 and the protruding portion 43, a force which is applied to the stopper portion at the time of restriction (stop) of the swing is reduced so that a surface pressure of the contact portion 19 is reduced. Therefore, the structure of the stopper portion can be simplified by downsizing the contact portion 19. Moreover, since the stopper portion (contact portion 19) does not need to have a sealing function for separating the control chamber R1, the contact portion 19 does not need to be formed over the z-axis directional entire range of the housing body 1. Hence, the structure of stopper portion can be further simplified by downsizing the contact portion 19.

(23) The pump VP includes: the stopper portion (contact portion 19) configured to restrict the swing of cam ring 4 in a direction that increases the eccentricity between the rotation center O of rotor 5 and the center P of the inner circumferential surface 400 of cam ring 4; the first choking portion (first choke forming surface 144) configured to face the outer circumferential surface (first choke forming surface 434) of cam ring 4 under the state where the swing of the cam ring 4 is stopped by the stopper portion; the second choking portion (second choke forming surface 150) configured to face the outer circumferential surface (second choke forming surface 431) of cam ring 4 irrespective of the swing state of the cam ring 4; and the control chamber R1. The control chamber R1 is separately formed on the outer circumference of cam ring 4 by the first choking portion, the second choking portion and the swing fulcrum Q of cam ring 4 under the state where the swing of the cam ring 4 is stopped by the stopper portion. On the other hand, the control chamber R1 is separately formed on the outer circumference of cam ring 4 by the second choking portion and the swing fulcrum Q of the cam ring 4 under the state where the cam ring 4 is swinging against the biasing force of the biasing member 8. The control chamber R1 is configured to cause the cam ring 4 to swing against the biasing force of the biasing member 8 by a pressure introduced from the discharge portion to the control chamber R1.

That is, in the first embodiment, the stopper portion and the choking portion are arranged adjacent to each other. However, according to the present invention, this adjacent arrangement is not indispensable, and therefore, the stopper portion and the choking portion may be arranged away from each other as in the ninth embodiment. Also in the ninth embodiment, advantageous effects similar as the first embodiment can be obtained, for example, an additional sealing member is not necessary. Moreover, in the ninth embodiment, since the choking flow passage is elongated by providing the plurality of choking portions, the flow-passage resistance becomes large. Thereby, the sealing performance of the control chamber R1 can be enhanced in the initial setting state where the swing of cam ring 4 has been restricted or stopped.

(24) The facing area of the first choking portion is smaller than the facing area of the second choking portion.

Accordingly, a downsizing of the pump VP can be achieved by reducing in size the first choking portion, and also, the sealing performance can be ensured by the second choking portion when the cam ring 4 is swinging.

Tenth Embodiment

In a pump VP according to a tenth embodiment, the bearing oil-feeding groove 26 (lateral groove 26*a*) extends in the radial direction of rotor 5 in a straight-line shape, and a groove width of the bearing oil-feeding groove 26 is smaller than the width of vane 6. Since the other structures in the tenth embodiment are similar as the first embodiment, the explanations thereof will be omitted by giving reference signs same as the first embodiment to the corresponding structural parts.

Figure 27:
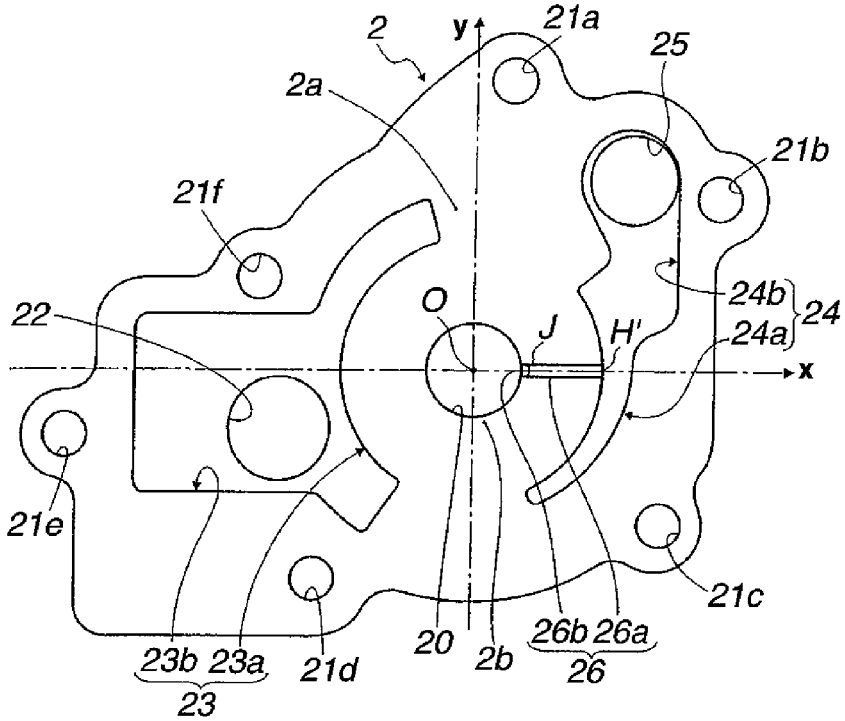
FIG. 27 is a front view of rear cover in a tenth embodiment according to the present invention.

FIG. 27 is a front view of the rear cover 2 according to the tenth embodiment as viewed from the positive side of z-axis. The bearing oil-feeding groove 26 includes a lateral groove 26*a* and a longitudinal or axial groove 26*b*. The lateral groove 26*a* is formed linearly on the x-axis. The lateral groove 26*a* extends from an end portion H' communicated with the falcate-shaped groove 24*a*, to the end portion 3 in the radial direction (in the x-axis negative direction) of drive shaft 9. Then, the lateral groove 26*a* is communicated with the longitudinal groove 26*b*. As viewed in the z-axis direction, the groove width of lateral groove 26*a* (a width perpendicular to an extending direction of lateral groove 26*a*) is smaller than the width of vane 6 (a width perpendicular to the extending direction of vane 6 in the x-y plane). That is, the groove width of lateral groove 26*a* is designed to be narrower than a thickness of one lateral surface (z-axis negative-side surface) of vane 6 which slides in contact with the rear cover 2. A structure of the longitudinal groove 26*b* is formed in the same manner as the first embodiment.

Since the width of lateral groove 26*a* is formed to be narrower than the width (thickness) of the vane 6, at least a part of the vane 6 is deviated from (does not overlap with) the bearing oil-feeding groove 26 as viewed in the z-axis direction, when the vane 6 has rotated and moved up to its position overlapping with the bearing oil-feeding groove 26 while rising and falling from and into the rotor 5. That is, when the lateral groove 26*a* overlaps with the vane 6 as viewed in the z-axis direction; a width-directional (thickness-directional) end portion of vane 6 is out of (does not overlap with) the lateral groove 26*a*, and is located on a part (near the lateral groove 26*a*) of the surface 2*a* of rear cover 2. Accordingly, the vane 6 is prevented from dropping or sinking into the bearing oil-feeding groove 26 (the lateral groove 26*a*) so that the effects similar as the first embodiment can be obtained.

Moreover in the tenth embodiment, since the lateral groove 26*a* extending in the radial direction of rotor 5 is formed, there is an advantage related to a tapering (draft angle) when the rear cover 2 is molded by aluminum die casting (metallic mold). Especially, the removal from the die becomes easy by molding the longitudinal groove 26*b* concurrently with the lateral groove 26*a*. Moreover, since the lateral groove 26*a* is provided in the radial direction of rotor 5, the length of lateral groove 26*a* can be shortened to its minimum so that working oil can be supplied to the bearing hole 20 more smoothly. Moreover, since the lateral groove 26*a* is formed in a straight-line shape covering an entire range between the falcate-shaped groove 24*a* and the longitudinal groove 26*b*, the molding of the lateral groove 26*a* is easier than the first embodiment.

Eleventh Embodiment

In a pump VP according to an eleventh embodiment, the bearing oil-feeding groove 26 (lateral groove 26*a*) includes a portion (a first groove 265) inclined toward the rotational direction of drive shaft 9. Since the other structures in the eleventh embodiment are similar as the first embodiment, the explanations thereof will be omitted by giving reference signs same as the first embodiment to the corresponding structural parts.

Figure 28:
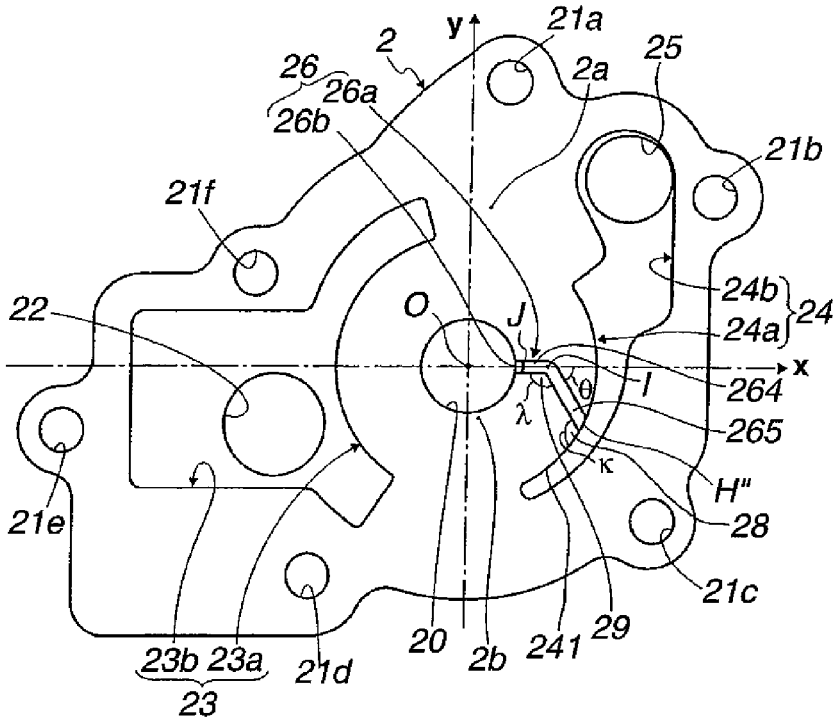
FIG. 28 is a front view of rear cover in an eleventh embodiment according to the present invention.

FIG. 28 is a front view of the rear cover 2 according to the eleventh embodiment as viewed from the positive side of z-axis. The bearing oil-feeding groove 26 includes a lateral groove 26*a* and a longitudinal or axial groove 26*b*. The lateral groove 26*a* is bent and formed in a dogleg shape as viewed in the z-axis direction. The lateral groove 26*a* includes the first groove 265 and a second groove 264. The first groove 265 linearly extends from an end portion H" communicated with the y-axis negative side of falcate-shaped groove 24*a*, in the x-axis negative and y-axis positive direction, to the end portion I. The second groove 264 extends from the end portion I in the x-axis negative direction to the end portion 3, in the same manner as the second groove 262 of the first embodiment. A length of the first groove 265 is set in the same manner as the first groove 261 of the first embodiment, and a length of the second groove 264 is set in the same manner as the second groove 262 of the first embodiment. A structure of the longitudinal groove 26*b* is same as the first embodiment.

The first groove 265 is inclined from the second groove 264 (the radial direction of drive shaft 9 or the rising-and-falling direction of vane 6) in the rotational direction of drive shaft 9, namely in the clockwise direction of FIG. 28. The first groove 265 is provided between the discharge port 24 (falcate-shaped groove 24*a*) and the bearing hole 20, and is located in a discharge port 24's side (radially outside the second groove 264) of an area given between the discharge port 24 (falcate-shaped groove 24*a*) and the bearing hole 20. The first groove 265 is located in a range in which the vane 6 slides on the surface 2*a*. Hence, "the first groove 265 is inclined toward the rotational direction of drive shaft 9" specifically means that an offset amount (deviation amount) at a given point of the first groove 265 in the rotational direction of drive shaft 9 with respect to a line passing through the end I in the radial direction of drive shaft 9 becomes greater as the given point of first groove 265 becomes farther from the bearing hole 20 (the center O). In other words, the first groove 265 forms a predetermined angle $\theta$ ($0°<\theta<90°$) with the second groove 264, toward the rotational direction of drive shaft 9. The lateral groove 26*a* constituted by the first groove 265 and the second groove 264 is formed to protrude in the inverse-rotational direction (counterclockwise direction of FIG. 28) of drive shaft 9, as viewed in the z-axis direction. A magnitude of this predetermined angle $\theta$ is equal to the angle $\eta$ of the first embodiment (see FIG. 4).

Moreover, the end portion H" of first groove 265 at which the first groove 265 is continuous with the discharge port 24 (falcate-shaped groove 24*a*) is adjacent to an edge portion 28 of the rear cover 2 in the rotational direction of drive shaft 9. An angle $\kappa$ of the edge portion 28, i.e., an angle $\kappa$ produced between the first groove 265 and the inner circumferential edge 241 of falcate-shaped groove 24*a* is an obtuse angle ($90°<\kappa<180°$). Magnitudes of this angle $\kappa$ and the angle $\rho$ of the first embodiment (see FIG. 4) satisfy a formula: $\kappa\approx(180°-\rho)$. Moreover, the end portion I of first groove 265 at which the first groove 265 is continuous with the second groove 264 is adjacent to an edge portion 29 of the rear cover 2 in the rotational direction of drive shaft 9. An angle $\lambda$ of the edge portion 29, i.e., an angle $\lambda$ produced between the first groove 265 and the second groove 264 is an obtuse angle ($90°<\lambda<180°$).

The first groove 265 is inclined from the radial direction of rotor 5, and thereby forms some angle with the rising-and-falling direction of vane 6. Accordingly, when the vane 6 reaches its position overlapping with the first groove 265 while sliding on the surface 2*a*, the vane 6 intersects with the first groove 265 (as viewed in the z-axis direction) irrespective of the eccentricity state of cam ring 4. At this time, at least a part of the vane 6 is deviated from (does not overlap with) the lateral groove 26*a* (first groove 265). Therefore, the vane 6 which has rotated and moved up to its position corresponding to the first groove 265 is prevented from dropping into the lateral groove 26*a* (first groove 265), so that effects similar as the first embodiment can be obtained.

Moreover, the first groove 265 is inclined in the rotational direction of drive shaft 9 in the eleventh embodiment. Accordingly, when the vane 6 passes over the lateral groove 26*a* while sliding on the surface 2*a*, an interference between each vane 6 and the drive-shaft-rotational-directional edge portion of lateral groove 26*a* is suppressed. Therefore, a wearing-away due to the interference can be prevented, and a smooth operation of pump VP can be achieved.

The following explanations will be given in order to compare the structure of this eleventh embodiment with the structure of the first embodiment. In the first embodiment, the first groove 261 is inclined in the inverse-rotational direction of drive shaft 9 in the sliding range of vane 6 (more specifically, in a region including the sliding range of vane 6, i.e., radially outside the second groove 262). The vane 6 rotates and moves in accordance with the rotation of rotor 5. The vane 6 crosses the edge portion 27 of rear cover 2 immediately after passing through the end portion H of first groove 261. When the lateral surface (z-axis negative side surface) of the vane 6 which has slid in contact with the surface 2*a* of rear cover 2 overlaps with the end portion H of first groove 261 as viewed in the z-axis direction, there is a possibility that the vane 6 is slightly inclined in the z-axis direction to slightly move into the first groove 261 (the end portion H). In this case, this part of vane 6 might make contact with a (drive-shaft inverse-rotational-directional) tip of the edge portion 27. The angle $\rho$ of edge portion 27 is acute angle ($0°<\rho<90°$), and therefore, this tip portion is thin. Hence, when the vane 6 makes contact with this tip, a contact pressure in the edge portion 27 is relatively high.

Contrary to this, in the eleventh embodiment, the first groove 265 is inclined in the rotational direction of drive shaft 9 in the sliding range of vane 6 (radially outside the second groove 264). Hence, the vane 6 crosses the edge portion 28 of rear cover 2 immediately after passing through the end portion H" of first groove 265. In the similar manner as the first embodiment, there is a possibility that the lateral surface (z-axis negative side surface) of the vane 6 which has slid in contact with the surface 2*a* makes contact with a (drive-shaft inverse-rotational-directional) tip of the edge portion 28. However, the angle $\kappa$ of edge portion 28 is obtuse angle ($90°<\kappa<180°$), and this tip portion is thick. Hence, even if the vane 6 makes contact with the tip of edge portion 28, a contact pressure in the edge portion 28 is relatively low. Therefore, an impact can be spread so that the edge portion 28 can be prevented from becoming chipped or worn away.

Moreover, for example, assuming that the second groove 264 is designed to be longer than the second groove 262 of the first embodiment and thereby the end portion I is designed to be in a more radially-outer location (at a location more distant from the center O) than that of the first embodiment, the end portion I might be located within the sliding range of vane 6. In this case, the vane 6 crosses the edge portion 29 of rear cover 2 immediately after passing through the end portion I of first groove 265. There is a possibility that the lateral surface of the vane 6 which is sliding in contact with the surface 2*a* makes contact with a (drive-shaft inverse-rotational-directional) tip of the edge portion 29. However, the angle $\lambda$ of edge portion 29 is obtuse angle, and its tip portion is thick. Hence, even if the vane 6 makes contact with the tip of edge portion 29, a contact pressure in the edge portion 29 is relatively low. Therefore, even on this assumption, the edge portion 29 can be prevented from becoming chipped or worn away. In other words, there is a limit to shortening the length of second groove 264, i.e., the second groove 264 needs a certain level of length. Accordingly, even in case that the end portion I might be located in a radially outer region capable of causing an interference with the base end portion of vane 6 (rising and falling from or into the rotor 5) in dependence upon the swing position of cam ring 4, influences due to this interference can be reduced in the eleventh embodiment.

As explained above, in the eleventh embodiment, the acute-angle portion which causes a relatively high influence due to the contact or interference with the vane 6 is eliminated from the lateral groove 26*a*. Moreover, the bending portion (end portion I) of lateral groove 26*a* is made to form an obtuse angle. Accordingly, the interference between the vane 6 and the lateral groove 26*a* is effectively suppressed so that the wearing-away or the like can be avoided more effectively. Particularly, this advantage becomes more effective in the case that the pump VP is used up to in a high rotational-speed region. That is, the structure of the first embodiment has the advantage that working oil can be actively introduced into the bearing hole 20 by virtue of the tilted structure of the first groove 261 in the inverse-rotational direction of drive shaft 9. On the other hand, the structure of the eleventh embodiment has the advantage that the interference between each vane 6 and the rear cover 2 can be suppressed more effectively by virtue of the tilted structure of the first groove 265 in the rotational direction of drive shaft 9.

Other Embodiments

Although the invention has been described above with reference to certain embodiments of the invention, the invention is not limited to the embodiments described above. Modifications and variations of the embodiments described above will occur to those skilled in the art in light of the above teachings.

For example, in the above respective embodiments, the present invention has been applied to the vane pump. However, the structure according to the present invention is also applicable to a variable displacement oil pump other than the vane-type pump. In the respective embodiments, a fluid which is supplied by the pump VP has been described as oil. However, the structure according to the present invention is also applicable to a supply of the other fluids such as water (for cooling an engine, electric motor, inverter, or the like). In the respective embodiments, the pump VP is used for the vehicle. However, the pump VP according to the present invention may be used for the other mechanical systems. In the respective embodiments, the pump VP is used for the lubrication of internal combustion engine or the like. However, the pump VP according to the present invention may be used for a drive source of a power steering apparatus or the like. In the respective embodiments, the pump VP is used for the internal combustion engine equipped with the variable valve operating apparatus, and the valve timing control apparatus has been mentioned as this variable valve operating apparatus. However, for example, any apparatus which variably controls a valve lift amount and is operated by means of oil pressure may be used as the variable valve operating apparatus other than the valve timing control apparatus. Moreover, the pump VP according to the present invention may be used for an internal combustion engine equipped with no variable valve operating apparatus. In the respective embodiments, the pump VP is driven by the internal combustion engine. However, the pump VP according to the present invention may be driven or rotated by a power source other than the internal combustion engine, for example, an electric motor (for driving a vehicle). Moreover, the pump VP according to the present invention does not need to be driven or rotated in synchronization with the internal combustion engine. In the respective embodiments, the number of vanes (and pump chambers) is seven. However, the pump VP according to the present invention does not limit this number to seven, and may employ the other number of vanes (and pump chambers). Moreover, the pump VP according to the present invention may includes a member formed by integrating the side walls (the rear cover and/or the front cover) with the housing body. Moreover, in the pump VP according to the present invention, the front cover may be formed with the suction hole and/or the discharge hole instead of the rear cover.

In the respective embodiments, the suction port and the discharge port are provided only in the rear cover. However, according to the present invention, the suction port and the discharge port may be provided in both of the front cover and rear cover, or may be provided only in the front cover. Moreover, in the respective embodiments, the bearing oil-feeding groove is provided only in the rear cover. However, according to the present invention, the bearing oil-feeding groove may be provided in both of the front cover and rear cover, or may be provided only in the front cover.

In the respective embodiments, as a method of proving the swing fulcrum of cam ring, the pivot portion protruding from (the main body portion of) the cam ring is disposed into the concave portion (the pivot setting portion) formed in the housing body. However, according to the present invention, a pivot portion protruding from the housing body may be disposed into a concave portion formed in the cam ring. Moreover, according to the present invention, a pivot pin may be used. In this case, by forming a receiving seat (concave portion) in each of the outer circumferential surface of cam ring and the inner circumferential surface of housing body, the pivot pin may be sandwiched between these receiving seats to enable the cam ring to swing about the pivot pin. Alternatively, the cam ring may be formed with a hole into which the pivot pin is inserted.

In the respective embodiments, the biasing member (spring chamber) is provided at a location opposite to the location of swing fulcrum relative to the center of inner circumferential surface of cam ring (relative to y-axis). However, according to the present invention, the biasing member has only to be arranged at a position allowing the biasing member to bias the cam ring in a direction that increases the volume of pump chamber. Therefore, the biasing member may be provided at any point in an outer circumferential region of the cam ring. For example, the biasing member may be provided at a location closer to the swing fulcrum than the center of inner circumferential surface of cam ring. In the respective embodiments, the double coil spring constituted by the first and second coil springs is used as the biasing member. However, according to the present invention, one (linear or nonlinear) coil spring may be used, and alternatively, an elastic member other than the coil spring may be used.

In the respective embodiments, the contact surface of stopper portion is formed over the entire axial range. However, according the present invention, the contact surface of stopper portion does not need to be formed over the entire axial range unless the sealing function is impaired under the initial setting state. For example, a part of the contact surface may be notched so that the control chamber is partly communicated with the backpressure chamber under the contacted state.

In the respective embodiments, the both contact surfaces 140 and 430 configured to become in surface-contact with each other are formed as flat surfaces. However, according to the present invention, each of the both contact surfaces may be formed in a shape other than the flat surface. For example, the both contact surfaces may be formed as concave and convex curved surfaces which are engaged with each other so that the concave and convex curved surfaces become in surface-contact with each other.

In the respective embodiments, the housing body is made of aluminum-based metallic material, and the cam ring is made of iron-based metallic material. However, according to the present invention, each of these two members may be made of the other material. Alternatively, the housing body and cam ring may be formed of materials equivalent in strength to each other, more alternatively, the cam ring may be formed of a material softer than the housing body so as to obtain effects similar as the above respective embodiments.

In the above first embodiment, the contact surface which becomes in contact with the outer circumferential surface (contact surface 430) of cam ring is formed in the inner circumferential surface of housing (housing body). However, according to the present invention, (a member including) the contact portion may be provided as another member separated from the housing. In the same manner, in the ninth embodiment, (a member including) the contact surface which becomes in contact with the outer circumferential surface of cam ring (arm portion) may be provided as another member separated from the housing.

In the first embodiment, the contact surface 430 which becomes in contact with the contact portion (contact surface 140) of housing (housing body) is formed in the protruding portion 43 protruding in the radially outer direction of cam ring. However, according to the present invention, for example, a concave portion depressed in the radially inner direction may be formed in the outer circumferential surface of cam ring to allow an inner circumferential surface of this concave portion to become in contact with the contact portion (contact surface 140) of housing.

In the first embodiment, the shape of protruding portion 43 as viewed in the z-axis direction is formed approximately in the triangle shape. However, according to the present invention, the shape of protruding portion 43 as viewed in the z-axis direction may be formed in the other shape such as a rectangular shape or a circular-arc shape.

In the first embodiment, some angle is formed between the stopper portion (contact surfaces 140 and 430) and the choking portion (choke forming surfaces 150 and 431). However, according to the present invention, the angle between the stopper portion and the choking portion is not indispensable.

In the first embodiment, the choking portion (choke forming surface 431 and the like) is provided adjacent to the stopper portion (contact surface 140 and the like). However, according to the present invention, the choking portion may be provided away from the stopper portion. That is, the choking portion may be provided at any point in the outer circumferential portion of cam ring which is located in the direction that increases the eccentricity of cam ring by the bias of biasing member.

In the first embodiment, the facing area of the choking portion is greater than the contact area of the stopper portion in the all the states from the initial setting state to the minimum eccentricity state. However, according to the present invention, these both areas may be provided so as to reverse the (square measure) values of these both areas at the time of transfer between the initial setting state and the minimum eccentricity state, so that the facing area of choking portion becomes smaller than or equal to the contact area of stopper portion when the swing amount of cam ring becomes greater than or equal to a predetermined value. Moreover, the choking portion and the stopper portion may be provided such that the contact area of the stopper portion is greater than the facing area of the choking portion under the all the states from the initial setting state to the minimum eccentricity state.

In the fourth embodiment, the protrusion 142 is provided at a point (y-axis-positive end) of base bottom surface 141 which is near the connecting portion between the stopper portion and the choking portion. However, according to the present invention, the location of this protrusion 142 is not limited to this. For example, the protrusion 142 may be provided near an end (y-axis-negative end) of base bottom surface 141 which is located opposite to the connecting portion between the stopper portion and the choking portion. Similarly, in the fifth embodiment, the protrusion 433 is provided at the y-axis-positive end of base bottom surface 432 which is adjacent to the choke forming surface 431. However, according to the present invention, the location of this protrusion 433 is not limited to this. For example, the protrusion 433 may be formed at a center portion of base bottom surface 432 so as to allow the protrusion 433 to abut on a y-axis negative portion of the contact surface 143.

In the fourth embodiment, the protruding portion 14 is shaped like a triangle. However, according to the present invention, a part of the protruding portion 14 which is located in a radially inner side (a y-axis negative region) beyond the protrusion 142 is not indispensable and therefore may be omitted. Similarly, in the fifth embodiment, the protruding portion 14 is shaped like a triangle. However, according to the present invention, a part of the protruding portion 14 which is located in a radially inner side (a y-axis negative region) beyond its portion contacted with the protrusion 433 is not indispensable and therefore may be omitted. That is, by virtue of the structure of line contact, a necessary space can be saved as compared with the case of surface contact as the first embodiment.

In the sixth embodiment, the surface (contact surface 143) of housing which becomes in contact with the protrusion 433 is formed flat. However, according to the present invention, this contact surface may be formed as a concave curved surface shaped like a circular arc as viewed in the z-axis direction, which has a larger radius of curvature than the protrusion 433. Moreover, in the sixth embodiment, the protrusion 433 is provided in the cam ring. However, in the same manner as the fourth embodiment, such a protrusion may be provided in the housing body 1 to allow this protrusion to abut on the contact surface of cam ring 4. In this case, this contact surface of cam ring 4 may be formed as a flat surface or a concave curved surface (shaped like a circular arc as viewed in the z-axis direction, which has a larger radius of curvature than the protrusion).

In the seventh or eighth embodiment, the flow-passage cross-sectional area of choking portion is varied by forming the choke forming surface 431 of cam ring 4 as an arc-shaped curve defining the point Q' or Q" as a center of the arc. This point Q' or Q" is shifted from the swing fulcrum Q. However, according to the present invention, the choke forming surface 431 may be appropriately formed in the other shape in order to cause the variation of flow-passage cross-sectional area of choking portion to have a desired characteristic (for example, nonlinear characteristic).

In the ninth embodiment, the contact portion 19 constituting the stopper portion is formed to protrude from (main body of) the housing body 1, i.e., the housing body 1 includes the contact portion 19. However, according to the present invention, such a contact portion may be protrude from the arm portion 42 of cam ring 4, i.e., the cam ring 4 includes the contact portion. In the ninth embodiment, the first and second choking portions are formed as the side surfaces of the triangular-shaped protruding portion 14 or protruding portion 43 as viewed in the axial direction. However, according to the present invention, the shape of protruding portion 14 or protruding portion 43 may be formed in the other shape such as a rectangular shape or a circular-arc shape, as viewed in the axial direction. Moreover, the first and second choking portion may be formed at locations away from each other. Moreover, in the same manner as the seventh and eighth embodiments, a flow-passage cross-sectional area of the first choking portion and/or the second choking portion may be configured to vary in dependence upon the swing state of cam ring 4. Moreover, the first choking portion may be omitted.

In the respective embodiments, there is provided the bearing oil-feeding groove 26. However, according to the present invention, the bearing oil-feeding groove 26 is not indispensable.

In the first and eleventh embodiments, the angle $\eta$ or $\theta$ of lateral groove 26*a* can be appropriately set at any value which ranges from 0-degree to 90-degrees and which prevents the vane 6 from dropping into the lateral groove 26*a* in relation to the groove width of the first groove 261 and 265 or the like.

In the first and eleventh embodiments, the linear portion (first groove 261 or 265) tilted from the radial direction of drive shaft 9 is provided in the lateral groove 26*a* so that the lateral groove 26*a* intersects with the vane 6. However, according to the present invention, for example, the lateral groove 26*a* may be bent in a curved line so that the lateral groove 26*a* intersects with the vane 6.

In the first and eleventh embodiments, the lateral groove 26*a* extends in the radial direction of drive shaft 9 from the bearing-portion-side end J to the predetermined location I and then is inclined from this extending direction by extending linearly from the predetermined location I to the discharge-portion-side end H. However, according to the present invention, the lateral groove may be formed to extend linearly in the entire range from the bearing-portion-side end to the discharge-portion-side end so as to be inclined from the radial direction of drive shaft 9, without providing the portion (second groove 262 or 264) extending in the radial direction of drive shaft. Moreover, the lateral groove may be formed to extend from the bearing-portion-side end to a predetermined location so as to be inclined from the radial direction of drive shaft 9 and then extends from the predetermined location to the discharge-portion-side end in the radial direction of drive shaft 9. In this case, by positioning this radially extending portion of lateral groove at a region radially outside the (radially-inner) base end portion of vane 6, at least a part (the base end portion) of vane 6 is deviated from (does not overlap with) the lateral groove so that vane 6 can be prevented from dropping to some extent.

In the tenth embodiment, the groove width of the entire range of lateral groove 26*a* is set narrower than the thickness of vane. However, according to the present invention, the lateral groove 26*a* may be formed such that only one part of lateral groove 26*a* has a groove width narrower than the thickness of vane. For example, a part of lateral groove 26*a* which is located within the sliding or passing range of vane as viewed in the z-axis direction may be made narrower than the thickness of vane, so that the vane can be prevented from dropping.

In the respective embodiments, the bearing oil-feeding groove 26 (lateral groove 26*a*) communicates the discharge port 24 with the bearing hole 20. However, according to the present invention, such a bearing oil-feeding groove may communicate the suction port 23 with the bearing hole 20. Moreover, in the respective embodiments; the end J of lateral groove 26*a* can be provided at any circumferential point of the bearing hole 20, and the end H, H' or H" can be provided at any point of the discharge port 24 (or the suction port 23).

In the respective embodiments, the longitudinal groove 26*b* is formed. However, according to the present invention, the longitudinal groove 26*b* is not indispensable. Moreover, in the respective embodiments, the longitudinal groove 26*b* includes the bottom portion 263 so as to enclose the longitudinal groove 26*b*. However, according to the present invention, a longitudinal groove passing through the housing HSG from the inside of housing HSG to the outside of housing HSG may be provided without providing the bottom portion 263.

In the respective embodiments, the bearing oil-feeding groove 26 is mold concurrently when molding the rear cover 2 by means of die molding. However, according to the present invention, the bearing oil-feeding groove 26 may be formed by means of cutting work or the like, after molding the housing (rear cover 2) by means of die molding.

According to the present invention, the structures of above respective embodiments can be properly combined or mixed with one another.

This application is based on prior Japanese Patent Application No. 2009-057396 filed on Mar. 11, 2009. The entire contents of this Japanese Patent Application are hereby incorporated by reference.

The scope of the invention is defined with reference to the following claims.

What is claimed is:

1. A variable displacement oil pump comprising:

a rotor configured to be rotationally driven by an internal combustion engine;

a plurality of vanes movable out from and into an outer circumferential portion of the rotor;

a cam ring configured to:

receive the rotor and the plurality of vanes in an inner circumferential space of the cam ring, cooperate with side walls, the rotor and the plurality of vanes to separately form a plurality of working-oil chambers, wherein the side walls are provided on both axial side surfaces of the cam ring, and swing about a swing fulcrum to vary an eccentricity between a rotation center of the rotor and a center of an inner circumferential surface of the cam ring;

a housing configured to receive the cam ring therein, and including:

a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and a suction portion open to at least one of the plurality of working-oil chambers from at least one of the side walls, wherein the at least one of the plurality of working-oil chambers to which the suction portion is open, increases its volume when the center of the inner circumferential surface of the cam ring becomes eccentric relative to the rotation center of the rotor;

a biasing member configured to bias the cam ring in a direction that enlarges the eccentricity between the rotation center of the rotor and the center of the inner circumferential surface of the cam ring;

a contact surface configured to become in contact with an outer circumferential surface of the cam ring by means of a biasing force applied to the cam ring by the biasing member, wherein a distance between the swing fulcrum and the contact surface is shorter than a distance between the swing fulcrum and a portion at which the cam ring is biased by the biasing member;

a control chamber separately formed by the contact surface and the swing fulcrum of the cam ring on an outer circumference of the cam ring when the contact surface is in contact with the outer circumferential surface of the cam ring, and configured to cause the cam ring to swing against the biasing force of the biasing member by a pressure introduced from the discharge portion to the control chamber; and a choking portion formed on the outer circumferential surface of the cam ring and configured to maintain a pressure of the control chamber even when the cam ring swings.

2. The variable displacement oil pump as claimed in claim 1, wherein the outer circumferential surface of the cam ring includes a flat surface; and the contact surface is a flat surface configured to become in contact with the flat surface of the cam ring by means of surface contact.

3. The variable displacement oil pump as claimed in claim 1, wherein the contact surface is formed in an inner circumferential surface of the housing.

4. The variable displacement oil pump as claimed in claim 1, wherein the choking portion is formed to prevent its flow-passage cross-sectional area from changing, even when the cam ring swings.

5. The variable displacement oil pump as claimed in claim 1, wherein the choking portion is formed to reduce its flow-passage cross-sectional area when the cam ring swings.

6. The variable displacement oil pump as claimed in claim 1, wherein the choking portion is formed to enlarge its flow-passage cross-sectional area when the cam ring swings.

7. The variable displacement oil pump as claimed in claim 1, wherein the contact surface is located adjacent to the choking portion.

8. The variable displacement oil pump as claimed in claim 7, wherein the contact surface and the choking portion are provided to form some angle between the contact surface and the choking portion.

9. The variable displacement oil pump as claimed in claim 8, wherein the contact surface and the choking portion are formed in an inner circumferential surface of the housing; and a boundary portion between the contact surface and the choking portion is notched in a direction in which the outer circumferential surface of the cam ring and the inner circumferential surface of the housing are made away from each other when the cam ring swings.

10. The variable displacement oil pump as claimed in claim 1, wherein the contact surface is configured to become in contact with the outer circumferential surface of the cam ring by means of line contact along an axial direction of the cam ring.

11. The variable displacement oil pump as claimed in claim 1, wherein the contact surface is formed of a material softer than the cam ring.

12. The variable displacement oil pump as claimed in claim 11, wherein the contact surface is formed in an inner circumferential surface of the housing;

the housing is molded of aluminum-based metallic material; and the cam ring is molded of iron-based metallic material.

13. The variable displacement oil pump as claimed in claim 1, wherein an outer circumferential space of the cam ring which is other than the control chamber is communicated with the suction portion.

14. The variable displacement oil pump as claimed in claim 13, wherein the biasing member is disposed on a side opposite to a location of the swing fulcrum relative to the cam ring, in the outer circumferential space of the cam ring which is other than the control chamber.

15. A variable displacement oil pump comprising:

a rotor configured to be rotationally driven;

a plurality of vanes movable out from and into an outer circumferential portion of the rotor;

a cam ring configured to:

receive the rotor and the plurality of vanes in an inner circumferential space of the cam ring, cooperate with side walls, the rotor and the plurality of vanes to separately form a plurality of working-oil chambers, wherein the side walls are provided on both axial side surfaces of the cam ring, and swing about a swing fulcrum to vary an eccentricity between a rotation center of the rotor and a center of an inner circumferential surface of the cam ring, wherein the swing fulcrum is formed over an entire axial range of the cam ring;

a housing configured to receive the cam ring therein, and including:

a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and a suction portion open to at least one of the plurality of working-oil chambers from at least one of the side walls, wherein the at least one of the plurality of working-oil chambers to which the suction portion is open increases its volume when the center of the inner circumferential surface of the cam ring becomes eccentric relative to the rotation center of the rotor;

a biasing member configured to bias the cam ring in a direction that enlarges the eccentricity between the rotation center of the rotor and the center of the inner circumferential surface of the cam ring;

a contact portion configured to become in contact with an entire axial range of an outer circumferential surface of the cam ring by means of a biasing force applied to the cam ring by the biasing member, wherein a distance between the swing fulcrum and the contact portion is shorter than a distance between the swing fulcrum and a portion at which the cam ring is biased by the biasing member;

a control chamber provided at a portion of an outer circumferential space of the cam ring which is located in the direction that enlarges the eccentricity of the cam ring and which is between the contact portion and the swing fulcrum of the cam ring, wherein the control chamber is open to the discharge portion; and a choking portion formed in a portion of the outer circumferential surface of the cam ring which is located in the direction that enlarges the eccentricity of the cam ring, wherein the choking portion has a shape extending along a swing path of the cam ring.

16. The variable displacement oil pump as claimed in claim 15, wherein the cam ring comprises a protrusion protruding in a radially outer direction of the cam ring; and the contact portion is configured to become in contact with the protrusion.

17. The variable displacement oil pump as claimed in claim 15, wherein the contact portion is configured to become in contact with a first portion of the cam ring;

the choking portion is provided in a second portion of the cam ring; and the first portion is closer to the swing fulcrum than the second portion.

18. The variable displacement oil pump as claimed in claim 15, wherein an area of the choking portion is larger than a contact area between the contact portion and the outer circumferential surface of the cam ring under a state that the cam ring is eccentric at its maximum relative to the rotor.

19. A variable displacement oil pump comprising:

a rotor configured to be rotationally driven;

a plurality of vanes movable out from and into an outer circumferential portion of the rotor;

a cam ring configured to:

receive the rotor and the plurality of vanes in an inner circumferential space of the cam ring, cooperate with side walls, the rotor and the plurality of vanes to separately form a plurality of working-oil chambers, wherein the side walls are provided on both axial side surfaces of the cam ring, and swing about a swing fulcrum to vary an eccentricity between a rotation center of the rotor and a center of an inner circumferential surface of the cam ring, wherein the swing fulcrum is formed over an entire axial range of the cam ring;

a housing configured to receive the cam ring therein, and including:

a discharge portion open to at least one of the plurality of working-oil chambers from at least one of the side walls, wherein the at least one of the plurality of working-oil chambers reduces its volume when the center of the inner circumferential surface of the cam ring becomes eccentric relative to the rotation center of the rotor, and a suction portion open to at least one of the plurality of working-oil chambers from at least one of the side walls, wherein the at least one of the plurality of working-oil chambers to which the suction portion is open increases its volume when the center of the inner circumferential surface of the cam ring becomes eccentric relative to the rotation center of the rotor;

a biasing member configured to bias the cam ring in a direction that enlarges the eccentricity between the rotation center of the rotor and the center of the inner circumferential surface of the cam ring;

a contact portion configured to become in contact with an entire axial range of an outer circumferential surface of the cam ring by means of a biasing force applied to the cam ring by the biasing member;

a control chamber provided at a portion of an outer circumferential space of the cam ring which is located in the direction that enlarges the eccentricity of the cam ring and which is between the contact portion and the swing fulcrum of the cam ring, wherein the control chamber is open to the discharge portion; and a choking portion formed in a portion of the outer circumferential surface of the cam ring which is located in the direction that enlarges the eccentricity of the cam ring, wherein the choking portion has a shape, extending along a swing path of the cam ring, wherein the cam ring includes a protrusion protruding in a radially outer direction of the cam ring, and the contact portion is configured to become in contact with the protrusion, wherein the protrusion protrudes substantially in a triangle shape, one side surface of the triangle-shaped protrusion becomes in contact with the contact portion, and the choking portion is provided in another side surface of the triangle-shaped protrusion.

* * * * *